US011535942B2

(12) United States Patent
Shibayama et al.

(10) Patent No.: US 11,535,942 B2
(45) Date of Patent: Dec. 27, 2022

(54) COATING METHOD

(71) Applicant: NISSAN MOTOR CO., LTD., Yokohama (JP)

(72) Inventors: Hirohisa Shibayama, Kanagawa (JP); Hidenobu Matsuyama, Kanagawa (JP); Eiji Shiotani, Kanagawa (JP); Yoshitsugu Noshi, Kanagawa (JP); Koukichi Kamada, Kanagawa (JP); Naoki Okamoto, Kanagawa (JP); Masahito Fujikawa, Kanagawa (JP); Junichi Hamasaki, Kanagawa (JP); Masatoshi Inoguchi, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 17/276,630

(22) PCT Filed: Sep. 18, 2018

(86) PCT No.: PCT/JP2018/034350
§ 371 (c)(1),
(2) Date: Mar. 16, 2021

(87) PCT Pub. No.: WO2020/059003
PCT Pub. Date: Mar. 26, 2020

(65) Prior Publication Data

US 2022/0042177 A1 Feb. 10, 2022

(51) Int. Cl.

| | |
|---|---|
| ***C23C 24/04*** | (2006.01) |
| ***B22F 5/00*** | (2006.01) |
| *F01L 3/04* | (2006.01) |

(52) U.S. Cl.
CPC ..... *C23C 24/04* (2013.01); *B22F 5/008* (2013.01); *F01L 3/04* (2013.01)

(58) Field of Classification Search
None
See application file for complete search history.

(56) References Cited

U.S. PATENT DOCUMENTS

2014/0291885 A1* 10/2014 Etchegoyen ..... C23C 24/04 425/375
2015/0197858 A1 7/2015 Corbeil et al.
(Continued)

FOREIGN PATENT DOCUMENTS

CN 106367750 A 2/2017
DE 10 2006 029 070 B3 8/2007
(Continued)

OTHER PUBLICATIONS

Blochet et al.; Influence of Spray Angle on Cold Spray with AI for the Repair of Aircraft Components; XP055826836, pp. 1-7; May 31, 2014.*

(Continued)

*Primary Examiner* — Michael P. Rodriguez
(74) *Attorney, Agent, or Firm* — Foley & Lardner LLP

(57) ABSTRACT

When forming valve seat coats at opening portions (16$a_1$ to 16$a_8$) of intake ports (16) provided at a cylinder block mounting surface (12*a*) of a semimanufactured cylinder head (3), the nozzle of a cold spray apparatus moves along a nozzle movement path for air intake (Inp1) that is set between any two of the plurality of opening portions (16$a_1$ to 16$a_8$), while continuing to spray a raw material powder. When forming valve seat coats at opening portions (17$a_1$ to 17$a_8$) of exhaust ports (17), the nozzle moves along a nozzle movement path for air exhaust (Enp1) that is set between any two of the plurality of opening portions (17$a_1$ to 17$a_8$), while continuing to spray the raw material powder.

9 Claims, 33 Drawing Sheets

(56) References Cited

U.S. PATENT DOCUMENTS

| | | | |
|---|---|---|---|
| 2017/0250122 | A1 | 8/2017 | Hamweendo et al. |
| 2018/0223902 | A1 | 8/2018 | Izawa |

FOREIGN PATENT DOCUMENTS

| | | | | | |
|---|---|---|---|---|---|
| DE | 102006029070 | B3 | * | 8/2007 | ..... C23C 24/04 |
| JP | 2016-200043 | A | | 12/2016 | |
| JP | 2016200043 | A | * | 12/2016 | |
| WO | WO 2017/022505 | A1 | | 2/2017 | |

OTHER PUBLICATIONS

Blochet Quentin et al., "Influence of Spray Angle on Cold Spray with A1 for the Repair of Aircraft Components", May 31, 2014, pp. 1-7, retrieved from the Internet: URL: https://www.researchgate.net/publication/281330261_Influence_of_spray_angle_on_cold_spray_with_A1_for_the_repair_of_aircraft_components, retrieved on Jul. 22, 2021.

* cited by examiner

COATING METHOD

TECHNICAL FIELD

The present invention relates to a coating method using a cold spray method.

BACKGROUND ART

A method of manufacturing a sliding member is known, which includes spraying a raw material powder such as metal powder onto the seating portion of an engine valve using a cold spray method thereby to be able to form a valve seat having excellent high-temperature wear resistance (Patent Document 1).

PRIOR ART DOCUMENT

Patent Document

[Patent Document 1] WO2017/022505

SUMMARY OF INVENTION

Problems to be Solved by Invention

Engines such as those of automobiles include a plurality of intake and exhaust engine valves because of the multi-valve system. Accordingly, when valve seats are formed on the seating portions of a plurality of engine valves using a cold spray method, it is necessary to relatively move the cylinder head and the nozzle of a cold spray apparatus, cause each of the plurality of seating portions and the nozzle to sequentially face each other, and inject a raw material powder from the nozzle to spray the powder onto the seating portion facing the nozzle.

However, when suspending the injection of the raw material powder, the cold spray apparatus requires a waiting time of several minutes until the raw material powder can be stably sprayed again. Thus, in the case of forming coats on a plurality of coating portions such as seating portions using the cold spray method, if the spraying of the raw material powder and its stopping are repeated for each coating portion, the cycle time will increase due to the waiting time of the cold spray apparatus.

A problem to be solved by the present invention is to provide a coating method in which the cycle time when forming coats on a plurality of coating portions using the cold spray method can be shorter than that when forming coats on the plurality of coating portions by repeating the spraying of the raw material powder and its stopping.

Means for Solving Problems

The present invention solves the above problem through, when relatively moving the nozzle of a cold spray apparatus, continuing the injection of a raw material powder from the nozzle and setting an angle of the nozzle with respect to the coating target component larger or smaller than that when the nozzle forms coats on the coating portions in a nozzle movement path from a coating portion having been formed with the coat to another coating portion to be subsequently formed with the coat.

Effect of Invention

According to the present invention, the coats are sequentially formed on the plurality of coating portions without stopping the injection of the raw material powder, and the cycle time can therefore be shorter than that when forming coats on the plurality of coating portions by repeating the spraying of the raw material powder and its stopping.

BRIEF DESCRIPTION OF DRAWINGS

FIG. 20AB is a cross-sectional view illustrating a spraying angle of raw material powder in the coating methods according to the first to fourth embodiments of the present invention and illustrates the spraying angle on a nozzle movement path.

FIG. 20BB is a cross-sectional view illustrating spraying angles of raw material powder in the coating method according to a fifth embodiment of the present invention and illustrates the spraying angle on a nozzle movement path.

FIG. 20CB is a cross-sectional view illustrating spraying angles of raw material powder in the coating method according to the fifth embodiment of the present invention and illustrates the spraying angle on a nozzle movement path.

MODE(S) FOR CARRYING OUT THE INVENTION

Figure 1:
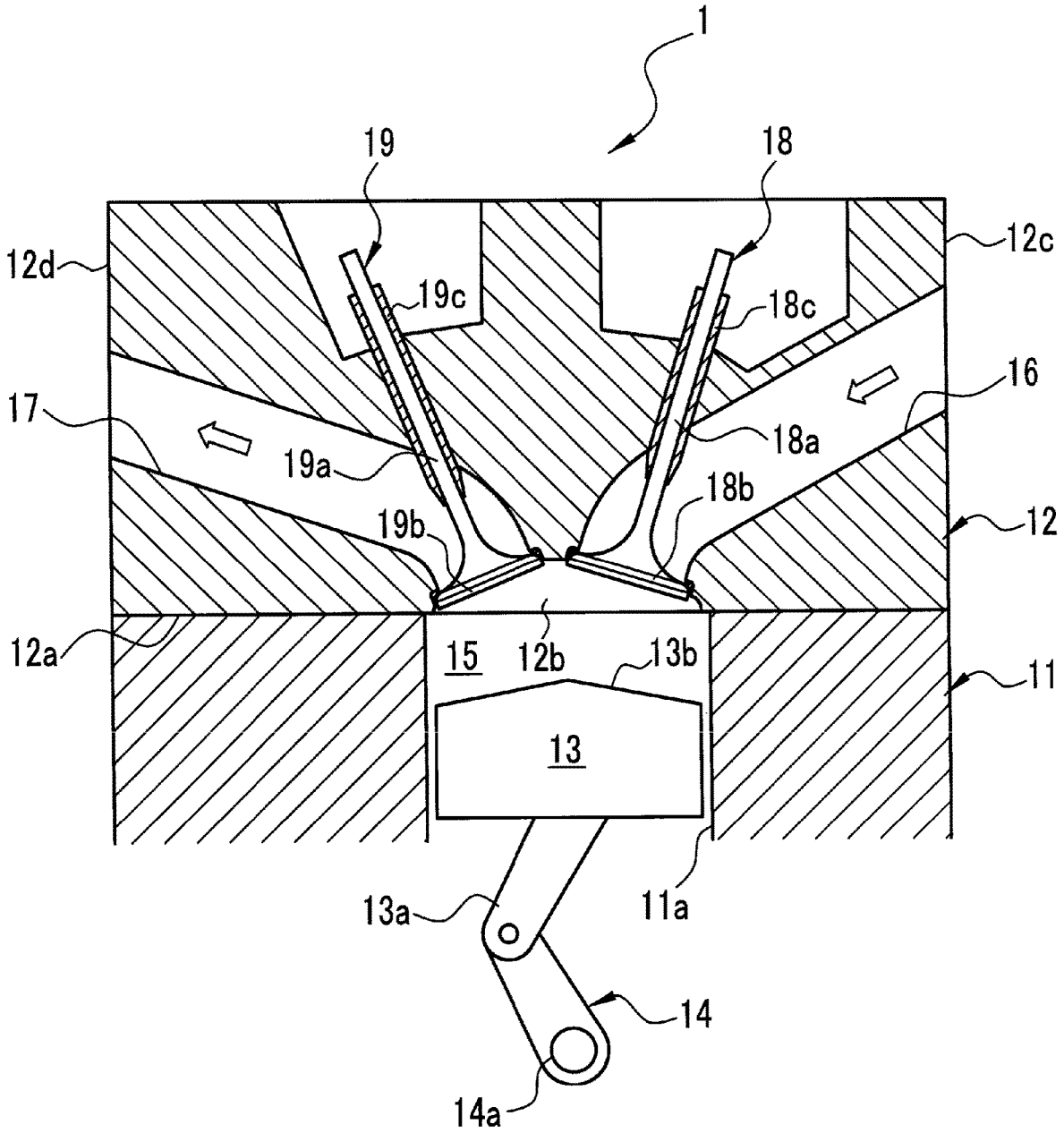
FIG. 1 is a cross-sectional view illustrating the configuration of an engine including a cylinder head in which valve seat coats are formed using the coating method according to one or more embodiments of the present invention.

Hereinafter, one or more embodiments of the present invention will be described with reference to the drawings. First, an engine 1 will be described, which includes valve seat coats formed using the coating method according to one or more embodiments of the present invention. FIG. 1 is a cross-sectional view of the engine 1 and mainly illustrates the configuration around the cylinder head.

The engine 1 includes a cylinder block 11 and a cylinder head 12 that is mounted on the upper portion of the cylinder block 11. The engine 1 is, for example, a four-cylinder gasoline engine, and the cylinder block 11 has four cylinders 11*a* arranged in the depth direction of the drawing sheet. The cylinders 11*a* house respective pistons 13 that reciprocate in the vertical direction in the figure. Each piston 13 is connected to a crankshaft 14, which extends in the depth direction of the drawing sheet, via a connecting rod 13*a*.

The cylinder head 12 has a cylinder block mounting surface 12*a* that is a surface for being mounted on the cylinder block 11. The cylinder block mounting surface 12*a* is provided with four combustion chamber upper wall portions 12*b* at positions corresponding to respective cylinders 11*a*. The combustion chamber upper wall portions 12*b* define combustion chambers 15 of the cylinders. Each combustion chamber 15 is a space for combusting a mixture gas of fuel and intake air and is defined by a combustion chamber upper wall portion 12*b* of the cylinder head 12, a top surface 13*b* of the piston 13, and an inner surface of the cylinder 11*a*.

The cylinder head 12 includes ports for air intake (referred to as intake ports, hereinafter) 16 that connect between the combustion chambers 15 and one side surface 12*c* of the cylinder head 12. The intake ports 16 have a curved, approximately cylindrical shape and supply intake air from an intake manifold (not illustrated) connected to the side surface 12*c* into respective combustion chambers 15. The air supplied into each combustion chamber 15 is mixed with gasoline supplied from an injector, which is not illustrated, to generate a mixture gas.

The cylinder head 12 further includes ports for air exhaust (referred to as exhaust ports, hereinafter) 17 that connect between the combustion chambers 15 and the other side surface 12*d* of the cylinder head 12. The exhaust ports 17 have a curved, approximately cylindrical shape like the intake ports 16 and exhaust the exhaust gas generated by the combustion of the mixture gas in respective combustion chambers 15 to an exhaust manifold (not illustrated) connected to the side surface 12*d*. The engine 1 according to one or more embodiments of the present invention is a multi-valve-type engine, and one cylinder 11*a* is provided with two intake ports 16 and two exhaust ports 17.

The cylinder head 12 is provided with intake valves 18 that open and close the intake ports 16 with respect to the combustion chambers 15 and exhaust valves 19 that open and close the exhaust ports 17 with respect to the combustion chambers 15. Each intake valve 18 includes a round rod-shaped valve stem 18*a* and a disk-shaped valve head 18*b* that is provided at the tip of the valve stem 18*a*. Likewise, each exhaust valve 19 includes a round rod-shaped valve stem 19*a* and a disk-shaped valve head 19*b* that is provided at the tip of the valve stem 19*a*. The valve stems 18*a* and 19*a* are slidably inserted into approximately cylindrical valve guides 18*c* and 19*c*, respectively. This allows the intake valves 18 and the exhaust valves 19 to be movable with respect to the combustion chambers 15 along the axial directions of the valve stems 18*a* and 19*a*.

Figure 2:
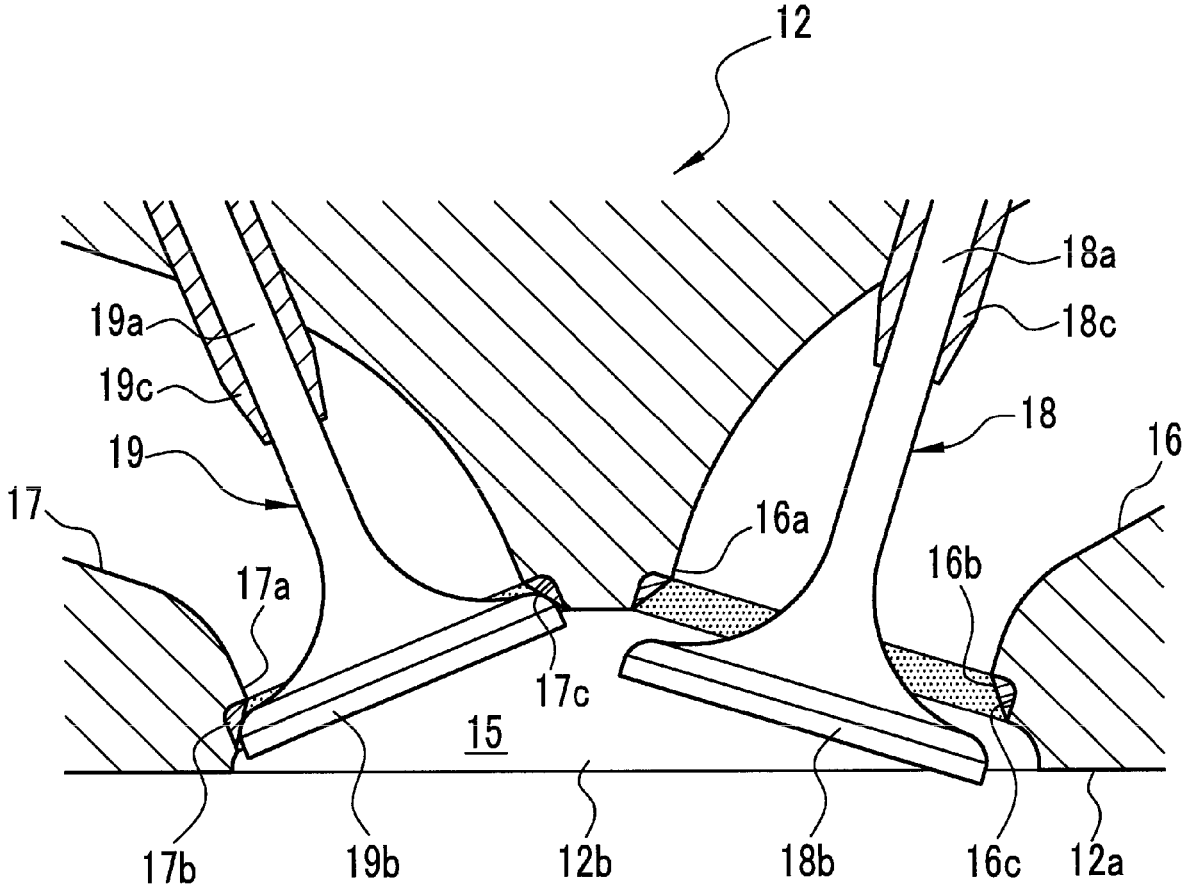
FIG. 2 is a cross-sectional view illustrating the configuration around valves of the cylinder head in which the valve seat coats are formed using the coating method according to one or more embodiments of the present invention.

FIG. 2 is an enlarged view illustrating a portion in which a combustion chamber 15 communicates with an intake port 16 and an exhaust port 17. The intake port 16 includes an approximately circular opening portion 16*a* at the portion communicating with the combustion chamber 15. The opening portion 16*a* has an annular edge portion provided with an annular valve seat coat 16*b* that abuts against the valve head 18*b* of an intake valve 18. When the intake valve 18 moves upward along the axial direction of the valve stem 18*a*, the upper surface of the valve head 18*b* comes into contact with the valve seat coat 16*b* to close the intake port 16. When the intake valve 18 moves downward along the axial direction of the valve stem 18*a*, a gap is formed between the upper surface of the valve head 18*b* and the valve seat coat 16*b* to open the intake port 16.

Like the intake port 16, the exhaust port 17 includes an approximately circular opening portion 17*a* at the portion communicating with the combustion chamber 15, and the opening portion 17*a* has an annular edge portion provided with an annular valve seat coat 17*b* that abuts against the valve head 19*b* of an exhaust valve 19. When the exhaust valve 19 moves upward along the axial direction of the valve stem 19*a*, the upper surface of the valve head 19*b* comes into contact with the valve seat coat 17*b* to close the exhaust port 17. When the exhaust valve 19 moves downward along the axial direction of the valve stem 19*a*, a gap is formed between the upper surface of the valve head 19*b* and the valve seat coat 17*b* to open the exhaust port 17.

In the four-cycle engine 1, for example, only the intake valve 18 opens when the corresponding piston 13 moves down, and the mixture gas is introduced from the intake port 16 into the cylinder 11*a*. In an in-cylinder injection-type engine, or a so-called direct injection-type engine, gasoline is injected into the cylinder 11*a* from the injector, and air is introduced into the cylinder 11*a* from the intake port 16 to generate a mixture gas. Subsequently, in a state in which the intake valve 18 and the exhaust valve 19 are closed, the piston 13 moves up to compress the mixture gas in the cylinder 11*a*, and when the piston 13 approximately reaches the top dead center, the mixture gas is ignited to explode by a spark plug, which is not illustrated. This explosion makes the piston 13 move down to the bottom dead center and is converted into the rotational force via the connected crankshaft 14. When the piston 13 reaches the bottom dead center and starts moving up again, only the exhaust valve 19 is opened to exhaust the exhaust gas in the cylinder 11*a* to the exhaust port 17. The engine 1 repeats the above cycle to generate the output.

The opening portions 16*a* and 17*a* of the cylinder head 12 have respective annular edge portions, and the valve seat coats 16*b* and 17*b* are formed directly on the annular edge portions using a cold spray method. The cold spray method refers to a method that includes making a supersonic flow of an operation gas having a temperature lower than the melting point or softening point of a raw material powder, injecting the raw material powder carried by a carrier gas into the operation gas to spray the raw material powder from a nozzle tip, and causing the raw material powder in the solid phase state to collide with a base material to form a coat by plastic deformation of the raw material powder. Compared with a thermal spray method in which the material is melted and deposited on a base material, the cold spray method has features that a dense coat can be obtained without oxidation in the air, thermal alteration is suppressed because of less thermal effect on the material particles, the coating speed is high, the coat can be made thick, and the deposition efficiency is high. In particular, the cold spray method is suitable for the use for structural materials such as the valve seat coats 16*b* and 17*b* of the engine 1 because the coating speed is high and the coats can be made thick.

Figure 3:
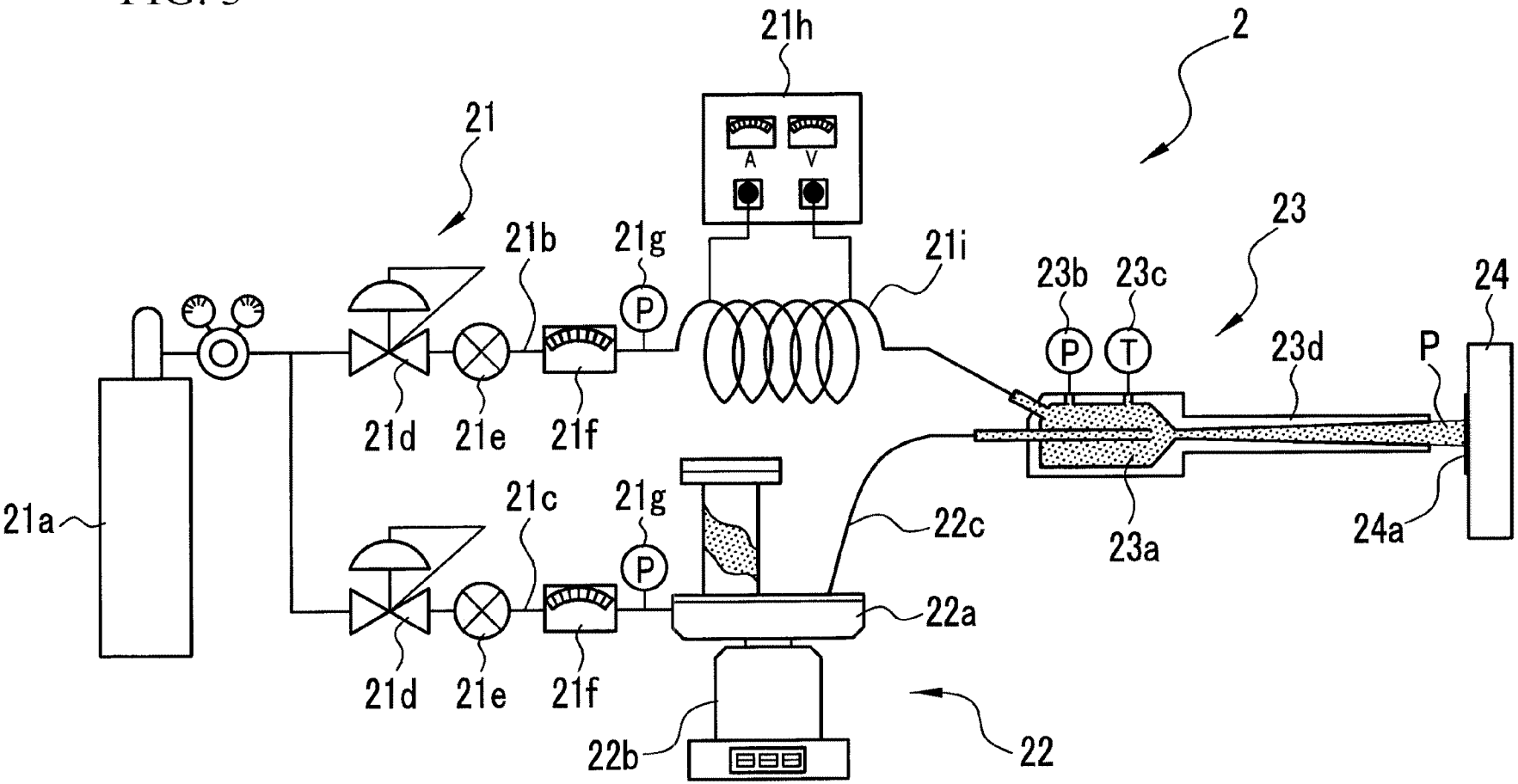
FIG. 3 is a schematic view illustrating the configuration of a cold spray apparatus used in the coating method according to one or more embodiments of the present invention.

FIG. 3 illustrates the schematic configuration of a cold spray apparatus used for the cold spray method. The cold spray apparatus 2 includes a gas supply unit 21 that supplies an operation gas and a carrier gas, a raw material powder supply unit 22 that supplies a raw material powder, and a cold spray gun 23 that sprays the raw material powder as a supersonic flow using the operation gas having a temperature equal to or lower than the melting point of the raw material powder.

The gas supply unit 21 includes a compressed gas cylinder 21*a*, an operation gas line 21*b*, and a carrier gas line 21*c*. Each of the operation gas line 21*b* and the carrier gas line 21*c* includes a pressure regulator 21*d*, a flow rate control valve 21*e*, a flow meter 21*f*, and a pressure gauge 21*g*. The pressure regulators 21*d*, the flow rate control valves 21*e*, the flow meters 21*f*, and the pressure gauges 21*g* are used for adjusting the pressure and flow rate of the operation gas and carrier gas from the compressed gas cylinder 21*a*.

The operation gas line 21*b* is installed with a heater 21*i* heated by a power source 21*h*. The operation gas is heated by the heater 21*i* to a temperature lower than the melting point or softening point of the raw material and then introduced into a chamber 23*a* in the cold spray gun 23. The chamber 23*a* is installed with a pressure gauge 23*b* and a thermometer 23*c*, which are used for feedback control of the pressure and temperature.

On the other hand, the raw material powder supply unit 22 includes a raw material powder supply device 22*a*, which is provided with a weighing machine 22*b* and a raw material powder supply line 22*c*. The carrier gas from the compressed gas cylinder 21*a* is introduced into the raw material powder supply device 22*a* through the carrier gas line 21*c*. A predetermined amount of the raw material powder weighed by the weighing machine 22*b* is carried into the chamber 23*a* via the raw material powder supply line 22*c*.

The cold spray gun 23 sprays the raw material powder P, which is carried into the chamber 23*a* by the carrier gas, together with the operation gas as the supersonic flow from the tip of a nozzle 23*d* and causes the raw material powder P in the solid phase state or solid-liquid coexisting state to collide with a base material 24 to form a coat 24*a*. In one or more embodiments of the present invention, the cylinder head 12 is applied as the base material 24, and the raw material powder P is sprayed onto the annular edge portions of the opening portions 16*a* and 17*a* of the cylinder head 12 using the cold spray method to form the valve seat coats 16*b* and 17*b*.

The valve seats of the cylinder head 12 are required to have high heat resistance and wear resistance to withstand the impact input from the valves in the combustion chambers 15 and high heat conductivity for cooling the combustion chambers 15. In response to these requirements, according to the valve seat coats 16*b* and 17*b* formed of the powder of precipitation-hardened copper alloy, for example, the valve seats can be obtained which are excellent in the heat resistance and wear resistance and harder than the cylinder head 12 formed of an aluminum alloy for casting.

Moreover, the valve seat coats 16*b* and 17*b* are formed directly on the cylinder head 12, and higher heat conductivity can therefore be obtained as compared with conventional valve seats formed by press-fitting seat rings as separate components into the port opening portions. Furthermore, as compared with the case in which the seat rings as separate components are used, subsidiary effects can be obtained such as that the valve seats can be made close to a water jacket for cooling and the tumble flow can be promoted due to expansion of the throat diameter of the intake ports 16 and exhaust ports 17 and optimization of the port shape.

The raw material powder used for forming the valve seat coats 16*b* and 17*b* is preferably a powder of metal that is harder than an aluminum alloy for casting and with which the heat resistance, wear resistance, and heat conductivity required for the valve seats can be obtained. For example, it is preferred to use the above-described precipitation-hardened copper alloy. The precipitation-hardened copper alloy for use may be a Corson alloy that contains nickel and silicon, chromium copper that contains chromium, zirconium copper that contains zirconium, or the like. It is also possible to apply, for example, a precipitation-hardened copper alloy that contains nickel, silicon, and chromium, a precipitation-hardened copper alloy that contains nickel, silicon, and zirconium, a precipitation-hardened copper alloy that contains nickel, silicon, chromium, and zirconium, a precipitation-hardened copper alloy that contains chromium and zirconium, or the like.

The valve seat coats 16*b* and 17*b* may also be formed by mixing a plurality of types of raw material powders; for example, a first raw material powder and a second raw material powder. In this case, it is preferred to use, as the first raw material powder, a powder of metal that is harder than an aluminum alloy for casting and with which the heat resistance, wear resistance, and heat conductivity required for valve seats can be obtained. For example, it is preferred to use the above-described precipitation-hardened copper alloy. On the other hand, it is preferred to use, as the second raw material powder, a powder of metal that is harder than the first raw material powder. The second raw material powder for application may be an alloy such as an iron-based alloy, a cobalt-based alloy, a chromium-based alloy, a nickel-based alloy, or a molybdenum-based alloy, ceramics, or the like. One type of these metals may be used alone, or two or more types may also be used in combination.

With the valve seat coats formed of a mixture of the first raw material powder and the second raw material powder which is harder than the first raw material powder, more excellent heat resistance and wear resistance can be obtained than those of valve seat coats formed only of a precipitation-hardened copper alloy. The reason that such an effect is obtained appears to be because the second raw material powder allows the oxide film existing on the surface of the cylinder head 12 to be removed so that a new interface is exposed and formed to improve the interfacial adhesion between the cylinder head 12 and the metal coats. Additionally or alternatively, it appears that the anchor effect due to the second raw material powder sinking into the cylinder head 12 improves the interfacial adhesion between the cylinder head 12 and the raw material coats. Additionally or alternatively, it appears that when the first raw material powder collides with the second raw material powder, a part of the kinetic energy is converted into heat energy, or heat is generated in the process in which a part of the first raw material powder is plastically deformed, and such heat promotes the precipitation hardening in a part of the precipitation-hardened copper alloy used as the first raw material powder.

Figure 4:
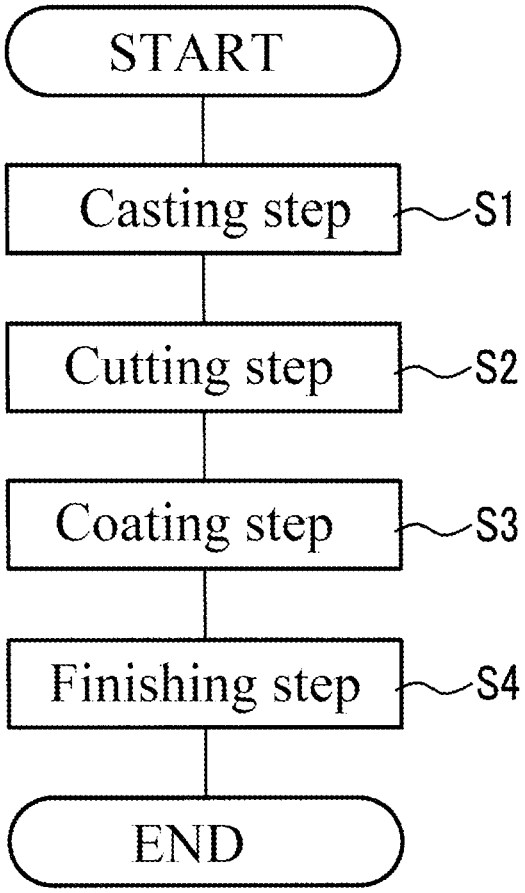
FIG. 4 is a process chart for forming the valve seat coats in the cylinder head using the coating method according to one or more embodiments of the present invention.

A method of manufacturing the cylinder head 12 according to one or more embodiments of the present invention will then be described. FIG. 4 is a process chart illustrating the procedure of forming the valve seat coats 16*b* and 17*b* for the intake ports 16 and the exhaust ports 17 in the steps of manufacturing the cylinder head 12. As illustrated in this process chart, the valve seat coats 16*b* and 17*b* of the cylinder head 12 according to one or more embodiments of the present invention are formed through a casting step (step S1), a cutting step (step S2), a coating step (step S3), and a finishing step (step S4). Detailed description of the steps other than the steps for forming the valve seat coats 16*b* and 17*b* will be omitted for simplicity of the description.

In the casting step S1, an aluminum alloy for casting is poured into a mold in which sand cores are set, and casting is performed to mold a semimanufactured cylinder head 3 (see FIG. 5) having intake ports 16 and exhaust ports 17 formed in the main body portion. The intake ports 16 and the exhaust ports 17 are formed by the sand cores, and the combustion chamber upper wall portions 12*b* are formed by the mold.

Figure 5:
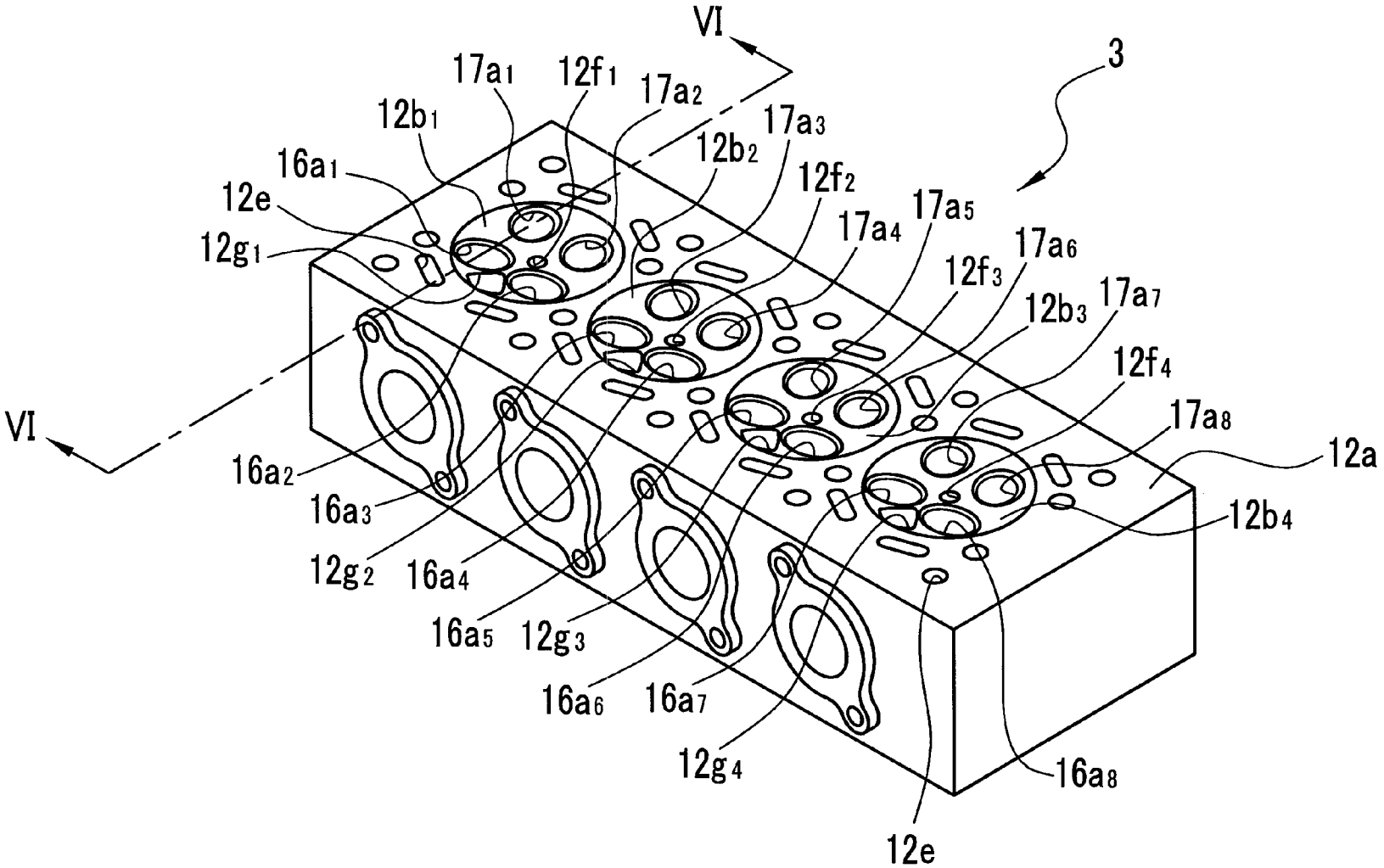
FIG. 5 is a perspective view illustrating the configuration of a semimanufactured cylinder head in which the valve seat coats are formed using the coating method according to one or more embodiments of the present invention.

FIG. 5 is a perspective view of the semimanufactured cylinder head 3 having been cast-molded in the casting step S1 as seen from above the cylinder block mounting surface 12*a*. The semimanufactured cylinder head 3 is that of a four-cylinder gasoline engine, and the cylinder block mounting surface 12*a* is provided with four combustion chamber upper wall portions $\mathbf{12}b_1$ to $\mathbf{12}b_4$ so that they are arranged along the longitudinal direction of the cylinder block mounting surface 12*a*. The cylinder block mounting surface 12*a* is provided also with a plurality of opening portions 12*e* of water jackets around the combustion chamber upper wall portions $\mathbf{12}b_1$ to $\mathbf{12}b_4$. Cooling water flows through the water jackets. The opening portions 12*e* of the water jackets communicate with corresponding opening portions of water jackets of the cylinder block 11 when the cylinder head 12 is mounted on the cylinder block 11.

The combustion chamber upper wall portions $\mathbf{12}b_1$ to $\mathbf{12}b_4$ have an approximately circular shape and are recessed with respect to the cylinder block mounting surface 12*a*. The combustion chamber upper wall portion $\mathbf{12}b_1$ is provided with two opening portions $\mathbf{16}a_1$ and $\mathbf{16}a_2$ of the intake port 16, two opening portions $\mathbf{17}a_1$ and $\mathbf{17}a_2$ of the exhaust port 17, a plug hole $\mathbf{12}f_1$, and an injector hole $\mathbf{12}g_1$. Likewise, the combustion chamber upper wall portion $\mathbf{12}b_2$ is provided with two opening portions $\mathbf{16}a_3$ and $\mathbf{16}a_4$ of the intake port 16, two opening portions $\mathbf{17}a_3$ and $\mathbf{17}a_4$ of the exhaust port 17, a plug hole $\mathbf{12}f_2$, and an injector hole $\mathbf{12}g_2$. The combustion chamber upper wall portion $\mathbf{12}b_3$ is provided with two opening portions $\mathbf{16}a_5$ and $\mathbf{16}a_6$ of the intake port 16, two opening portions $\mathbf{17}a_5$ and $\mathbf{17}a_6$ of the exhaust port 17, a plug hole $\mathbf{12}f_3$, and an injector hole $\mathbf{12}g_3$. The combustion chamber upper wall portion $\mathbf{12}b_4$ is provided with two opening portions $\mathbf{16}a_7$ and $\mathbf{16}a_8$ of the intake port 16, two opening portions $\mathbf{17}a_7$ and $\mathbf{17}a_8$ of the exhaust port 17, a plug hole $\mathbf{12}f_4$, and an injector hole $\mathbf{12}g_4$.

The plug holes $\mathbf{12}f_1$ to $\mathbf{12}f_4$ are holes for attaching spark plugs and are disposed approximately in the centers of the combustion chamber upper wall portions $\mathbf{12}b_1$ to $\mathbf{12}b_4$. The four plug holes $\mathbf{12}f_1$ to $\mathbf{12}f_4$ provided in the semimanufactured cylinder head 3 are therefore arranged along the longitudinal direction of the semimanufactured cylinder head 3.

The two opening portions 16$a_1$ and 16$a_2$ of the intake port 16 are arranged along the longitudinal direction of the semimanufactured cylinder head 3 at positions in contact with the edge portion of the combustion chamber upper wall portion 12$b_1$. Likewise, the opening portions 16$a_3$ to 16$a_8$ are also arranged along the longitudinal direction of the semimanufactured cylinder head 3 at positions in contact with the edge portions of the combustion chamber upper wall portions 12$b_2$ to 12$b_4$. Thus, the eight intake opening portions 16$a_1$ to 16$a_8$ provided in the semimanufactured cylinder head 3 are arranged along the longitudinal direction of the semimanufactured cylinder head 3. The two intake ports 16 provided at each of the combustion chamber upper wall portions 12$b_1$ to 12$b_4$ are merged into one in the semimanufactured cylinder head 3, which communicates with a side surface of the semimanufactured cylinder head 3.

The two opening portions 17$a_1$ and 17$a_2$ of the exhaust port 17 are arranged along the longitudinal direction of the semimanufactured cylinder head 3 at positions in contact with the edge portion of the combustion chamber upper wall portion 12$b_1$ opposite to the opening portions 16$a_1$ and 16$a_2$ with respect to the plug hole 12$f_1$. Likewise, the opening portions 17$a_3$ to 17$a_8$ are also arranged along the longitudinal direction of the semimanufactured cylinder head 3 at positions in contact with the edge portions of the combustion chamber upper wall portions 12$b_2$ to 12$b_4$. Thus, the eight exhaust opening portions 17$a_1$ to 17$a_8$ provided in the semimanufactured cylinder head 3 are arranged along the longitudinal direction of the semimanufactured cylinder head 3. The two exhaust ports 17 provided at each of the combustion chamber upper wall portions 12$b_1$ to 12$b_4$ are merged into one in the semimanufactured cylinder head 3, which communicates with a side surface of the semimanufactured cylinder head 3.

The injector holes 12$g_1$ to 12$g_4$ are holes for attaching injector devices for fuel injection. The injector hole 12$g_1$ is disposed between the two opening portions 16$a_1$ and 16$a_2$ and in contact with the edge portion of the combustion chamber upper wall portion 12$b_1$. Like the injector hole 12$g_1$, the injector holes 12$g_2$ to 12$g_4$ are also arranged at the combustion chamber upper wall portions 12$b_2$ to 12$b_4$. Thus, the four injector holes 12$g_1$ to 12$g_4$ provided in the semimanufactured cylinder head 3 are arranged along the longitudinal direction of the semimanufactured cylinder head 3.

Figure 6A:
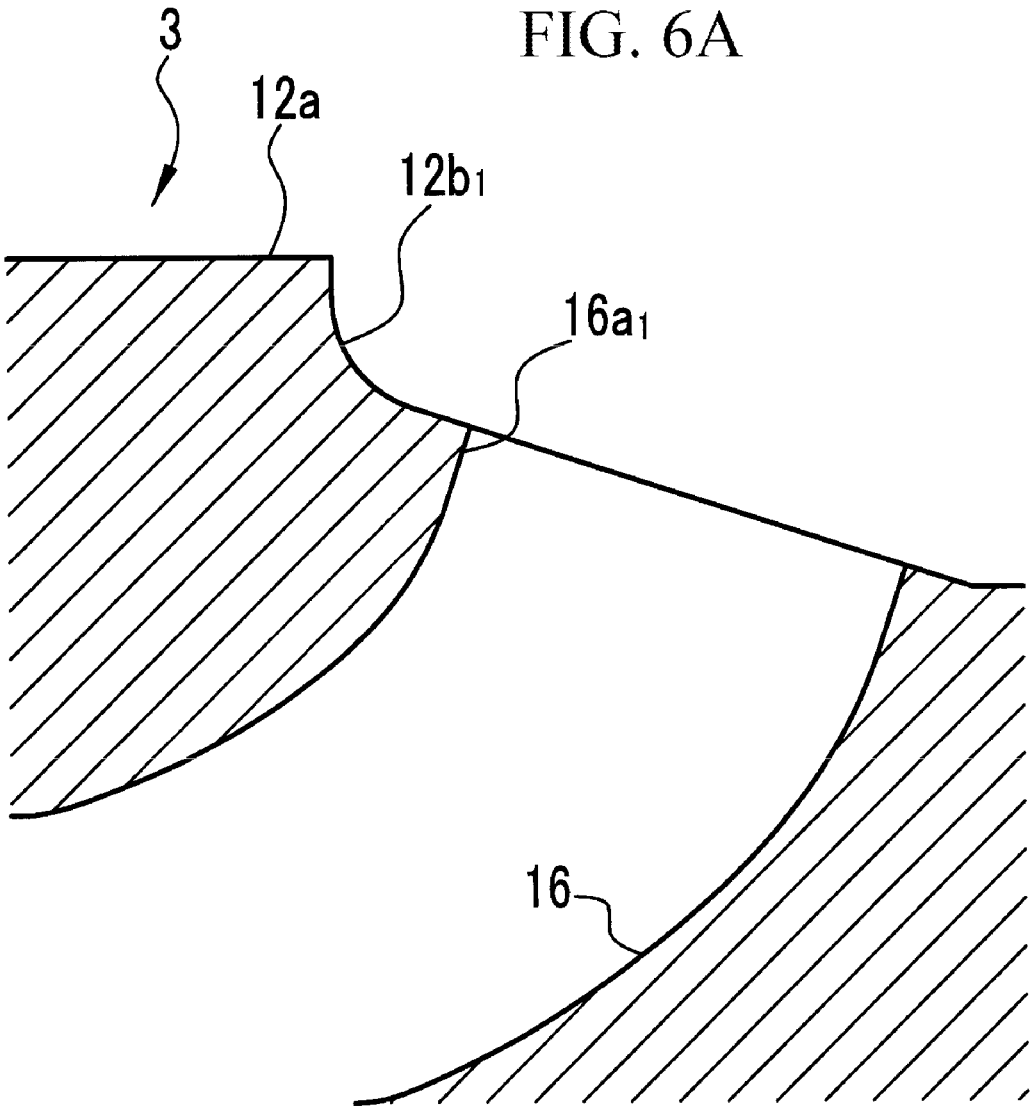
FIG. 6A is a cross-sectional view illustrating an intake port along line VI-VI of FIG. 5.
Figure 6B:
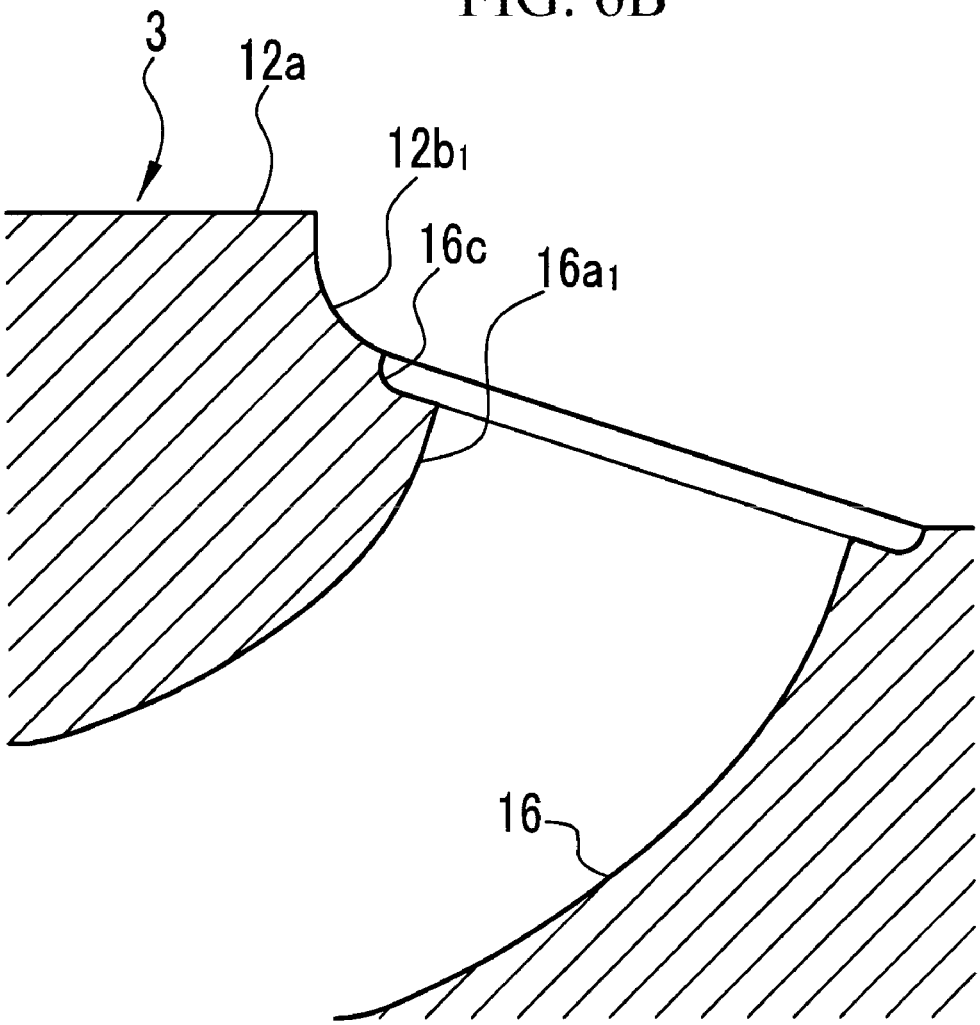
FIG. 6B is a cross-sectional view illustrating a state in which an annular valve seat portion is formed in the intake port of FIG. 6A in a cutting step.

The cutting step S2 will then be described. FIG. 6A is a cross-sectional view of the semimanufactured cylinder head 3 taken along line VI-VI of FIG. 5 and illustrates the cross-sectional shape of the intake port 16 at the combustion chamber upper wall portion 12$b_1$. The intake port 16 is provided with a circular opening portion 16$a_1$ that is exposed in the combustion chamber upper wall portion 12$b_1$ of the semimanufactured cylinder head 3. In the cutting step S2, milling work is performed on the semimanufactured cylinder head 3 as illustrated in FIG. 6B, such as using an end mill or a ball end mill, to form an annular valve seat portion 16*c* on the annular edge portion of the opening portion 16$a_1$ of the intake port 16. The annular valve seat portion 16*c* is an annular groove that serves as the base shape of a valve seat coat 16*b*, and is formed on the outer circumference of the opening portion 16$a_1$.

The cylinder head 12 according to one or more embodiments of the present invention is processed through spraying the raw material powder P onto the annular valve seat portion 16*c* using the cold spray method to form a coat and forming the valve seat coat 16*b* (see FIG. 6D) based on that coat. The annular valve seat portion 16*c* is therefore formed with a size slightly larger than that of the valve seat coat 16*b*.

In the coating step S3, the raw material powder P is sprayed onto the opening portions 16$a_1$ to 16$a_8$ of the semimanufactured cylinder head 3 using the cold spray apparatus 2 according to one or more embodiments of the present invention to form the valve seat coats 16*b*. The semimanufactured cylinder head 3 corresponds to the coating target component of the present invention, and the opening portions 16$a_1$ to 16$a_8$ and the opening portions 17$a_1$ to 17$a_8$ correspond to the coating portions of the present invention. In the coating step S3, the semimanufactured cylinder head 3 and the nozzle 23*d* of the cold spray gun 23 are relatively moved at a constant speed so that the raw material powder P is sprayed onto the entire circumference of the annular valve seat portion 16*c* while keeping constant the posture of the annular valve seat portion 16*c* and nozzle 23*d* and the distance between the annular valve seat portion 16*c* and the nozzle 23*d*.

Figure 7:
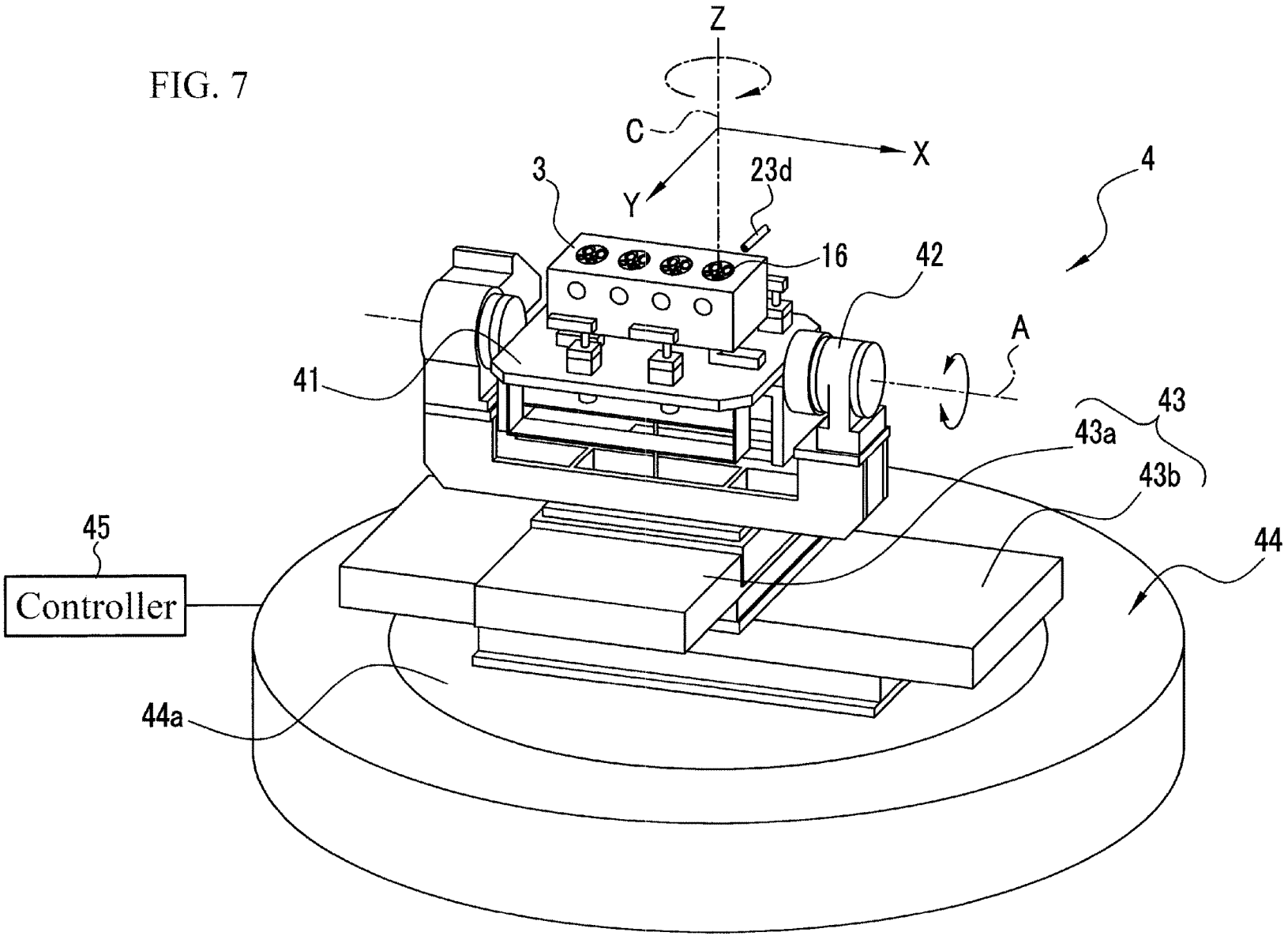
FIG. 7 is a perspective view illustrating the configuration of a work rotating apparatus used for moving the semimanufactured cylinder head in the coating method according to one or more embodiments of the present invention.

In one or more embodiments of the present invention, for example, the semimanufactured cylinder head 3 is moved with respect to the nozzle 23*d* of the cold spray gun 23, which is fixedly arranged, using a work rotating apparatus 4 illustrated in FIG. 7. The work rotating apparatus 4 includes a work table 41, a tilt stage unit 42, an XY stage unit 43, a rotation stage unit 44, and a controller 45. The work table 41 holds the semimanufactured cylinder head 3.

The tilt stage unit 42 is a stage that supports the work table 41 and rotates the work table 41 around an A-axis arranged in the horizontal direction to tilt the semimanufactured cylinder head 3. The XY stage unit 43 includes a Y-axis stage 43*a* that supports the tilt stage unit 42 and an X-axis stage 43*b* that supports the Y-axis stage 43*a*. The Y-axis stage 43*a* moves the tilt stage unit 42 along the Y-axis arranged in the horizontal direction. The X-axis stage 43*b* moves the Y-axis stage 43*a* along the X-axis orthogonal to the Y-axis on the horizontal plane. This allows the XY stage unit 43 to move the semimanufactured cylinder head 3 to an arbitrary position along the X-axis and the Y-axis. The rotation stage unit 44 has a rotation table 44*a* that supports the XY stage unit 43 on the upper surface, and rotates the rotation table 44*a* thereby to rotate the semimanufactured cylinder head 3 around the Z-axis in an approximately vertical direction.

The controller 45 is a control device that controls the movements of the tilt stage unit 42, XY stage unit 43, and rotation stage unit 44. The controller 45 is installed with a teaching program that causes the semimanufactured cylinder head 3 to move with respect to the nozzle 23*d* of the cold spray apparatus 2.

Figure 6C:
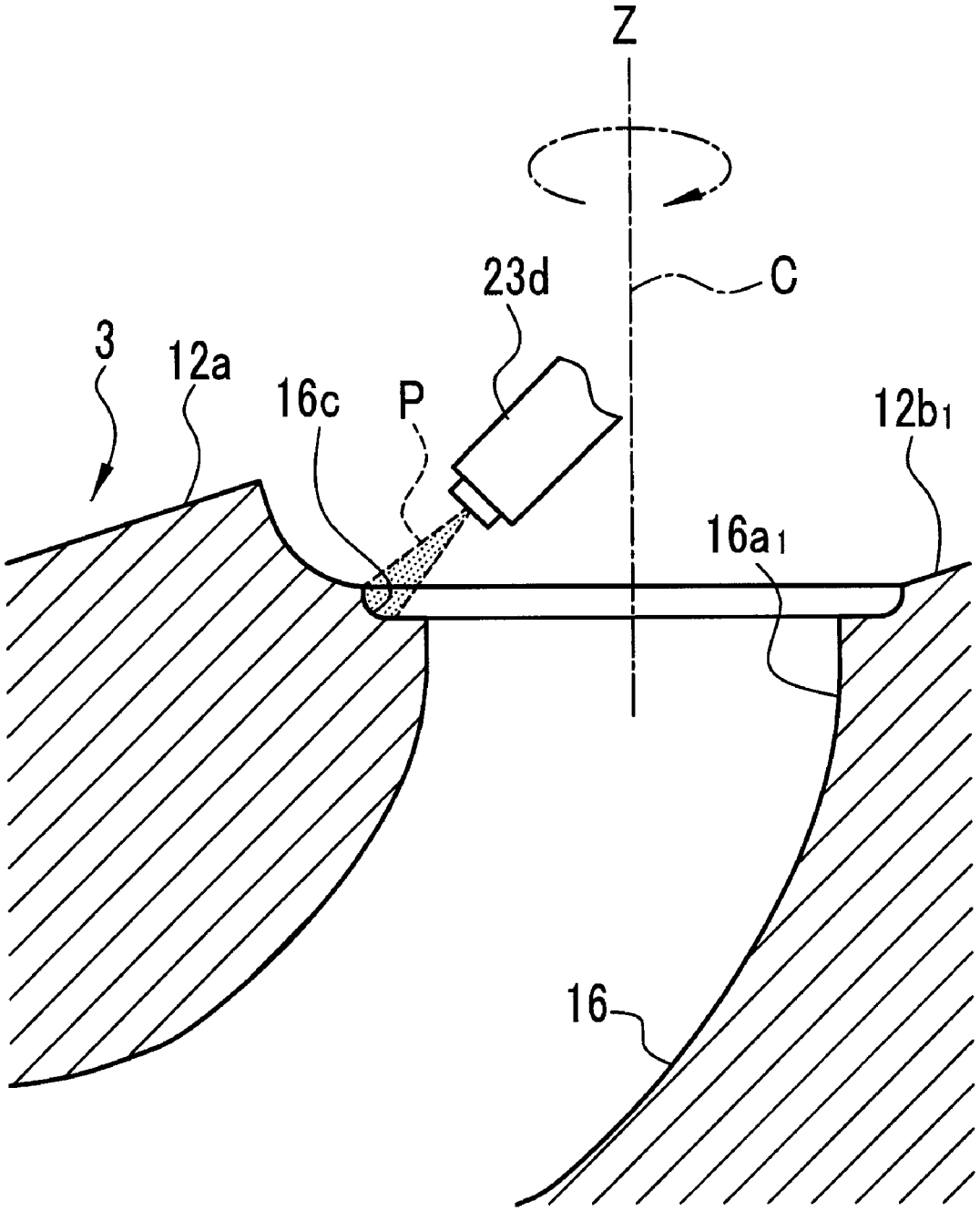
FIG. 6C is a cross-sectional view illustrating a state of forming a valve seat coat at the annular valve seat portion of FIG. 6B.

The tip of the nozzle 23*d* of the cold spray gun 23 is fixedly arranged above the tilt stage unit 42 and in the vicinity of the Z-axis of the rotation stage unit 44. The controller 45 uses the tilt stage unit 42 to tilt the work table 41 so that, as illustrated in FIG. 6C, the central axis C of the intake port 16 to be formed with the valve seat coat 16*b* becomes vertical. The controller 45 also uses the XY stage unit 43 to move the semimanufactured cylinder head 3 so that the central axis C of the intake port 16 to be formed with the valve seat coat 16*b* coincides with the Z-axis of the rotation stage unit 44. In this state, the nozzle 23*d* sprays the raw material powder P onto the annular valve seat portion 16*c* and the rotation stage unit 44 rotates the semimanufactured cylinder head 3 around the Z-axis, thereby forming the valve seat coat 16*b* on the entire circumference of the annular valve seat portion 16*c*.

The controller 45 temporarily stops the rotation of the rotation stage unit 44 when the semimanufactured cylinder head 3 makes one rotation around the Z-axis to complete the formation of the valve seat coat 16*b* for the opening portion 16$a_1$. While the rotation is stopped, the XY stage unit 43 moves the semimanufactured cylinder head 3 so that the central axis C of the opening portion 16$a_2$ to be subsequently formed with the valve seat coat 16*b* coincides with the Z-axis of the rotation stage unit 44. After the XY stage unit 43 completes the movement of the semimanufactured cylinder head 3, the controller 45 restarts the rotation of the rotation stage unit 44 to form the valve seat coat 16*b* on the annular valve seat portion 16*c* of the next opening portion 16$a_2$. This operation is then repeated thereby to form the valve seat coats 16*b* and 17*b* for all the opening portions 16$a_1$ to 16$a_8$ and the opening portions 17$a_1$ to 17$a_8$ of the semimanufactured cylinder head 3. When the valve seat coating target is switched between an intake port 16 and an exhaust port 17, the tilt stage unit 42 changes the tilt of the semimanufactured cylinder head 3 so that the central axis of the exhaust port 17 becomes vertical.

In the finishing step S4, finishing work is performed on the valve seat coats 16*b* and 17*b*, the intake ports 16, and the exhaust ports 17. In the finishing work performed on the valve seat coats 16*b* and 17*b*, the surfaces of the valve seat coats 16*b* and 17*b* are cut by milling work using a ball end mill to adjust the valve seat coats 16*b* into a predetermined shape.

Figure 6D:
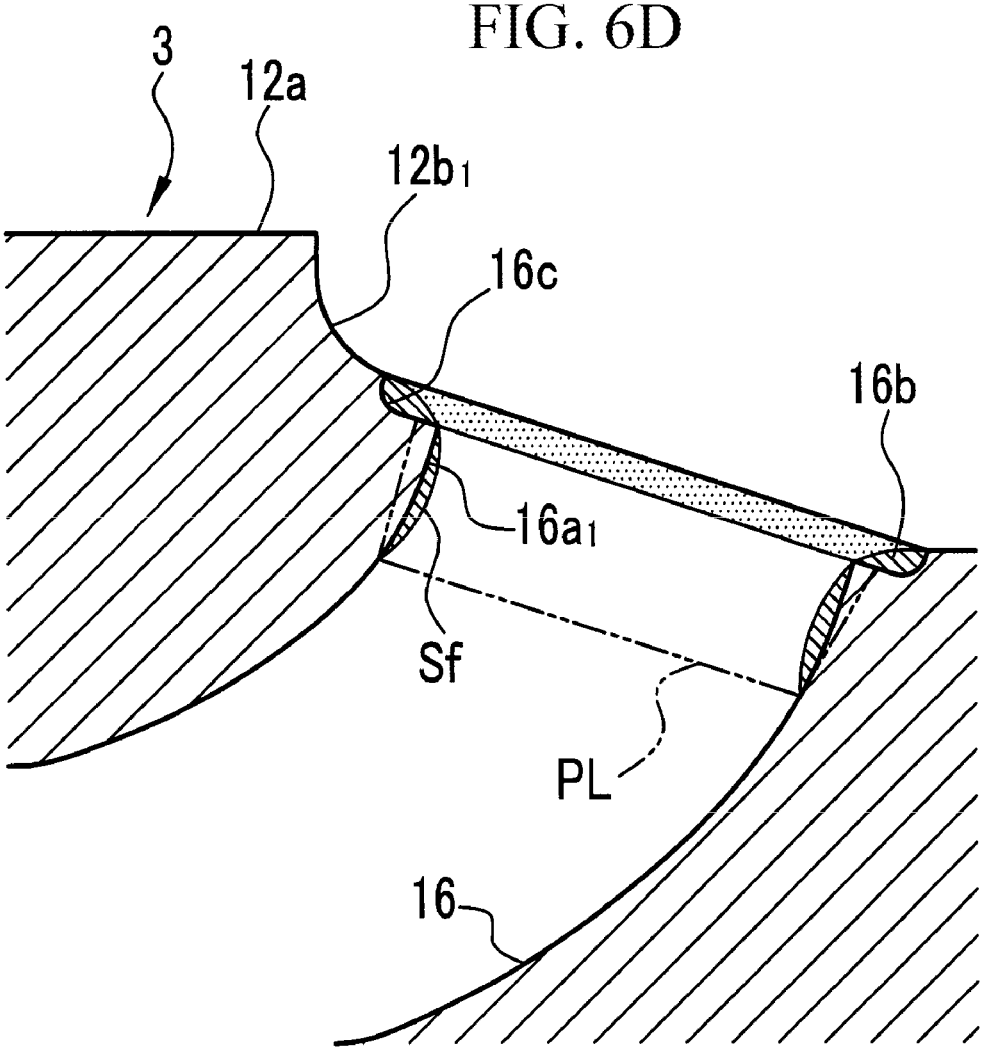
FIG. 6D is a cross-sectional view illustrating the intake port in which the valve seat coat is formed at the annular valve seat portion of FIG. 6B.

In the finishing work performed on an intake port 16, a ball end mill is inserted from the opening portion 16$a_1$ into the intake port 16 to cut the inner surface of the intake port 16 on the opening port 16$a_1$ side along a working line PL illustrated in FIG. 6D. The working line PL defines a range in which the raw material powder P scatters and adheres in the intake port 16 to form a relatively thick excessive coat Sf. More specifically, the working line PL refers to a range in which the excessive coat Sf is formed thick to such an extent that affects the intake performance of the intake port 16.

Figure 6E:
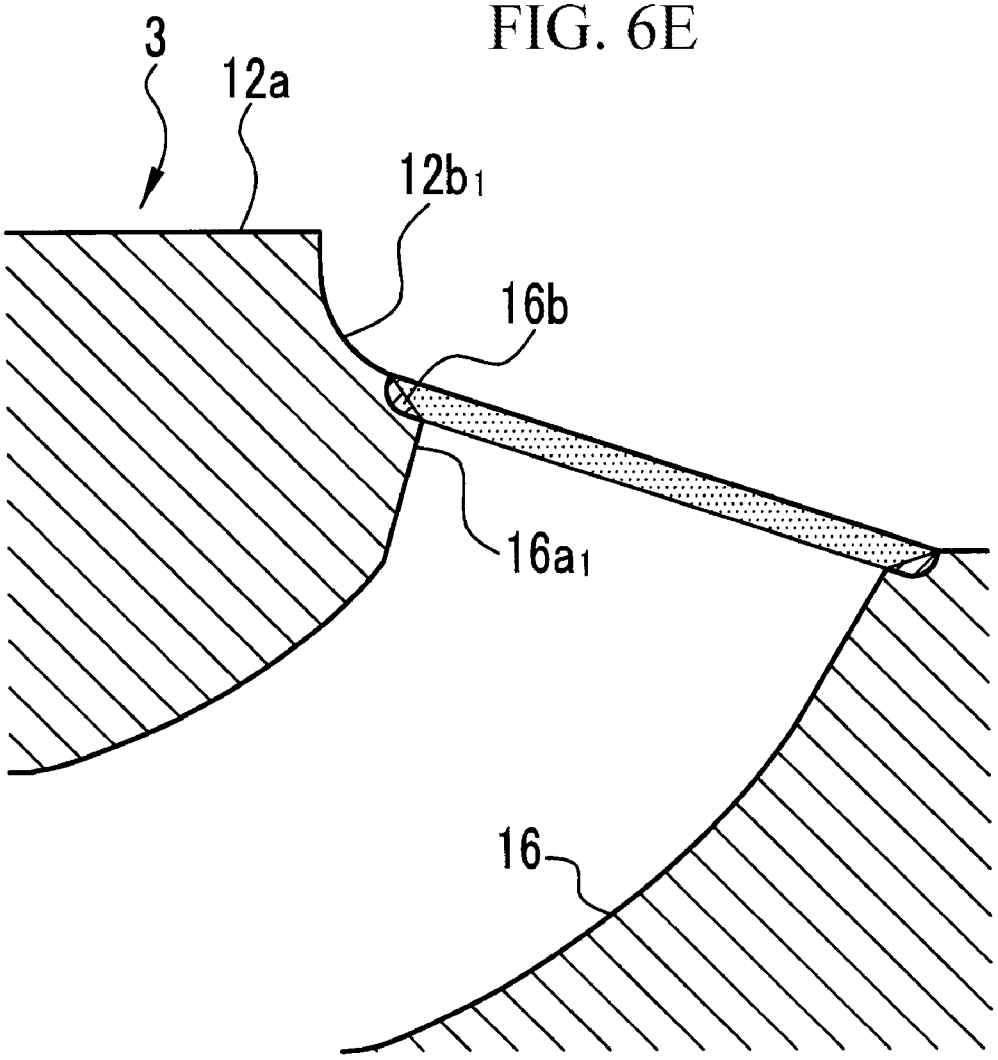
FIG. 6E is a cross-sectional view illustrating the intake port after a finishing step illustrated in FIG. 4.

Thus, according to the finishing step S4, the surface roughness of the intake port 16 due to the cast molding is eliminated, and the excessive coat SF formed in the coating step S3 can be removed. FIG. 6E illustrates the intake port 16 after the finishing step S4.

Like the intake ports 16, each exhaust port 17 is processed through the formation of the exhaust port 17 by the cast molding, the formation of an annular valve seat portion 17*c* (see FIG. 2) by the cutting work, the formation of a valve seat coat 17*b* by the cold spray method, and the finishing work performed on the valve seat coat 17*b*. Detailed description will therefore be omitted for the procedure of forming the valve seat coats 17*b* on the exhaust ports 17.

First Embodiment

The coating step S3 described above has two problems: (1) the cycle time of the coating step is long; and (2) excessive coats are formed. The problem (1) is due to the characteristics of the cold spray apparatus 2. That is, once the spraying of the raw material powder P is stopped, the cold spray apparatus 2 requires a waiting time of several minutes until the raw material powder P can be stably sprayed again. Thus, in the case of forming the valve seat coats 16*b* and 17*b* at the plurality of opening portions 16$a_1$ to 16$a_8$ and opening portions 17$a_1$ to 17$a_8$, if the spraying of the raw material powder P and its stopping are repeated for each opening portion, the cycle time of the coating step S3 will increase.

The problem (2) is a problem caused by applying the present invention to solve the problem (1). That is, in one or more embodiments of the present invention, to solve the problem (1) regarding the cycle time of the coating step S3, the nozzle 23*d* is moved between any two of the opening portions 16$a_1$ to 16$a_8$ and between any two of the opening portions 17$a_1$ to 17$a_8$ while continuing to inject the raw material powder P. Through this operation, the nozzle 23*d* does not stop injecting the raw material powder P; therefore, the waiting time is unnecessary and the cycle time of the coating step S3 is shortened, but the problem (2) occurs that the raw material powder P adheres to portions other than the opening portions 16$a_1$ to 16*a*8 and opening portions 17$a_1$ to 17$a_8$ of the semimanufactured cylinder head 3 to form excessive coats. In particular, if the excessive coats are formed beyond the working lines PL for the intake ports 16 and exhaust ports 17, the excessive coats cannot be removed by post-processing, which may affect the engine performance.

Figure 8A:
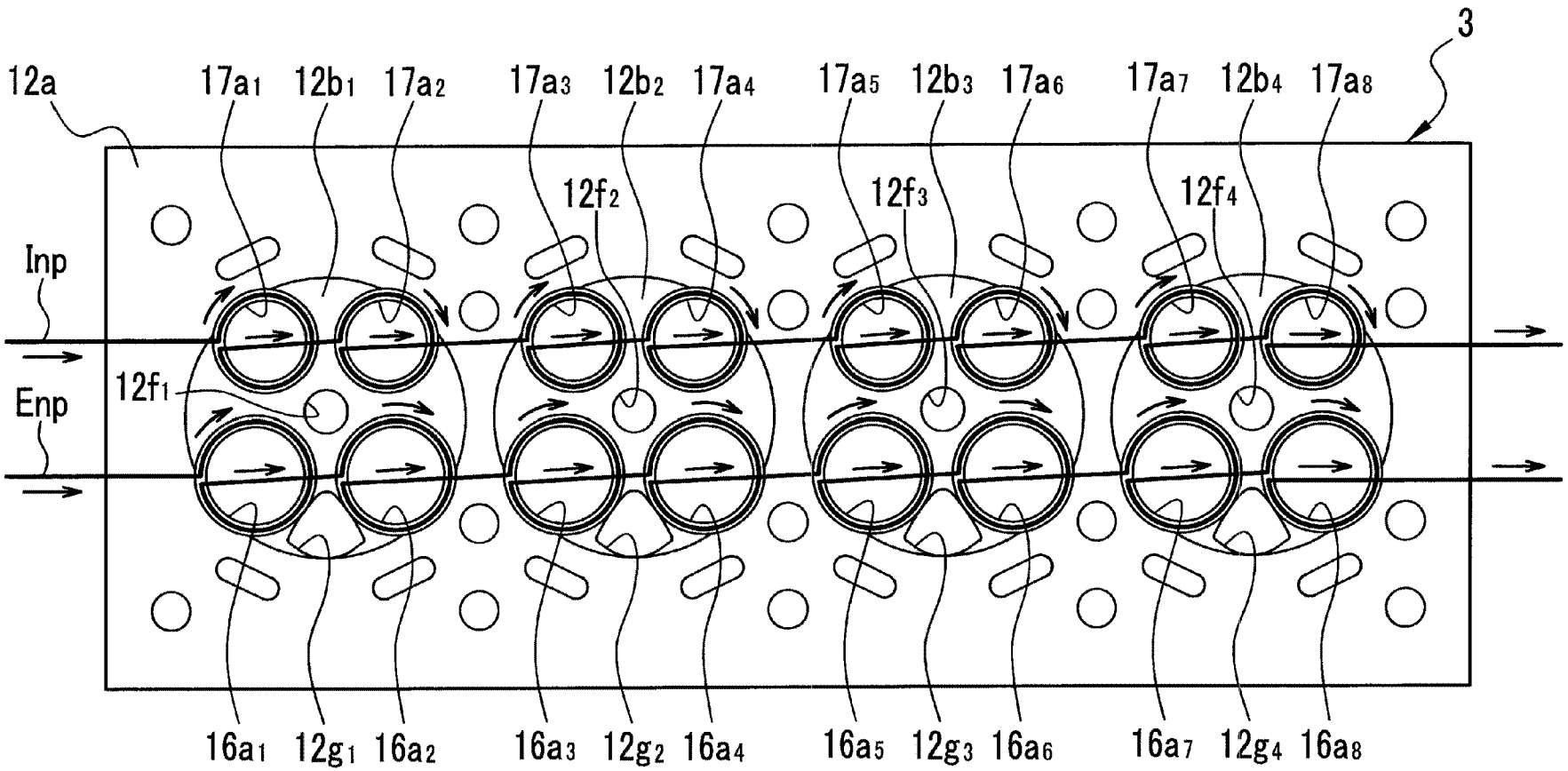
FIG. 8A is a plan view of the semimanufactured cylinder head illustrating nozzle movement paths when the nozzle of the cold spray apparatus moves above the valve opening portions.

FIG. 8A illustrates a nozzle movement path for air intake Inp and a nozzle movement path for air exhaust Enp with which the above-described problem (2) occurs. The nozzle movement path for air intake Inp is a movement path for the nozzle 23*d* which is moved with respect to the semimanufactured cylinder head 3 when the valve seat coats 16*b* are formed at the opening portions 16$a_1$ to 16$a_8$ of the intake ports 16 by the nozzle 23*d*. On the other hand, the nozzle movement path for air exhaust Enp is a movement path for the nozzle 23*d* which is moved with respect to the semimanufactured cylinder head 3 when the valve seat coats 17*b* are formed at the opening portions 17$a_1$ to 17$a_8$ of the exhaust ports 17 by the nozzle 23*d*. The nozzle movement path for air intake Inp and the nozzle movement path for air exhaust Enp are set along the longitudinal direction of the semimanufactured cylinder head 3.

The nozzle 23*d* sequentially forms the valve seat coats 16*b* for the opening portions 16$a_1$ to 16$a_8$ of the intake ports 16 while moving along the nozzle movement path for air intake Inp. When moving from an opening portion (e.g., the opening portion 16$a_1$) having been formed with the valve seat coat 16*b* to another opening portion (e.g., the opening portion 16*a*2) to be subsequently formed with the valve seat coat 16*b*, the nozzle 23*d* moves above the opening portion (e.g., the opening portion 16$a_1$) having been formed with the valve seat coat 16*b*. Likewise, the nozzle 23*d* sequentially forms the valve seat coats 17*b* for the opening portions 17$a_1$ to 17$a_8$ of the exhaust ports 17 while moving along the nozzle movement path for air exhaust Enp. When moving from an opening portion (e.g., the opening portion 17$a_1$) having been formed with the valve seat coat 17*b* to another opening portion (e.g., the opening portion 17*a*2) to be subsequently formed with the valve seat coat 17*b*, the nozzle 23*d* moves above the opening portion (e.g., the opening portion 17$a_1$) having been formed with the valve seat coat 17*b*.

Figure 8B:
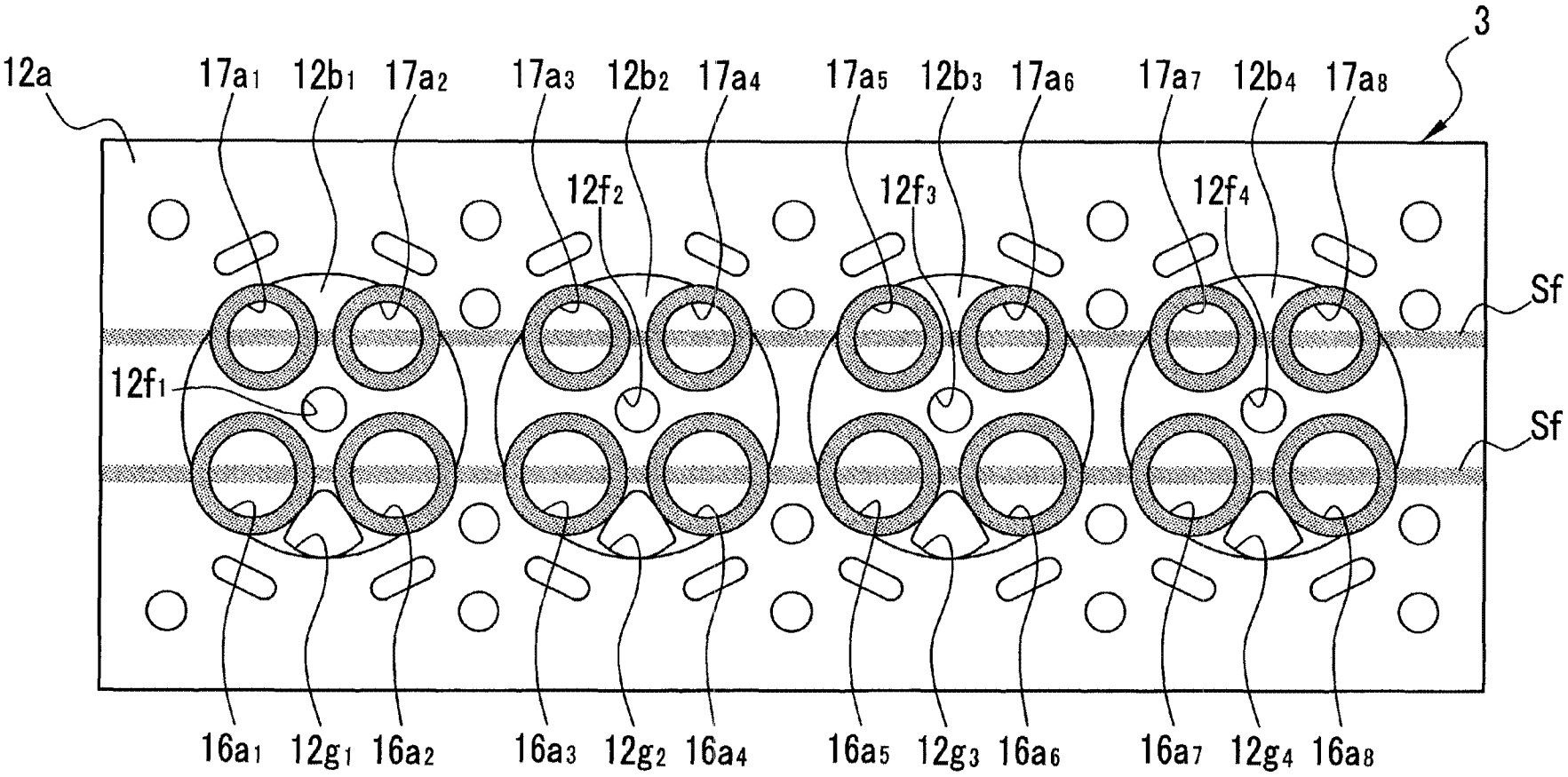
FIG. 8B is a plan view of the semimanufactured cylinder head illustrating excessive coats formed by the nozzle of the cold spray apparatus moving along the nozzle movement paths illustrated in FIG. 8A.

FIG. 8B illustrates the cylinder block mounting surface 12*a* of the semimanufactured cylinder head 3 on which the valve seat coats 16*b* and 17*b* are formed by the nozzle 23*d* moved along the nozzle movement path for air intake Inp and the nozzle movement path for air exhaust Enp. As illustrated in FIG. 8B, excessive coats Sf which cannot be removed are formed beyond the working lines PL for the intake ports 16 and exhaust ports 17 because the nozzle 23*d* moves above the opening portions 16$a_1$ to 16$a_8$ and the opening portions 17$a_1$ to 17$a_8$.

Figure 9A:
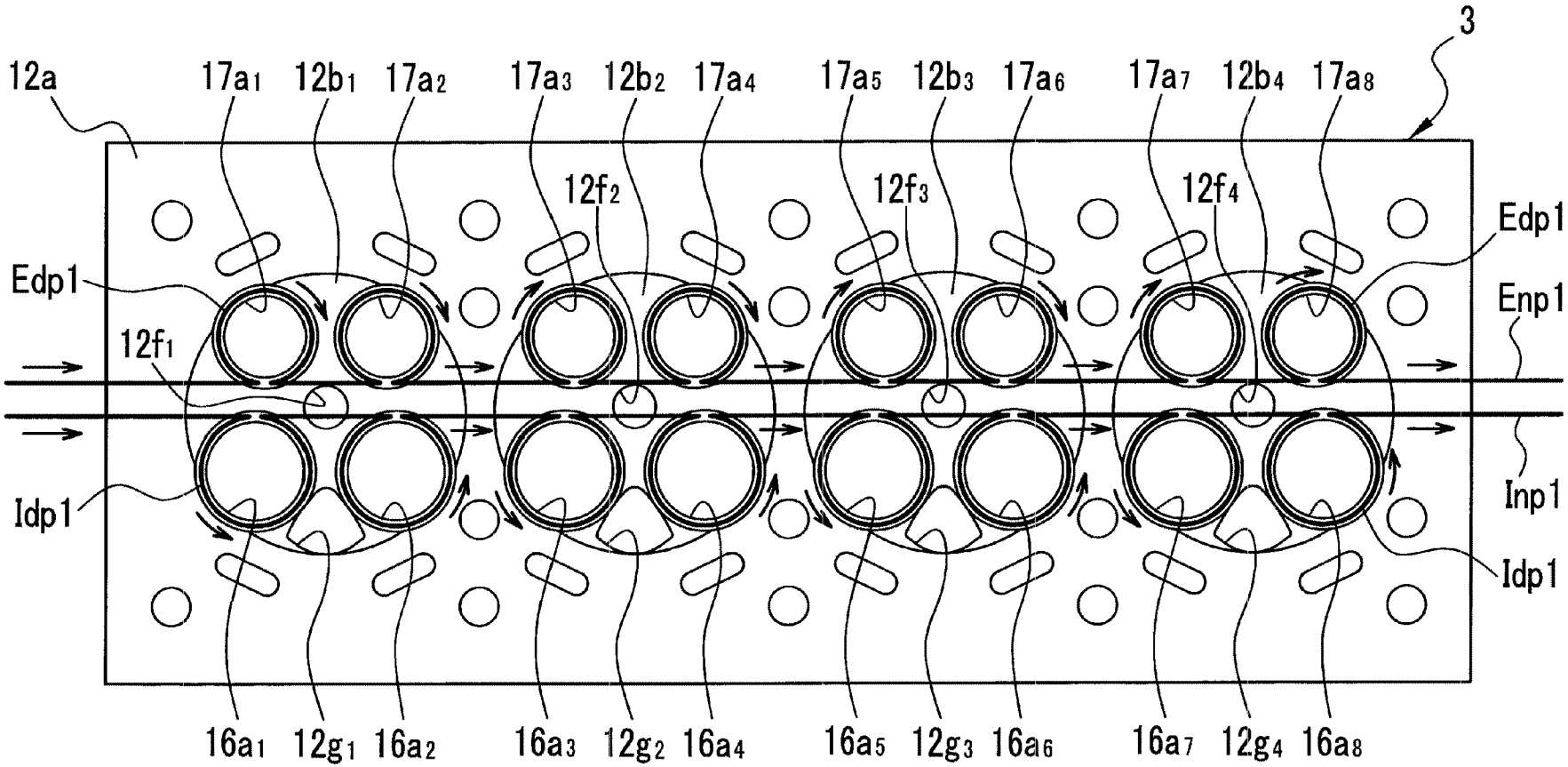
FIG. 9A is a plan view of the semimanufactured cylinder head illustrating nozzle movement paths that are set between the intake ports and the exhaust ports according to the coating method of a first embodiment of the present invention.

The coating step S3 according to the present embodiment is an embodiment for carrying out the coating method according to the present invention. To solve the above-described problems (1) and (2), as illustrated in FIG. 9A, this embodiment includes setting a nozzle movement path for air intake Inp1 and a nozzle movement path for air exhaust Enp 1 that are different from the nozzle movement path for air intake Inp and the nozzle movement path for air exhaust Enp of FIG. 8A. Here, the nozzle movement paths are movement paths for the nozzle 23*d* from opening portions having been formed with the valve seat coats to other opening portions to be subsequently formed with the valve seat coats. Each nozzle movement path includes a path for the nozzle 23*d* to move from the outside of the semimanufactured cylinder head 3 to an opening portion (e.g., the opening portion 16$a_1$) to be first formed with the valve seat coat and a path for the nozzle 23*d* to move from an opening portion (e.g., the opening portion 16$a_8$) having been finally formed with the valve seat coat to the outside of the semimanufactured cylinder head 3. In the following description, the path for the nozzle 23*d* to move so as to trace over an opening portion in order to form the valve seat coat at the opening portion will be referred to as a coating path.

Figure 10:
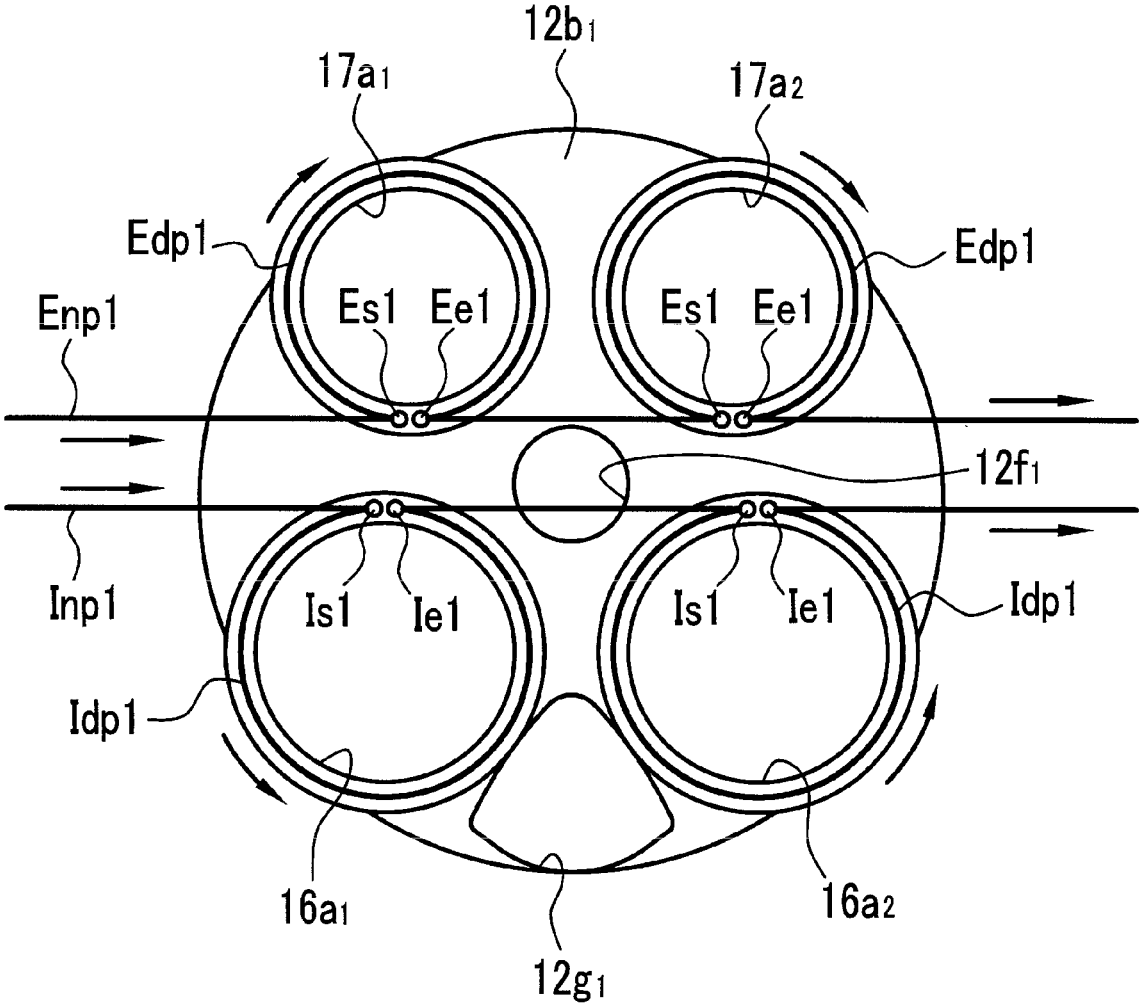
FIG. 10 is an enlarged plan view of a part of the semimanufactured cylinder head and nozzle movement paths illustrated in FIG. 9A.

FIG. 9A is a plan view illustrating the cylinder block mounting surface 12*a* of the semimanufactured cylinder head 3 and illustrates the nozzle movement path for air intake Inp1 for forming the valve seat coats 16*b* at the opening portions 16$a_1$ to 16$a_8$ of the intake ports 16 and the nozzle movement path for air exhaust Enp1 for forming the valve seat coats 17*b* at the opening portions 17$a_1$ to 17$a_8$ of the exhaust ports 17. FIG. 10 illustrates an enlarged view of the leftmost combustion chamber upper wall portion 12$b_1$ of the semimanufactured cylinder head 3 illustrated in FIG. 9A.

The nozzle movement path for air intake Inp1 is linearly set along the arrangement direction of the opening portions 16$a_1$ to 16$a_8$ so as to be in contact with the opening portions 16$a_1$ to 16$a_8$ between the opening portions 16$a_1$ to 16$a_8$ of the intake ports 16 and the opening portions 17$a_1$ to 17$a_8$ of the exhaust ports 17. The nozzle 23*d* moves on the nozzle movement path for air intake Inp1 from the left side to the right side in the figure. This nozzle movement path for air intake Inp1 allows the nozzle 23*d* to move above the cylinder block mounting surface 12*a* and above the combustion chamber upper wall portions 12$b_1$ to 12$b_4$ rather than to move above the opening portions 16$a_1$ to 16$a_8$ of the intake ports 16 or above the opening portions 17$a_1$ to 17$a_8$ of the exhaust ports 17.

For the nozzle movement path for air intake Inp1 thus set, annular coating paths for air intake Idp1 are set on the annular valve seat portions 16*c* of the respective opening portions 16$a_1$ to 16$a_8$ so as to be in contact with the nozzle movement path for air intake Inp1. In addition, positions at which the nozzle movement path for air intake Inp1 is in contact with the coating paths for air intake Idp1 are set with coating start positions Is1 at which the nozzle 23*d* starts spraying the raw material powder P onto the annular valve seat portions 16*c* of the opening portions 16$a_1$ to 16$a_8$ and coating end positions Ie1 at which the nozzle 23*d* finishes spraying the raw material powder P onto the annular valve seat portions 16*c*.

The nozzle movement path for air exhaust Enp1 is linearly set along the arrangement direction of the opening portions 17$a_1$ to 17$a_8$ so as to be in contact with the opening portions 17$a_1$ to 17$a_8$ between the opening portions 16$a_1$ to 16$a_8$ of the intake ports 16 and the opening portions 17$a_1$ to 17$a_8$ of the exhaust ports 17. The nozzle 23*d* moves on the nozzle movement path for air exhaust Enp1 from the left side to the right side in the figure. This nozzle movement path for air exhaust Enp1 allows the nozzle 23*d* to move above the cylinder block mounting surface 12*a* and above the combustion chamber upper wall portions 12$b_1$ to 12$b_4$ rather than to move above the opening portions 16$a_1$ to 16$a_8$ of the intake ports 16 or above the opening portions 17$a_1$ to 17$a_8$ of the exhaust ports 17.

For the nozzle movement path for air exhaust Enp1 thus set, annular coating paths for air exhaust Edp1 are set on the annular valve seat portions 17*c* of the respective opening portions 17$a_1$ to 17$a_8$ so as to be in contact with the nozzle movement path for air exhaust Enp 1. In addition, positions at which the nozzle movement path for air exhaust Enp1 is in contact with the coating paths for air exhaust Edp1 are set with coating start positions Es1 at which the nozzle 23*d* starts spraying the raw material powder P onto the annular valve seat portions 17*c* of the opening portions 17$a_1$ to 17$a_8$ and coating end positions Ee1 at which the nozzle 23*d* finishes spraying the raw material powder P onto the annular valve seat portions 17*c*.

Figure 11:
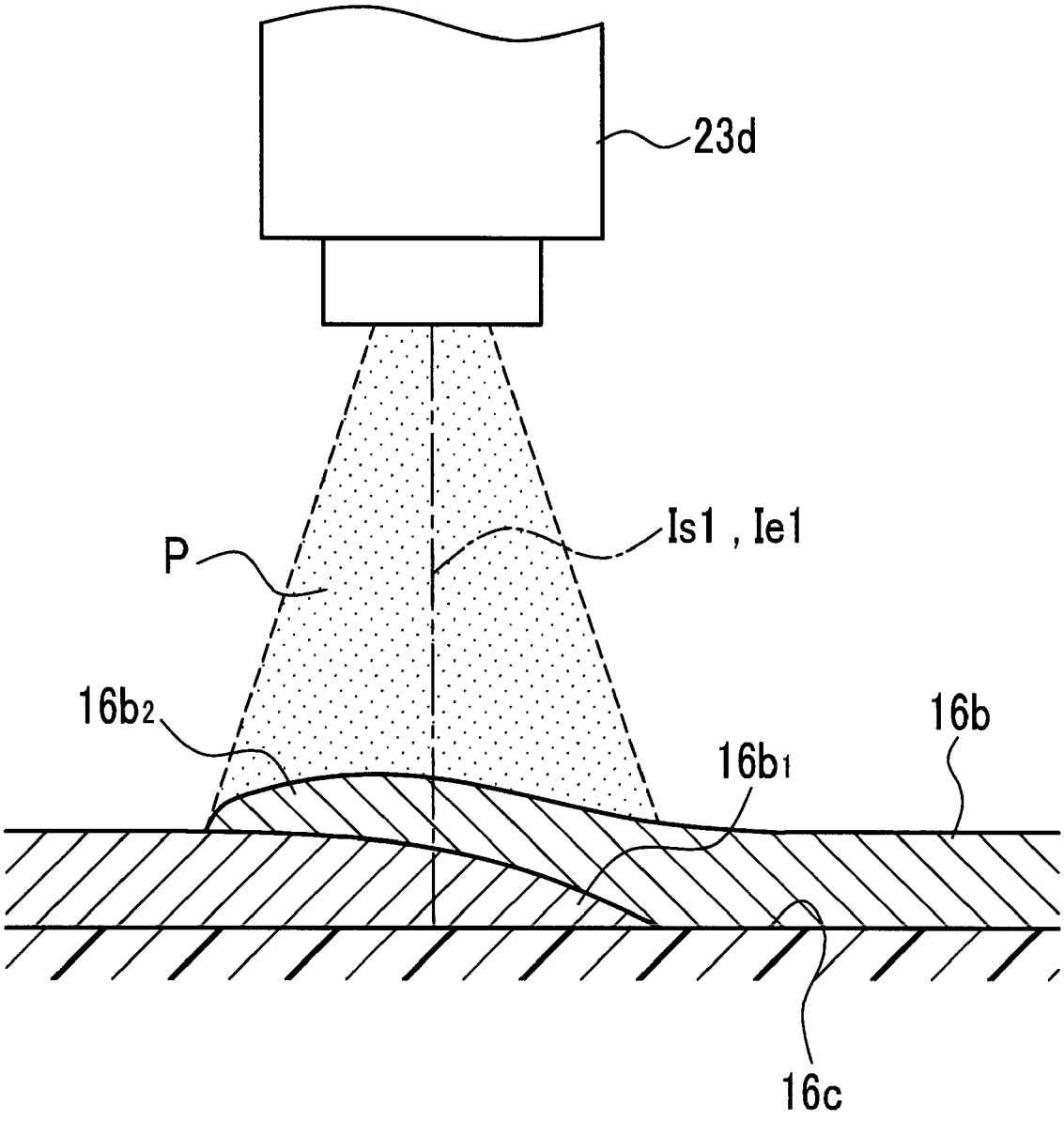
FIG. 11 is a cross-sectional view illustrating a valve seat coat formed at a position at which a coating end position overlaps a coating start position on a nozzle movement path illustrated in FIG. 9A.

In FIG. 9A, the coating start positions Is1 and coating end positions Ie1 of the coating paths for air intake Idp1 are illustrated at positions separated from each other, but in practice they are set so that the coating end positions Ie1 overlap the coating start positions Is1. FIG. 11 is a cross-sectional view illustrating a coating start position Is1 and a coating end position Ie1 immediately after the valve seat coat 16*b* is formed on the annular valve seat portion 16*c* of the opening portion 16$a_1$. As illustrated in this cross-sectional view, the coating start position Is1 and the coating end position Ie1 are set at the same position, and the valve seat coat 16*b* is formed so that one end portion 16$b_2$ of the valve seat coat 16*b* formed at the coating end position Ie1 overlaps the other end portion 16$b_1$ of the valve seat coat 16*b* formed at the coating start position Is1. The valve seat coat 16*b* is therefore formed without any gap over the entire circumference of each of the opening portions 16$a_1$ to 16$a_8$. At the position at which the coating end position Ie1 overlaps the coating start positions Is1, the coat is thicker than the other portions, but the coat is cut in the finishing step S4 so that the thickness becomes uniform. The positional relationship between a coating start position Es1 and a coating end position Ee1 in a coating path for air exhaust Edp1 is the same as the positional relationship between a coating start position Is1 and a coating end position Ie1 in a coating path for air intake Idp1, so the detailed description will be omitted.

The nozzle 23*d* moves seemingly along the nozzle movement path for air intake Inp1 and the coating paths for air intake Idp1 as follows. In the present embodiment, the nozzle 23*d* is practically fixed and the semimanufactured cylinder head 3 is moved, but for the purpose of clarifying the movement of the nozzle 23*d* along the nozzle movement path for air intake Inp1 and the coating paths for air intake Idp1, the following description will be made on the assumption that the nozzle 23*d* moves.

The nozzle 23*d* linearly moves on the nozzle movement path for air intake Inp1 along the arrangement direction of the opening portions 16$a_1$ to 16$a_8$, that is, the longitudinal direction of the semimanufactured cylinder head 3, while spraying the raw material powder P. After moving from the outside of the semimanufactured cylinder head 3 to above the cylinder block mounting surface 12*a*, the nozzle 23*d* passes above the cylinder block mounting surface 12*a* and moves to above the first opening portion 16$a_1$. When reaching the first coating start position Is1, the nozzle 23*d* switches the direction of travel so as to fold back in the opposite direction and moves in the counterclockwise direction so as to trace over the annular valve seat portion 16*c* along the coating path for air intake Idp1, thus forming the valve seat coat 16*b* on the annular valve seat portion 16*c* of the opening portion $\mathbf{16}a_1$.

After moving to the first coating end position Tel, the nozzle 23*d* switches the direction of travel so as to fold back in the opposite direction, moves again above the combustion chamber upper wall portion $\mathbf{12}b_1$ along the nozzle movement path for air intake Inp1, and moves to the coating start position Is1 for the next opening portion $\mathbf{16}a_2$. When reaching the coating start position Is1 for the opening portion 16*a*2, the nozzle 23*d* moves above the second opening portion $\mathbf{16}a_2$ in the counterclockwise direction in the figure so as to trace over the opening portion $\mathbf{16}a_2$ and forms the valve seat coat 16*b* on the annular valve seat portion 16*c* of the opening portion $\mathbf{16}a_2$.

After moving to the coating end position Ie1 of the opening portion 16*a*2, the nozzle 23*d* moves above the combustion chamber upper wall portion $\mathbf{12}b_1$ and above the cylinder block mounting surface 12*a* again along the nozzle movement path for air intake Inp1 and moves to the coating start position Is1 for the opening portion $\mathbf{16}a_3$ of the next combustion chamber upper wall portion 12*b*2. After that, the valve seat coats 16*b* are formed on the opening portions $\mathbf{16}a_3$ to $\mathbf{16}a_8$ of the combustion chamber upper wall portions $\mathbf{12}b_2$ to $\mathbf{12}b_4$ in the same manner as for the opening portions $\mathbf{16}a_1$ and $\mathbf{16}a_2$. After finishing the formation of the valve seat coat 16*b* for the final opening portion $\mathbf{16}a_8$, the nozzle 23*d* moves above the combustion chamber upper wall portion $\mathbf{12}b_4$ and above the cylinder block mounting surface 12*a* along the nozzle movement path for air intake Inp1 and is moved to the outside of the semimanufactured cylinder head 3.

When the formation of the valve seat coats 16*b* for the opening portions $\mathbf{16}a_1$ to $\mathbf{16}a_8$ of the intake ports 16 is completed, the formation of the valve seat coats 17*b* for the opening portions $\mathbf{17}a_1$ to $\mathbf{17}a_8$ of the exhaust ports 17 is started. The nozzle 23*d* linearly moves on the nozzle movement path for air exhaust Enp 1 along the arrangement direction of the opening portions $\mathbf{17}a_1$ to $\mathbf{17}a_8$, that is, the longitudinal direction of the semimanufactured cylinder head 3, while spraying the raw material powder P. After moving from the outside of the semimanufactured cylinder head 3 to above the cylinder block mounting surface 12*a*, the nozzle 23*d* passes above the cylinder block mounting surface 12*a* and moves to above the first opening portion $\mathbf{17}a_1$. When reaching the first coating start position Es1, the nozzle 23*d* switches the direction of travel so as to fold back in the opposite direction and moves in the clockwise direction so as to trace over the annular valve seat portion along the coating path for air exhaust Edp1, thus forming the valve seat coat 17*b* on the annular valve seat portion 17*c* of the opening portion $\mathbf{17}a_1$.

After moving to the coating end position Ee1 of the opening portion $\mathbf{17}a_1$, the nozzle 23*d* moves again above the combustion chamber upper wall portion $\mathbf{12}b_1$ along the nozzle movement path for air exhaust Enp1 and moves to the coating start position Es1 for the next opening portion $\mathbf{17}a_2$. When reaching the coating start position Es1 for the next opening portion 17*a*2, the nozzle 23*d* moves above the second opening portion $\mathbf{17}a_2$ in the clockwise direction in the figure so as to trace over the opening portion $\mathbf{17}a_2$ and forms the valve seat coat 17*b* on the annular valve seat portion 17*c* of the opening portion $\mathbf{17}a_2$.

After moving to the coating end position Ee1 of the opening portion 17*a*2, the nozzle 23*d* moves above the combustion chamber upper wall portion $\mathbf{12}b_1$ and above the cylinder block mounting surface 12*a* again along the nozzle movement path for air exhaust Enp1 and moves to the coating start position Es1 for the opening portion $\mathbf{17}a_3$ of the next combustion chamber upper wall portion 12*b*2. After that, the valve seat coats 17*b* are formed on the opening portions $\mathbf{17}a_3$ to $\mathbf{17}a_8$ of the combustion chamber upper wall portions $\mathbf{12}b_2$ to $\mathbf{12}b_4$ in the same manner as for the opening portions $\mathbf{17}a_1$ and $\mathbf{17}a_2$. After finishing the formation of the valve seat coat 17*b* for the final opening portion $\mathbf{17}a_8$, the nozzle 23*d* moves above the combustion chamber upper wall portion $\mathbf{12}b_4$ and above the cylinder block mounting surface 12*a* along the nozzle movement path for air exhaust Enp1 and is moved to the outside of the semimanufactured cylinder head 3.

Figure 9B:
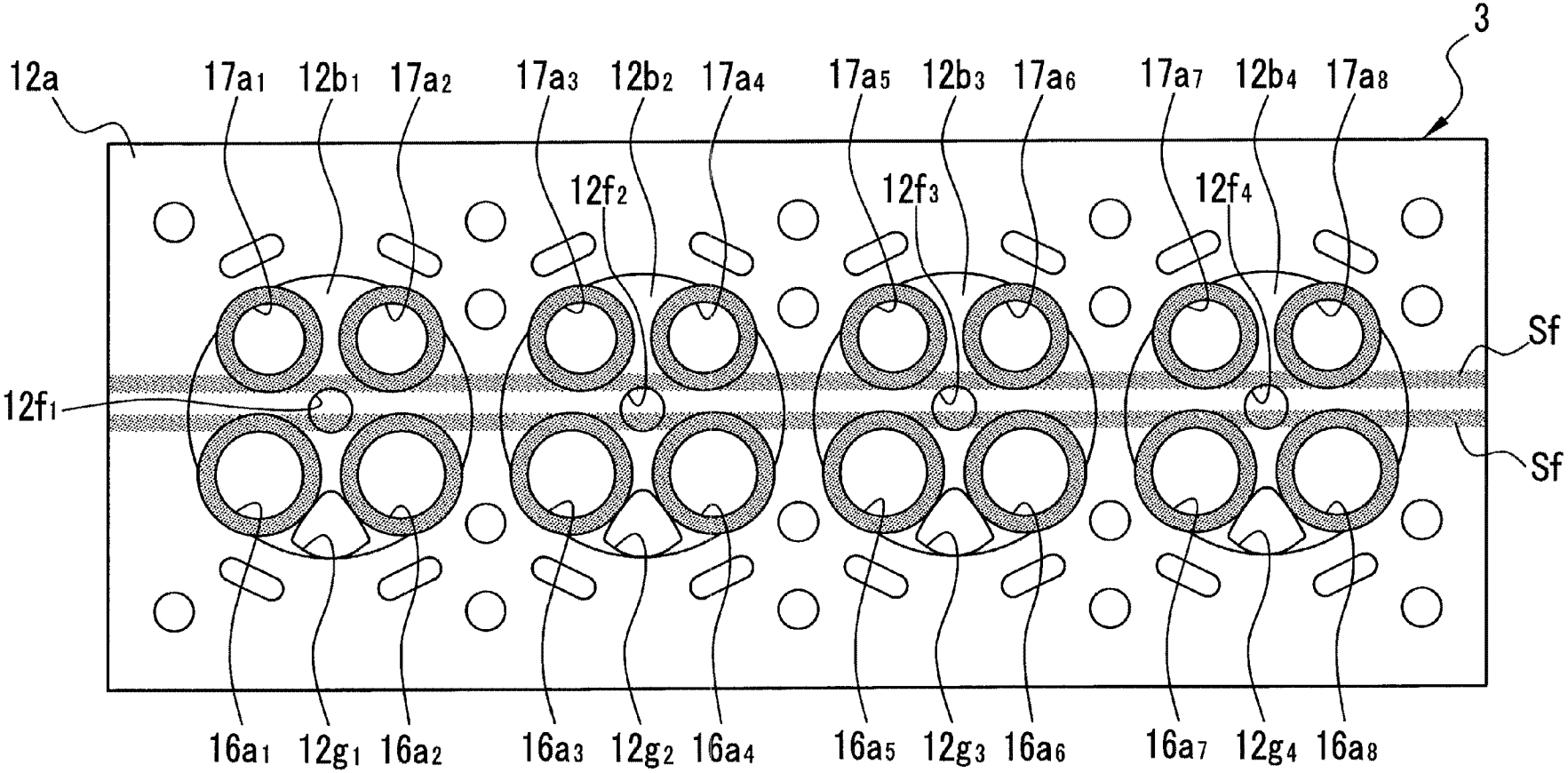
FIG. 9B is a plan view of the semimanufactured cylinder head illustrating excessive coats formed by the nozzle of the cold spray apparatus moving along the nozzle movement paths illustrated in FIG. 9A.

FIG. 9B illustrates the cylinder block mounting surface 12*a* of the semimanufactured cylinder head 3 after the valve seat coats 16*b* and 17*b* are formed. As illustrated in FIG. 9B, the valve seat coats 16*b* are formed at the opening portions $\mathbf{16}a_1$ to $\mathbf{16}a_8$ of the intake ports 16, and the valve seat coats 17*b* are formed at the opening portions $\mathbf{17}a_1$ to $\mathbf{17}a_8$ of the exhaust ports 17. In addition, excessive coats Sf are formed on the cylinder block mounting surface 12*a* and the combustion chamber upper wall portions $\mathbf{12}b_1$ to $\mathbf{12}b_4$, but the excessive coats Sf are not formed in the intake ports 16 or the exhaust ports 17.

Thus, the nozzle 23*d* is moved between the opening portions $\mathbf{16}a_1$ to $\mathbf{16}a_8$ and the opening portions $\mathbf{17}a_1$ to $\mathbf{17}a_8$ while continuing to spray the raw material powder P, and the cycle time of the coating step S3 can therefore be shortened as compared with the case in which the spraying of the raw material powder P and its stopping are repeated to form the valve seat coats 16*b* and 17*b* at the plurality of opening portions $\mathbf{16}a_1$ to $\mathbf{16}a_8$ and opening portions $\mathbf{17}a_1$ to $\mathbf{17}a_8$.

Moreover, the nozzle movement path for air intake Inp1 and the nozzle movement path for air exhaust Enp1 are set to allow the nozzle 23*d* to move above the cylinder block mounting surface 12*a* and above the combustion chamber upper wall portions $\mathbf{12}b_1$ to $\mathbf{12}b_4$ rather than to move above the opening portions $\mathbf{16}a_1$ to $\mathbf{16}a_8$ of the intake ports 16 or above the opening portions $\mathbf{17}a_1$ to $\mathbf{17}a_8$ of the exhaust ports 17, and it is therefore possible to prevent the excessive coats Sf from being formed at positions in the intake ports 16 or the exhaust ports 17 from which the excessive coats Sf cannot be removed.

The excessive coats Sf are formed on the cylinder block mounting surface 12*a*, but the cylinder block mounting surface 12*a* has been conventionally post-processed using a milling machine or the like to improve the flatness, and the excessive coats Sf formed on the cylinder block mounting surface 12*a* can therefore be removed without providing any new step. Furthermore, the excessive coats Sf are also formed on the combustion chamber upper wall portions $\mathbf{12}b_1$ to $\mathbf{12}b_4$, but the excessive coats Sf on the combustion chamber upper wall portions $\mathbf{12}b_1$ to $\mathbf{12}b_4$ can be removed relatively easily because the combustion chamber upper wall portions $\mathbf{12}b_1$ to $\mathbf{12}b_4$ are exposed to the outside. The excessive coats Sf formed on the combustion chamber upper wall portions $\mathbf{12}b_1$ to $\mathbf{12}b_4$ may be left unremoved if they do not affect the combustion performance of the engine 1.

The nozzle movement path for air intake Inp1 is set linearly along the arrangement direction of the opening portions $\mathbf{16}a_1$ to $\mathbf{16}a_8$ so as to be in contact with the opening portions $\mathbf{16}a_1$ to $\mathbf{16}a_8$, and the coating start positions Is1 and the coating end positions Ie1 are set on the nozzle movement path for air intake Inp1. Likewise, the nozzle movement path for air exhaust Enp1 is linearly set along the arrangement direction of the opening portions 17$a_1$ to 17$a_8$ so as to be in contact with the opening portions 17$a_1$ to 17$a_8$, and the coating start positions Es1 and the coating end positions Ee1 are set on the nozzle movement path for air exhaust Enp1. It is therefore possible to shorten the distance along which the nozzle 23*d* uselessly injects the raw material powder P, that is, the distance along which the excessive coats Sf are formed. This can suppress the waste of the raw material powder P and reduce the number of steps for removing the excessive coats Sf.

Furthermore, the strength between the opening portions 16$a_1$ to 16$a_8$ and the opening portions 17$a_1$ to 17$a_8$ can be increased through setting the nozzle movement path for air intake Inp1 and the nozzle movement path for air exhaust Enp1 between the opening portions 16$a_1$ to 16$a_8$ of the intake ports 16 and the opening portions 17$a_1$ to 17$a_8$ of the exhaust ports 17 and spraying the raw material powder P to form the excessive coats Sf thereby applying the compressive residual stress between the intake ports 16 and the exhaust ports 17.

The cylinder head 12 undergoes repetitive heating at a high temperature in a restrained state of being mounted on the cylinder block 11, so that the thermal fatigue phenomenon may possibly cause cracks between the opening portions 16$a_1$ to 16$a_8$ of the intake ports 16 and the opening portions 17$a_1$ to 17$a_8$ of the exhaust ports 17. That is, the cylinder block mounting surface 12*a* of the cylinder head 12 tends to expand by receiving heat from the combustion chambers 15 and being heated, but the cylinder head 12 is restrained by the cylinder block 11 and therefore receives the compressive load to yield, thus generating the compressive stress. If, in such a state, the engine 1 is stopped and the cylinder head 12 is cooled, the cylinder block mounting surface 12*a* of the cylinder head 12 tends to shrink, so that the tensile stress is generated on the yielding surface of the cylinder block mounting surface 12*a*. Due to repetition of the compressive stress and the tensile stress, cracks may occur between the opening portions 16$a_1$ to 16$a_8$ and the opening portions 17$a_1$ to 17$a_8$ which are exposed to the thermally severest condition.

Figure 12:
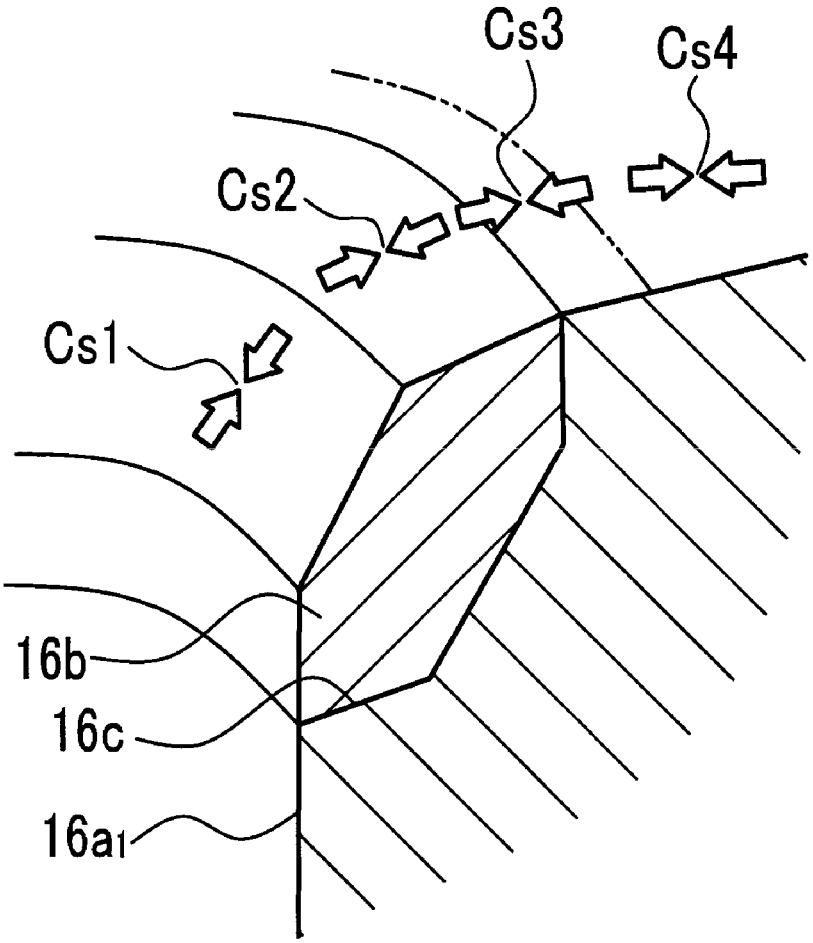
FIG. 12 is a cross-sectional view illustrating the distribution of compressive residual stress applied by an excessive coat illustrated in FIG. 9B around a valve opening portion of the semimanufactured cylinder head.

To overcome such a problem, in the present embodiment, the nozzle movement path for air intake Inp1 and the nozzle movement path for air exhaust Enp 1 are set between the opening portions 16$a_1$ to 16$a_8$ and the opening portions 17$a_1$ to 17$a_8$ to form the excessive coats Sf thereby to apply the compressive residual stress as in the case of performing the shot peening process. FIG. 12 is a cross-sectional view illustrating the opening portion 16$a_1$ of the intake port 16 after the valve seat coat 16*b* is formed. As illustrated in FIG. 12, a compressive residual stress Cs1 (e.g., 350 to 467 Mpa) is generated in the valve seat coat 16*b* formed at the opening portion 16$a_1$, and a compressive residual stress Cs2 (e.g., 23 to 118 Mpa) is generated in the outer part of the valve seat coat 16*b*. On the other hand, a compressive residual stress Cs3 (e.g., 34 to 223 Mpa) larger than that in the outer part of the valve seat coat 16*b* is generated between the opening portion 16$a_1$ of the intake port 16 and the opening portion 17$a_1$ of the exhaust port 17. Thus, this compressive residual stress enhances the strength between the opening portions 16$a_1$ to 16$a_8$ of the intake ports 16 and the opening portions 17$a_1$ to 17$a_8$ of the exhaust ports 17, and the occurrence of cracks can therefore be prevented.

Moreover, the excessive coats Sf are not formed in any of the injector holes 12$g_1$ to 12$g_4$ because the nozzle movement path for air intake Inp1 and the nozzle movement path for air exhaust Enp1 are set between the opening portions 16$a_1$ to 16$a_8$ of the intake ports 16 and the opening portions 17$a_1$ to 17$a_8$ of the exhaust ports 17. When using the nozzle movement path for air intake Inp1 and the nozzle movement path for air exhaust Enp1, the excessive coats Sf are formed in the plug holes 12$f_1$ to 12$f_4$, but the plug holes 12$f_1$ to 12$f_4$ are necessarily post-processed to form threaded bores for the spark plugs, and the excessive coats Sf can be removed by that post-processing.

Second Embodiment

Figure 13A:
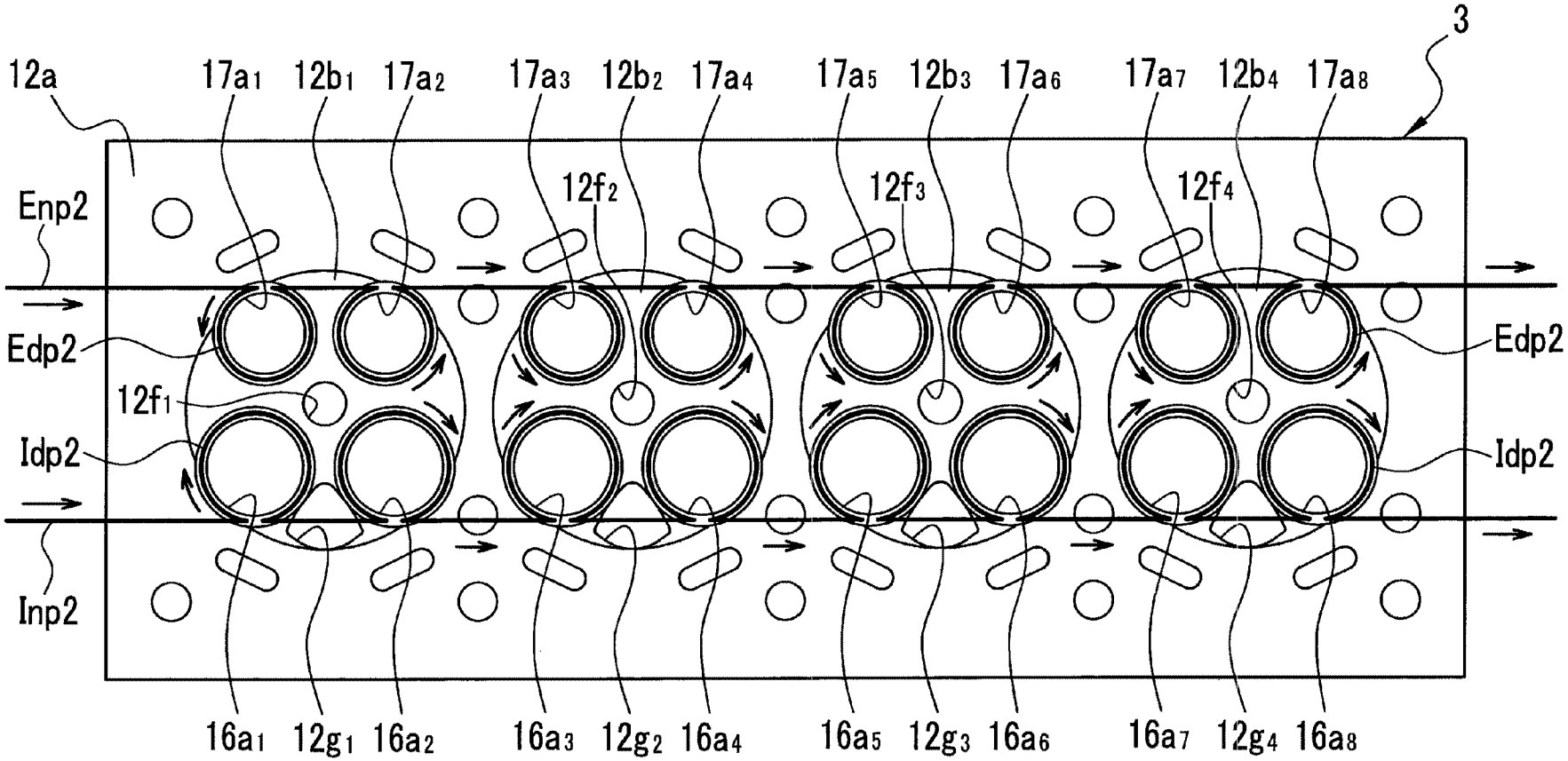
FIG. 13A is a plan view of the semimanufactured cylinder head illustrating nozzle movement paths that are set between the combustion chamber upper wall portions and the intake and exhaust ports according to the coating method of a second embodiment of the present invention.
Figure 14:
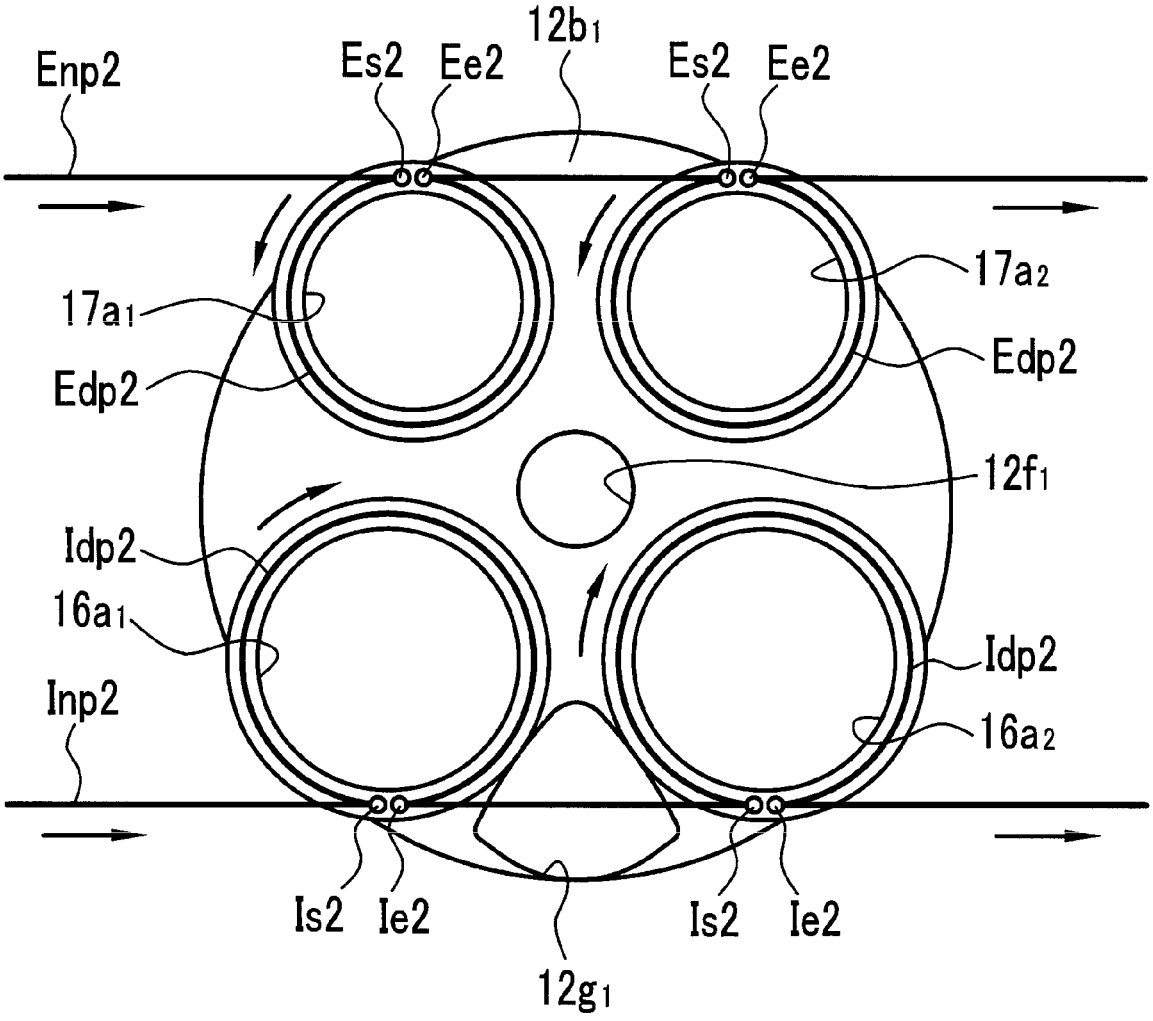
FIG. 14 is an enlarged plan view of a part of the semimanufactured cylinder head and nozzle movement paths illustrated in FIG. 13A.

A second embodiment regarding the nozzle movement paths will then be described. FIG. 13A is a plan view illustrating the cylinder block mounting surface 12*a* of the semimanufactured cylinder head 3 and illustrates a nozzle movement path for air intake Inp2 for forming the valve seat coats 16*b* at the opening portions 16$a_1$ to 16$a_8$ of the intake ports 16 and a nozzle movement path for air exhaust Enp2 for forming the valve seat coats 17*b* at the opening portions 17$a_1$ to 17$a_8$ of the exhaust ports 17. FIG. 14 illustrates an enlarged view of the leftmost combustion chamber upper wall portion 12$b_1$ of the semimanufactured cylinder head 3 illustrated in FIG. 13A.

The nozzle movement path for air intake Inp2 is linearly set along the arrangement direction of the opening portions 16$a_1$ to 16$a_8$ so as to be in contact with the opening portions 16$a_1$ to 16$a_8$ between edge portions of the combustion chamber upper wall portions 12$b_1$ to 12$b_4$ and the opening portions 16$a_1$ to 16$a_8$. The nozzle 23*d* moves on the nozzle movement path for air intake Inp2 from the left side to the right side in the figure. This nozzle movement path for air intake Inp2 allows the nozzle 23*d* to move above the cylinder block mounting surface 12*a* and above the combustion chamber upper wall portions 12$b_1$ to 12$b_4$ rather than to move above the opening portions 16$a_1$ to 16$a_8$ of the intake ports 16 or above the opening portions 17$a_1$ to 17$a_8$ of the exhaust ports 17.

For the nozzle movement path for air intake Inp2 thus set, annular coating paths for air intake Idp2 are set on the annular valve seat portions 16*c* of the respective opening portions 16$a_1$ to 16$a_8$ so as to be in contact with the nozzle movement path for air intake Inp2. In addition, positions at which the nozzle movement path for air intake Inp2 is in contact with the coating paths for air intake Idp2 are set with coating start positions Is2 at which the nozzle 23*d* starts spraying the raw material powder P onto the annular valve seat portions 16*c* of the opening portions 16$a_1$ to 16$a_8$ and coating end positions Ie2 at which the nozzle 23*d* finishes spraying the raw material powder P onto the annular valve seat portions 16*c*.

The nozzle movement path for air exhaust Enp2 is linearly set along the arrangement direction of the opening portions 17$a_1$ to 17$a_8$ so as to be in contact with the opening portions 17$a_1$ to 17$a_8$ between edge portions of the combustion chamber upper wall portions 12$b_1$ to 12$b_4$ and the opening portions 17$a_1$ to 17$a_8$. The nozzle 23*d* moves on the nozzle movement path for air exhaust Enp2 from the left side to the right side in the figure. This nozzle movement path for air exhaust Enp2 allows the nozzle 23*d* to move above the cylinder block mounting surface 12*a* and above the combustion chamber upper wall portions 12$b_1$ to 12$b_4$ rather than to move above the opening portions 16$a_1$ to 16$a_8$ of the intake ports 16 or above the opening portions 17$a_1$ to 17$a_8$ of the exhaust ports 17.

For the nozzle movement path for air exhaust Enp2 thus set, annular coating paths for air exhaust Edp2 are set on the annular valve seat portions 17*c* of the respective opening portions 17$a_1$ to 17$a_8$ so as to be in contact with the nozzle movement path for air exhaust Enp2. In addition, positions at which the nozzle movement path for air exhaust Enp2 is in contact with the coating paths for air exhaust Edp2 are set with coating start positions Es2 at which the nozzle 23*d* starts spraying the raw material powder P onto the annular valve seat portions 17*c* of the opening portions 17$a_1$ to 17$a_8$ and coating end positions Ee2 at which the nozzle 23*d* finishes spraying the raw material powder P onto the annular valve seat portions 17*c*.

The coating start positions Is2 and coating end positions Ie2 of the nozzle movement path for air intake Inp2 are set so that the coats overlap as in the coating start positions Is1 and coating end positions Ie1 of the first embodiment. The valve seat coats 16*b* are therefore formed without any gap over the entire circumferences of the opening portions 16$a_1$ to 16$a_8$. Likewise, the coating start positions Es2 and coating end positions Ee2 of the nozzle movement path for air exhaust Enp2 are set so that the coats overlap as in the coating start positions Es1 and coating end positions Ee1 of the first embodiment. The valve seat coats 17*b* are therefore formed without any gap over the entire circumferences of the opening portions 17$a_1$ to 17$a_8$.

The nozzle 23*d* moves along the nozzle movement path for air intake Inp2 and the coating paths for air intake Idp2 as follows. The nozzle 23*d* linearly moves on the nozzle movement path for air intake Inp2 along the arrangement direction of the opening portions 16$a_1$ to 16$a_8$, that is, the longitudinal direction of the semimanufactured cylinder head 3, while spraying the raw material powder P. After moving from the outside of the semimanufactured cylinder head 3 to above the cylinder block mounting surface 12*a*, the nozzle 23*d* passes above the cylinder block mounting surface 12*a* and moves to above the first opening portion 16$a_1$. When reaching the first coating start position Is2, the nozzle 23*d* switches the direction of travel so as to fold back in the opposite direction and moves in the clockwise direction so as to trace over the annular valve seat portion 16*c* along the coating path for air intake Idp2, thus forming the valve seat coat 16*b* on the annular valve seat portion 16*c* of the opening portion 16$a_1$.

After moving to the first coating end position Ie2, the nozzle 23*d* moves again above the combustion chamber upper wall portion 12$b_1$ along the nozzle movement path for air intake Inp2 and moves to the coating start position Is2 for the next opening portion 16$a_2$. When reaching the coating start position Is2 for the next opening portion 16*a*2, the nozzle 23*d* moves above the second opening portion 16$a_2$ in the clockwise direction in the figure so as to trace over the second opening portion 16$a_2$ and forms the valve seat coat 16*b* on the annular valve seat portion 16*c* of the opening portion 16$a_2$.

After moving to the coating end position Ie2 of the opening portion 16*a*2, the nozzle 23*d* moves above the combustion chamber upper wall portion 12$b_1$ and above the cylinder block mounting surface 12*a* again along the nozzle movement path for air intake Inp2 and moves to the coating start position Is2 for the opening portion 16$a_3$ of the next combustion chamber upper wall portion 12*b*2. After that, the valve seat coats 16*b* are formed on the opening portions 16$a_3$ to 16$a_8$ of the combustion chamber upper wall portions 12$b_2$ to 12$b_4$ in the same manner as for the opening portions 16$a_1$ and 16$a_2$. After finishing the formation of the valve seat coat 16*b* for the final opening portion 16$a_8$, the nozzle 23*d* moves above the combustion chamber upper wall portion 12$b_4$ and above the cylinder block mounting surface 12*a* along the nozzle movement path for air intake Inp2 and is moved to the outside of the semimanufactured cylinder head 3.

When the formation of the valve seat coats 16*b* for the opening portions 16$a_1$ to 16$a_8$ of the intake ports 16 is completed, the formation of the valve seat coats 17*b* for the opening portions 17*a*1 to 17$a_8$ of the exhaust ports 17 is started. The nozzle 23*d* linearly moves on the nozzle movement path for air exhaust Enp2 along the arrangement direction of the opening portions 17$a_1$ to 17$a_8$, that is, the longitudinal direction of the semimanufactured cylinder head 3, while spraying the raw material powder P. After moving from the outside of the semimanufactured cylinder head 3 to above the cylinder block mounting surface 12*a*, the nozzle 23*d* passes above the cylinder block mounting surface 12*a* and moves to above the first opening portion 17$a_1$. When reaching the first coating start position Es2, the nozzle 23*d* switches the direction of travel so as to fold back in the opposite direction and moves in the counterclockwise direction so as to trace over the annular valve seat portion 17*c* along the coating path for air exhaust Edp2, thus forming the valve seat coat 17*b* on the annular valve seat portion 17*c* of the opening portion 17$a_1$.

After moving to the coating end position Ee2 of the opening portion 17$a_1$, the nozzle 23*d* moves again above the combustion chamber upper wall portion 12$b_1$ along the nozzle movement path for air exhaust Enp2 and moves to the coating start position Es2 for the next opening portion 17$a_2$. When reaching the coating start position Es2 for the next opening portion 17*a*2, the nozzle 23*d* moves above the second opening portion 17$a_2$ in the counterclockwise direction in the figure so as to trace over the second opening portion 17$a_2$ and forms the valve seat coat 17*b* on the annular valve seat portion 17*c* of the opening portion 17$a_2$.

After moving to the coating end position Ee2 of the opening portion 17*a*2, the nozzle 23*d* moves above the combustion chamber upper wall portion 12$b_1$ and above the cylinder block mounting surface 12*a* again along the nozzle movement path for air exhaust Enp2 and moves to the coating start position Es2 for the opening portion 17$a_3$ of the next combustion chamber upper wall portion 12*b*2. After that, the valve seat coats 17*b* are formed on the opening portions 17$a_3$ to 17$a_8$ of the combustion chamber upper wall portions 12$b_2$ to 12$b_4$ in the same manner as for the opening portions 17$a_1$ and 17$a_2$. After finishing the formation of the valve seat coat 17*b* for the final opening portion 17$a_8$, the nozzle 23*d* moves above the combustion chamber upper wall portion 12$b_4$ and above the cylinder block mounting surface 12*a* along the nozzle movement path for air exhaust Enp2 and is moved to the outside of the semimanufactured cylinder head 3.

Figure 13B:
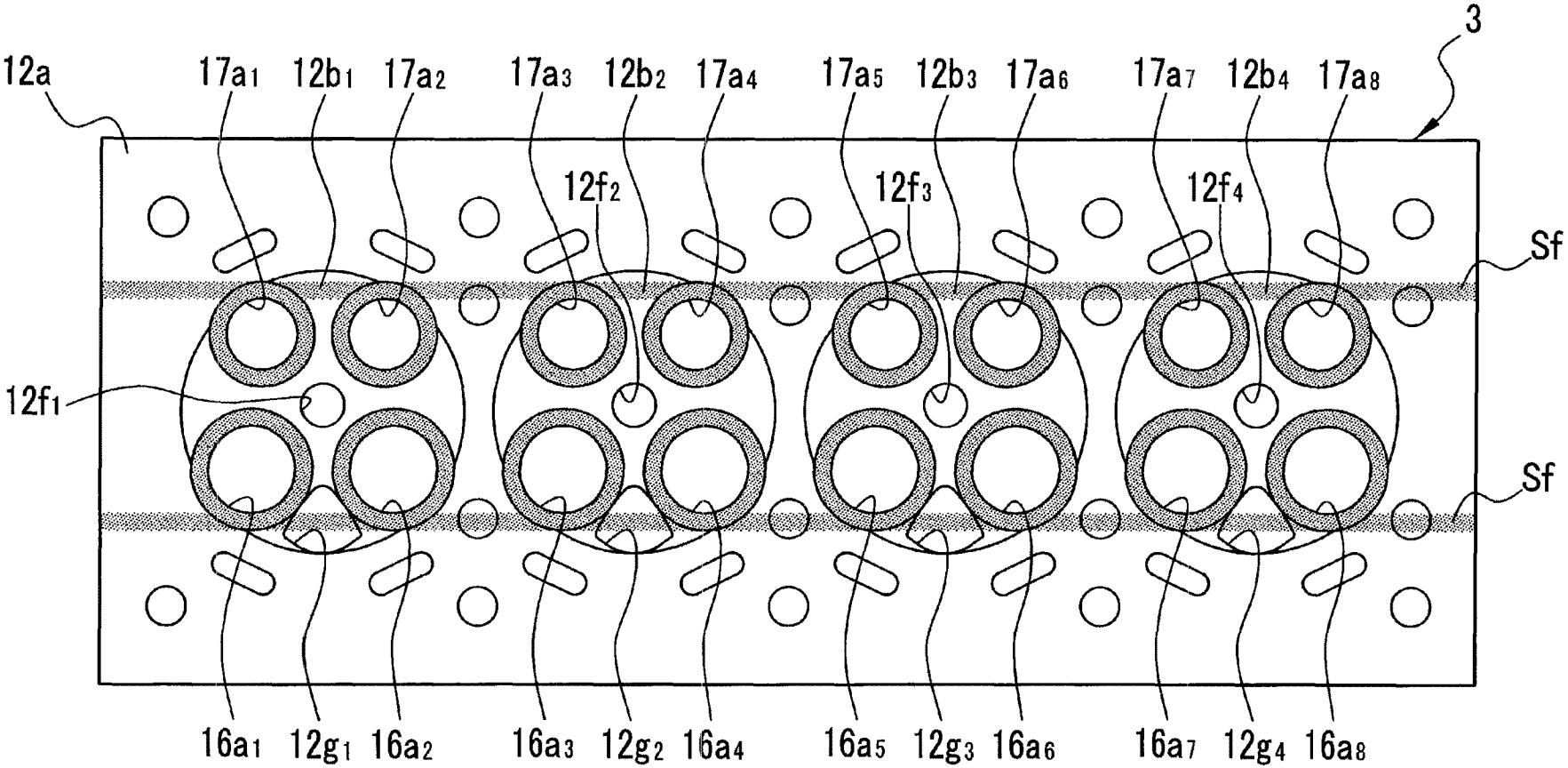
FIG. 13B is a plan view of the semimanufactured cylinder head illustrating excessive coats formed by the nozzle of the cold spray apparatus moving along the nozzle movement paths illustrated in FIG. 13A.

FIG. 13B illustrates the cylinder block mounting surface 12*a* of the semimanufactured cylinder head 3 after the valve seat coats 16*b* and 17*b* are formed. As illustrated in FIG. 13B, the valve seat coats 16*b* are formed at the opening portions 16$a_1$ to 16$a_8$ of the intake ports 16, and the valve seat coats 17*b* are formed at the opening portions 17$a_1$ to 17$a_8$ of the exhaust ports 17. In addition, excessive coats Sf are formed on the cylinder block mounting surface 12*a* and the combustion chamber upper wall portions 12$b_1$ to 12$b_4$, but the excessive coats Sf are not formed in the intake ports 16 or the exhaust ports 17.

Thus, in the present embodiment, the nozzle 23*d* is moved between any two of the opening portions 16$a_1$ to 16$a_8$ and between any two of the opening portions 17$a_1$ to 17$a_8$ while continuing to spray the raw material powder P, and the nozzle 23*d* is made so as not to move above the opening portions 16$a_1$ to 16$a_8$ or the opening portions 17$a_1$ to 17$a_8$; therefore, the problems (1) and (2) can be overcome as in the first embodiment.

In the present embodiment, the improvement of the strength by the compressive residual stress may not be achieved because the excessive coats Sf are not formed between the opening portions 16$a_1$ to 16$a_8$ and the opening portions 17$a_1$ to 17$a_8$. However, fortunately, the nozzle movement path for air intake Inp2 and the nozzle movement path for air exhaust Enp2 are set at positions separated from each other via the combustion chamber upper wall portions 12$b_1$ to 12$b$4; therefore, the heat generated during the cold spray is dissipated and the valve seat coats 16$b$ and 17$b$ can be formed in which the residual stress is less likely to accumulate.

Moreover, in the present embodiment, the coating start positions Is2 and Es2 and the coating end positions Ie2 and Ee2 are not disposed on the central portions of the combustion chamber upper wall portions 12$b_1$ to 12$b_4$ at which the temperature during operation of the engine 1 is high and the heat load is large. Rather, the coating start positions Is2 and Es2 and the coating end positions Ie2 and Ee2 are set on the edge portion sides of the combustion chamber upper wall portions 12$b_1$ to 12$b_4$ at which the temperature is lower than that in the central portions and the heat load is smaller than that in the central portions. The performance of the valve seat coats 16$b$ and 17$b$ is therefore not affected even when the strength of the coating start positions Is2 and coating end positions Ie2 of the valve seat coats 16$b$ and the strength of the coating start positions Es2 and coating end positions Ee2 of the valve seat coats 17$b$ become lower than predetermined strength that is preliminarily set.

Furthermore, in the present embodiment, the nozzle movement path for air intake Inp2 is set between the edge portions of the combustion chamber upper wall portions 12$b_1$ to 12$b_4$ and the opening portions 16$a_1$ to 16$a_8$, and the nozzle movement path for air exhaust Enp2 is set between the edge portions of the combustion chamber upper wall portions 12$b_1$ to 12$b_4$ and the opening portions 17$a_1$ to 17$a_8$; therefore, the excessive coats Sf are not formed in any of the plug holes 12$f_1$ to 12$f_4$.

Figure 15:
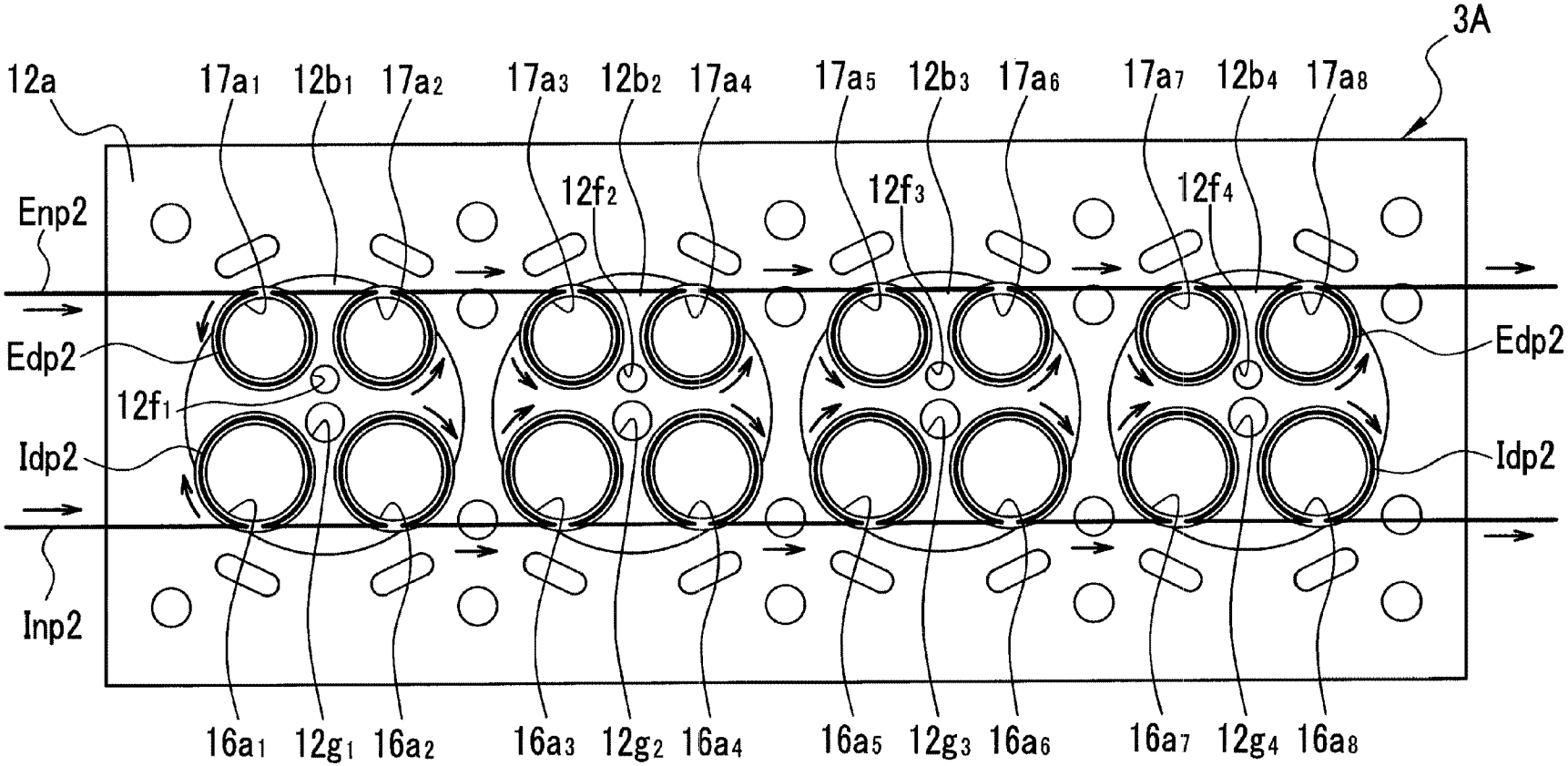
FIG. 15 is a plan view illustrating a state in which the nozzle movement paths according to the second embodiment of the present invention are set for the semimanufactured cylinder head provided with injector holes at central portions of the combustion chamber upper wall portions.

In-cylinder injection-type engines include spray guide-type (center injection-type) engines in which injectors are arranged so as to inject the fuel downward into the fuel chambers from approximately above the centers of the combustion chambers. As illustrated in FIG. 15, the semimanufactured cylinder head 3A of such a spray guide-type engine is configured such that the injector holes 12$g_1$ to 12$g_4$ are arranged alongside the plug holes 12$f_1$ to 12$f_4$ in the central portions of the combustion chamber upper wall portions 12$b_1$ to 12$b_4$. The nozzle movement path for air intake Inp2 and nozzle movement path for air exhaust Enp2 of the present embodiment can be applied to the semimanufactured cylinder head 3A of such a spray guide-type engine thereby to suppress the formation of the excessive coats Sf not only in the intake ports 16 and the exhaust ports 17 but also in the plug holes 12$f_1$ to 12$f_4$ and the injector holes 12$g_1$ to 12$g_4$.

Third Embodiment

A third embodiment regarding the nozzle movement paths will then be described. This embodiment represents a combination of the nozzle movement path for air intake Inp1 or the nozzle movement path for air exhaust Enp1 as described in the first embodiment and the nozzle movement path for air intake Inp2 or the nozzle movement path for air exhaust Enp2 as described in the second embodiment. For example, in the semimanufactured cylinder head 3 illustrated in FIG. 16, the nozzle movement path for air intake Inp1 of the first embodiment is applied to the intake ports 16 while the nozzle movement path for air exhaust Enp2 of the second embodiment is applied to the exhaust ports 17. In the semimanufactured cylinder head 3 illustrated in FIG. 17, the nozzle movement path for air intake Inp2 of the second embodiment is applied to the intake ports 16 while the nozzle movement path for air exhaust Enp1 of the first embodiment is applied to the exhaust ports 17.

According to this embodiment, the nozzle 23$d$ is moved between any two of the opening portions 16$a_1$ to 16$a_8$ and between any two of the opening portions 17$a_1$ to 17$a_8$ while continuing to spray the raw material powder P, and the nozzle 23$d$ is made so as not to move above the opening portions 16$a_1$ to 16$a_8$ or the opening portions 17$a_1$ to 17$a$8; therefore, the problems (1) and (2) can be overcome as in the first embodiment and the second embodiment.

Figure 16:
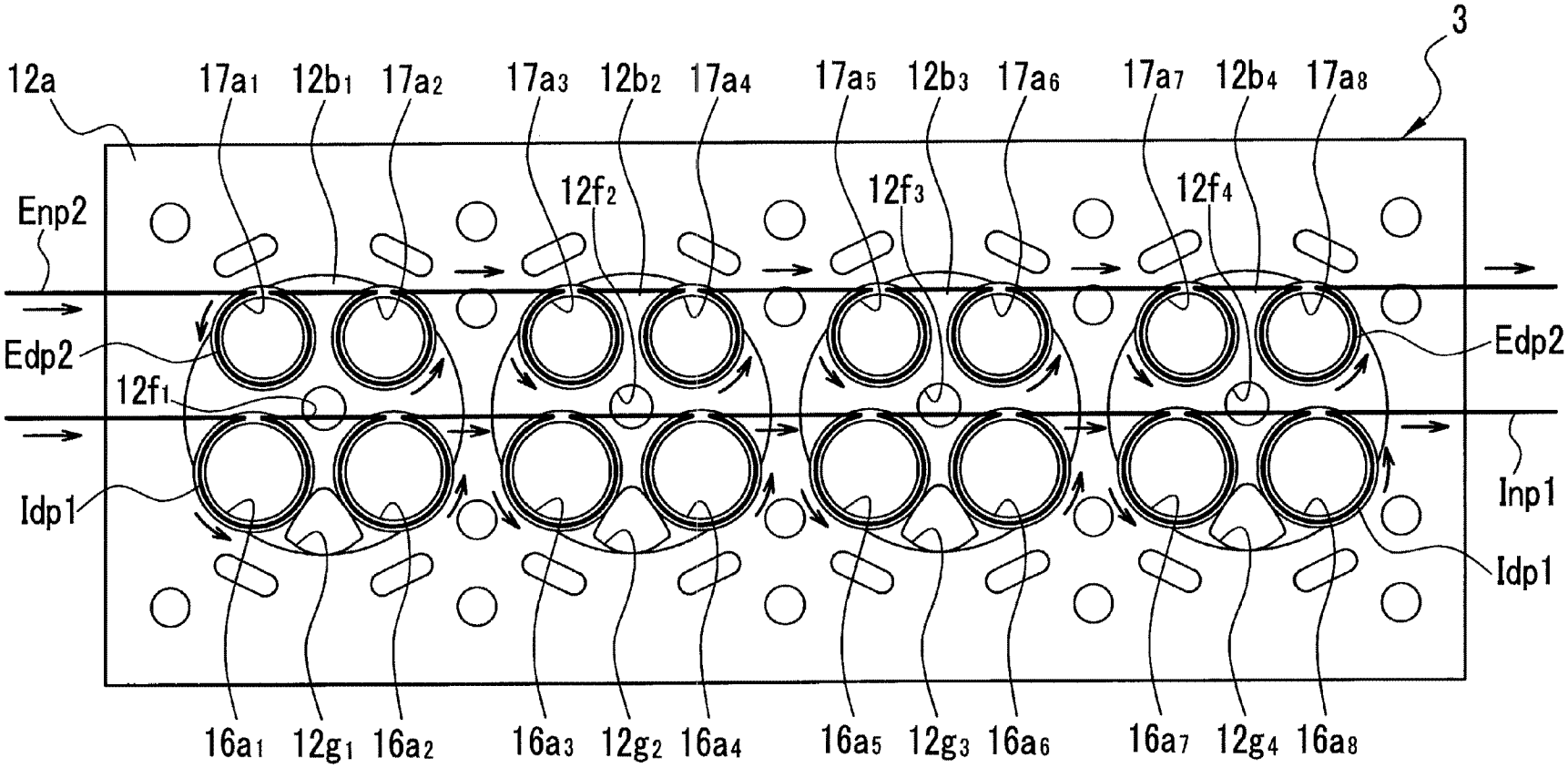
FIG. 16 is a plan view of the semimanufactured cylinder head illustrating nozzle movement paths that are set between the intake ports and the exhaust ports and between the combustion chamber upper wall portions and the exhaust ports according to the coating method of a third embodiment of the present invention.

In the embodiment illustrated in FIG. 16, effects obtained by combining the effect of the first embodiment and the effect of the second embodiment can be exhibited. That is, by spraying the raw material powder P between the opening portions 16$a_1$ to 16$a_8$ and the opening portions 17$a_1$ to 17$a_8$ to form the excessive coats, the compressive residual stress can be applied to improve the strength. Moreover, the heat generated during the cold spray is dissipated in the exhaust ports 17, and the valve seat coats 17$b$ can be formed in which the residual stress is less likely to accumulate. Furthermore, the formation of the excessive coats Sf in the injector holes 12$g_1$ to 12$g_4$ can be prevented.

Figure 17:
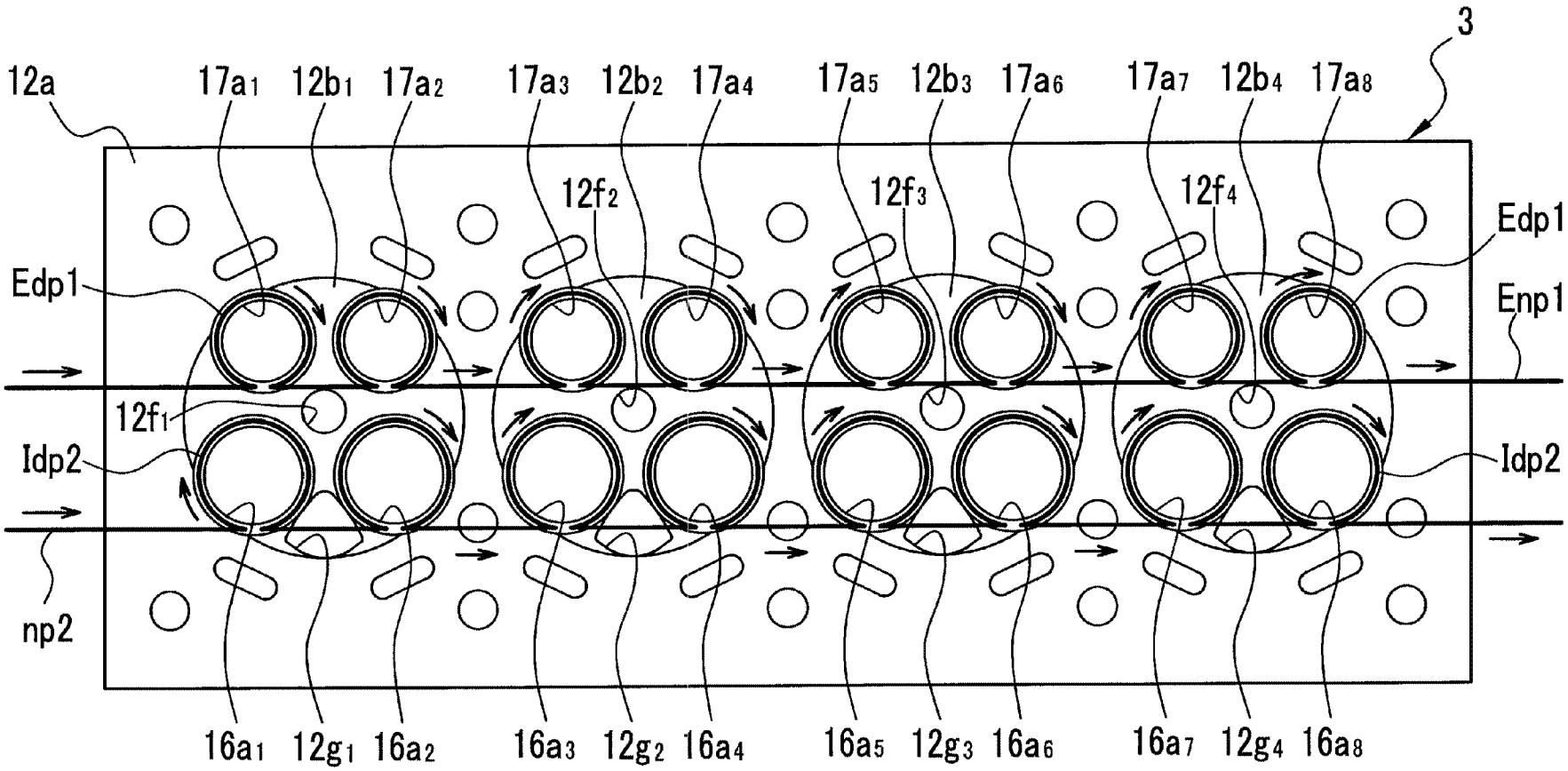
FIG. 17 is a plan view of the semimanufactured cylinder head illustrating nozzle movement paths that are set between the intake ports and the exhaust ports and between the combustion chamber upper wall portions and the intake ports according to the coating method of the third embodiment of the present invention.

Also in the embodiment illustrated in FIG. 17, effects obtained by combining the effect of the first embodiment and the effect of the second embodiment can be exhibited. That is, by spraying the raw material powder P between the opening portions 16$a_1$ to 16$a_8$ and the opening portions 17$a_1$ to 17$a_8$ to form the excessive coats, the compressive residual stress can be applied to improve the strength. Moreover, the heat generated during the cold spray is dissipated in the intake ports 16, and the valve seat coats 16$b$ can be formed in which the residual stress is less likely to accumulate. Furthermore, the formation of the excessive coats Sf in the plug holes 12$f_1$ to 12$f_4$ can be prevented.

Fourth Embodiment

Figure 18A:
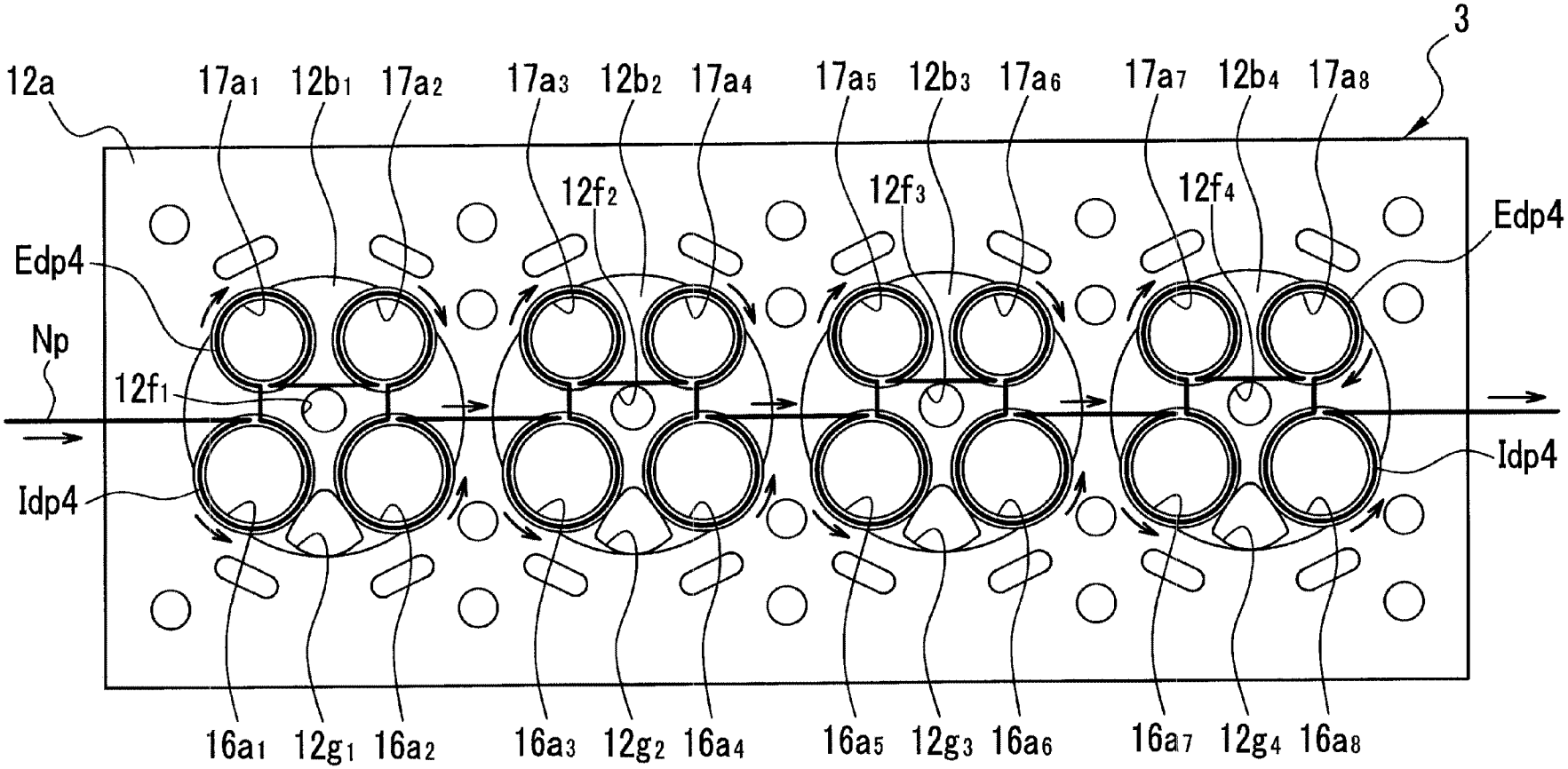
FIG. 18A is a plan view of the semimanufactured cylinder head illustrating a nozzle movement path for forming the valve seat coats on each of a plurality of combustion chamber upper wall portions according to the coating method of a fourth embodiment of the present invention.
Figure 19:
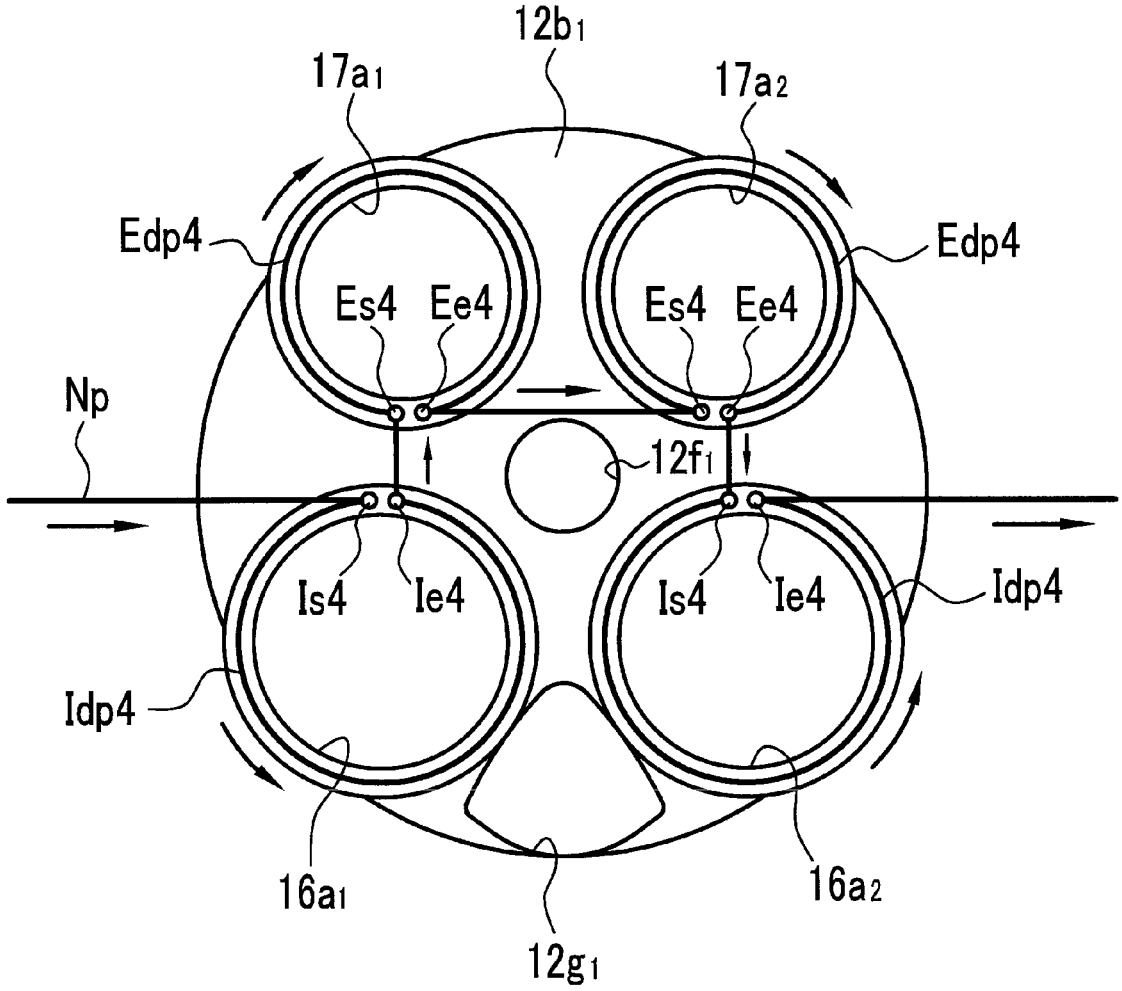
FIG. 19 is an enlarged plan view of a part of the semimanufactured cylinder head and nozzle movement path illustrated in FIG. 18A.

A fourth embodiment regarding the nozzle movement path will then be described. FIG. 18A is a plan view illustrating the cylinder block mounting surface 12$a$ of the semimanufactured cylinder head 3 and illustrates a nozzle movement path Np for forming the valve seat coats 16$b$ and 17$b$ at the opening portions 16$a_1$ to 16$a_8$ of the intake ports 16 and at the opening portions 17$a_1$ to 17$a_8$ of the exhaust ports 17. FIG. 19 illustrates an enlarged view of the leftmost combustion chamber upper wall portion 12$b_1$ of the semimanufactured cylinder head 3 illustrated in FIG. 18A.

When the semimanufactured cylinder head 3 has a plurality of combustion chamber upper wall portions 12$b_1$ to 12$b_4$ and the combustion chamber upper wall portions 12$b_1$ to 12$b_4$ include respective opening portions 16$a_1$ to 16$a_8$ and respective opening portions 17$a_1$ to 17$a_8$, the nozzle movement path Np is used to form the valve seat coats 16$b$ and 17$b$ for each of the combustion chamber upper wall portions 12$b_1$ to 12$b_4$. The nozzle movement path Np is connected to coating paths for air intake Idp4 for forming the valve seat coats 16$b$ at the opening portions 16$a_1$ to 16$a_8$ and coating paths for air exhaust Edp4 for forming the valve seat coats 17*b* at the opening portions 17$a_1$ to 17$a_8$.

Specifically, the nozzle 23*d* moves along the nozzle movement path Np as follows. The nozzle 23*d* linearly moves on the nozzle movement path Np along the arrangement direction of the opening portions 16$a_1$ to 16$a_8$, that is, the longitudinal direction of the semimanufactured cylinder head 3, while spraying the raw material powder P. After moving from the outside of the semimanufactured cylinder head 3 to above the cylinder block mounting surface 12*a*, the nozzle 23*d* passes above the cylinder block mounting surface 12*a* and moves to above the first opening portion 16$a_1$. When reaching the first coating start position Is4 at which the nozzle movement path Np is in contact with the coating path for air intake Idp4, the nozzle 23*d* moves above the opening portion 16$a_1$ in the counterclockwise direction so as to trace over the opening portion 16$a_1$ along the coating path for air intake Idp4 and forms the valve seat coat 16*b* on the annular valve seat portion 16*c* of the opening portion 16$a_1$.

After moving to the coating end position Ie4 of the opening portion 16$a_1$, the nozzle 23*d* moves above the combustion chamber upper wall portion 12$b_1$ along the width direction of the semimanufactured cylinder head 3 and moves to the coating start position Es4 for the next opening portion 17$a_1$. When reaching the coating start position Es4 for the opening portion 17$a_1$, the nozzle 23*d* moves above the opening portion 17$a_1$ in the clockwise direction in the figure so as to trace over the opening portion 17$a_1$ and forms the valve seat coat 17*b* on the annular valve seat portion 17*c* of the opening portion 17$a_1$.

After moving to the coating end position Ee4 of the opening portion 17$a_1$, the nozzle 23*d* moves again above the combustion chamber upper wall portion 12$b_1$ along the longitudinal direction of the semimanufactured cylinder head 3 and moves to the coating start position Es4 for the next opening portion 17$a_2$. When reaching the coating start position Es4 for the opening portion 17*a*2, the nozzle 23*d* moves above the opening portion 17$a_2$ in the clockwise direction in the figure so as to trace over the opening portion 17$a_2$ and forms the valve seat coat 17*b* on the annular valve seat portion 17*c* of the opening portion 17$a_2$.

After moving to the coating end position Ee4 of the opening portion 17*a*2, the nozzle 23*d* moves again above the combustion chamber upper wall portion 12$b_1$ along the width direction of the semimanufactured cylinder head 3 and moves to the coating start position Is4 for the next opening portion 16$a_2$. When reaching the coating start position Is4 for the opening portion 16*a*2, the nozzle 23*d* moves above the opening portion 16$a_2$ in the counterclockwise direction in the figure so as to trace over the opening portion 16$a_2$ and forms the valve seat coat 16*b* on the annular valve seat portion 16*c* of the opening portion 16$a_2$.

After moving to the coating end position Ie4 of the opening portion 16*a*2, the nozzle 23*d* moves above the combustion chamber upper wall portion 12$b_1$ and above the cylinder block mounting surface 12*a* again along the longitudinal direction of the semimanufactured cylinder head 3 and moves to the coating start position Is4 for the opening portion 16$a_3$ of the next combustion chamber upper wall portion 12*b*2. After that, the nozzle 23*d* forms the valve seat coats 16*b* and 17*b* at the opening portions 16$a_3$ to 16$a_8$ and opening portions 17$a_3$ to 17$a_8$ of the combustion chamber upper wall portions 12$b_2$ to 12$b_4$ in the same manner as for the opening portions 16$a_1$, 16*a*2, 17$a_1$, and 17$a_2$. After finishing the formation of the valve seat coat 16*b* for the final opening portion 16$a_8$, the nozzle 23*d* moves above the combustion chamber upper wall portion 12$b_4$ and above the cylinder block mounting surface 12*a* along the nozzle movement path Np and is moved to the outside of the semimanufactured cylinder head 3.

Figure 18B:
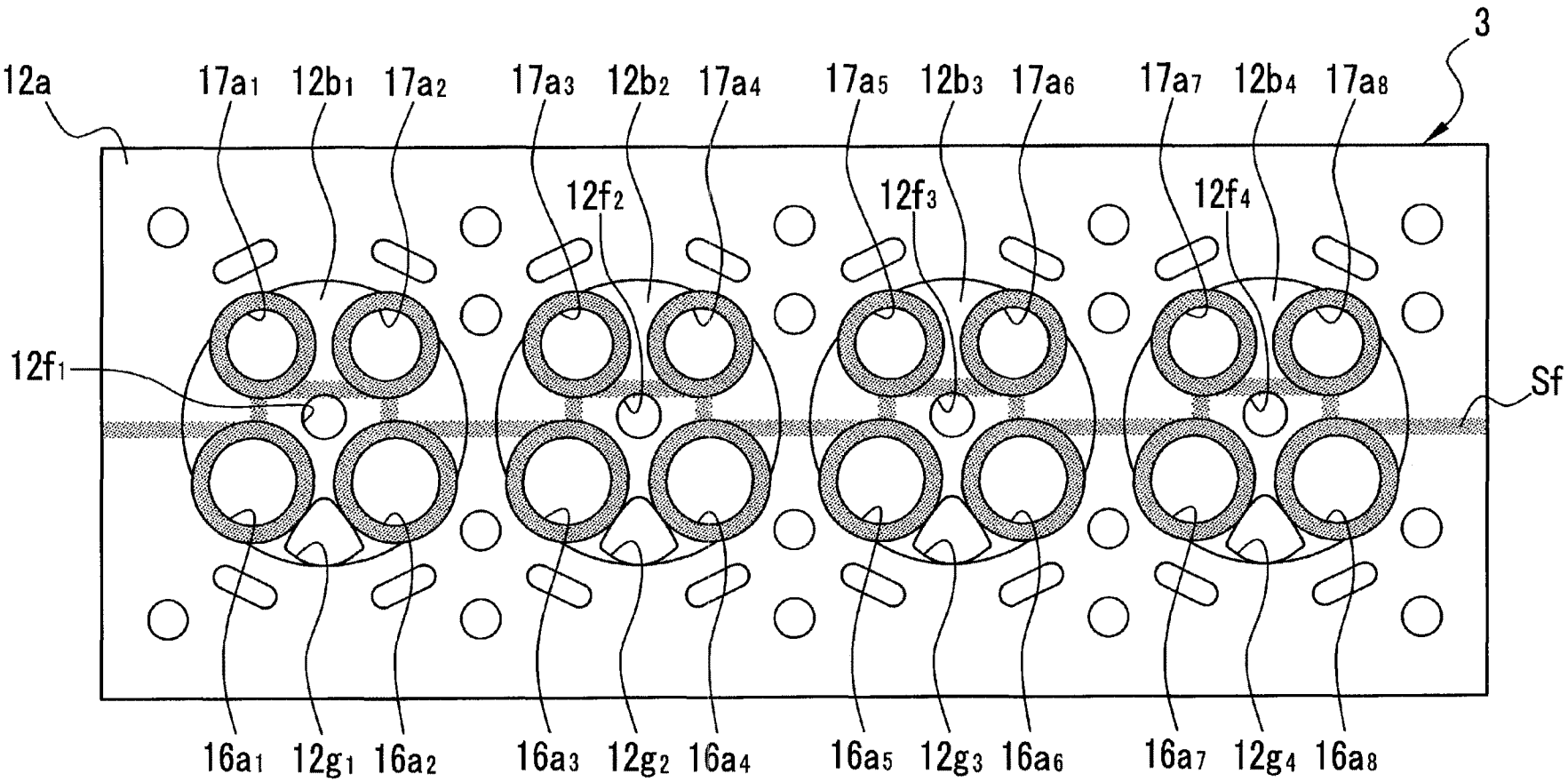
FIG. 18B is a plan view of the semimanufactured cylinder head illustrating excessive coats formed by the nozzle of the cold spray apparatus moving along the nozzle movement path illustrated in FIG. 18A.

FIG. 18B illustrates the cylinder block mounting surface 12*a* of the semimanufactured cylinder head 3 after the valve seat coats 16*b* and 17*b* are formed. As illustrated in FIG. 18B, the valve seat coats 16*b* are formed at the opening portions 16$a_1$ to 16$a_8$ of the intake ports 16, and the valve seat coats 17*b* are formed at the opening portions 17$a_1$ to 17$a_8$ of the exhaust ports 17. In addition, excessive coats Sf are formed on the cylinder block mounting surface 12*a* and the combustion chamber upper wall portions 12$b_1$ to 12$b_4$, but the excessive coats Sf are not formed in the intake ports 16 or the exhaust ports 17.

According to this embodiment, the nozzle 23*d* is moved between any two of the opening portions 16$a_1$ to 16$a_8$ and opening portions 17$a_1$ to 17$a_8$ while continuing to spray the raw material powder P, and the nozzle 23*d* is made so as not to move above the opening portions 16$a_1$ to 16$a_8$ or the opening portions 17$a_1$ to 17$a_8$; therefore, the problems (1) and (2) can be overcome as in the first embodiment and the second embodiment. Moreover, it is possible to suppress the formation of the excessive coats Sf not only in the intake ports 16 and the exhaust ports 17 but also in the plug holes 12$f_1$ to 12$f_4$ and the injector holes 12$g_1$ to 12$g_4$.

Furthermore, in the cold spray method, the higher the temperature of the coating portions to be formed with coats, the easier the coating portions and the raw material powder P can be plastically deformed; therefore, the higher the temperature of the coating portions to be formed with coats, the stronger the raw material powder P can adhere to the coating portions. According to the present embodiment, the valve seat coats 16*b* and 17*b* are formed for each of the combustion chamber upper wall portions 12$b_1$ to 12$b_4$ thereby to allow the temperature of the combustion chamber upper wall portions 12$b_1$ to 12$b_4$ formed with the valve seat coats 16*b* and 17*b* to be maintained at a high temperature, and the raw material powder P can therefore adhere strongly to the combustion chamber upper wall portions 12$b_1$ to 12$b_4$ to form the valve seat coats 16*b* and 17*b* having excellent high-temperature abrasion resistance.

Furthermore, in the present embodiment, the valve seat coats 16*b* and 17*b* are formed for each of the combustion chamber upper wall portions 12$b_1$ to 12$b_4$, and the valve seat coats 16*b* and 17*b* can therefore be repaired for each of the combustion chamber upper wall portions 12$b_1$ to 12$b_4$.

Fifth Embodiment

A fifth embodiment regarding the nozzle movement path or paths will then be described. In this embodiment, when the nozzle 23*d* moves along the nozzle movement path, the injection angle of the raw material powder P with respect to the injection surface onto which the raw material powder P is injected, that is, the injection angle of the raw material powder P with respect to the cylinder block mounting surface 12*a* or the combustion chamber upper wall portions 12$b_1$ to 12$b_4$, is made different from an injection angle θ1 of the raw material powder P with respect to the opening portions 16$a_1$ to 16$a_8$ or the opening portions 17$a_1$ to 17$a_8$, which are the coating portions, thereby to change the width and thickness of the excessive coats formed on the cylinder block mounting surface 12*a* or the combustion chamber upper wall portions 12$b_1$ to 12$b_4$. The following description will be made for a pattern (1) in which the injection angle of the raw material powder P with respect to the cylinder block mounting surface 12*a* or the combustion chamber upper wall portions $12b_1$ to $12b_4$ is made approximately horizontal along the nozzle movement path and a pattern (2) in which the injection angle of the raw material powder P with respect to the cylinder block mounting surface 12*a* or the combustion chamber upper wall portions $12b_1$ to $12b_4$ is made approximately vertical along the nozzle movement path.

Figure 20A:
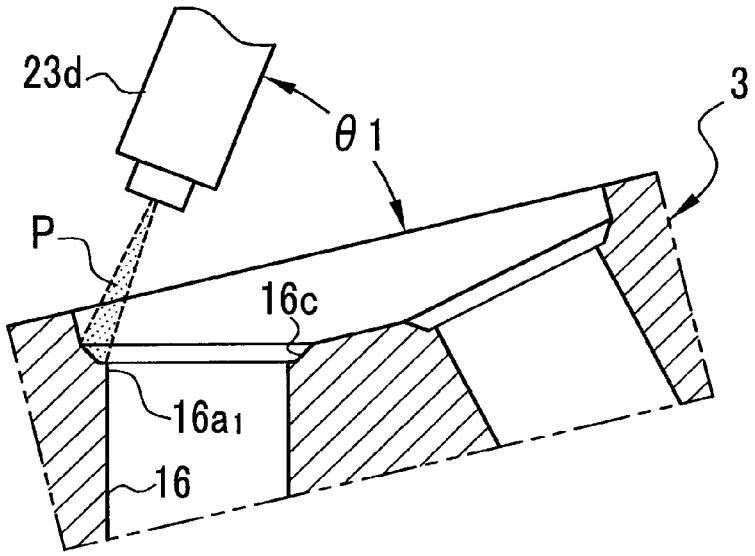
FIG. 20AA is a cross-sectional view illustrating a spraying angle of raw material powder in the coating methods according to the first to fourth embodiments of the present invention and illustrates the spraying angle when forming a valve seat coat.
Figure 20A:
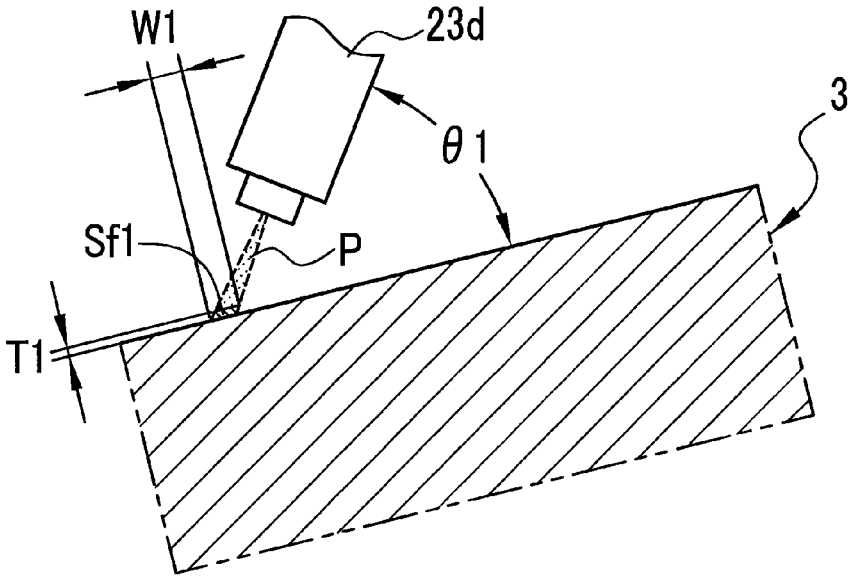

First, the injection angle of the raw material powder P in the first embodiment will be described. In the first embodiment, as illustrated in FIG. 20AA, when the nozzle 23*d* is moved along the coating path for air intake Idp1 on the opening portion $16a_1$ to form the valve seat coat 16*b* on the annular valve seat portion 16*c*, the injection angle θ1 of the raw material powder P from the nozzle 23*d* is set so that the raw material powder P is sprayed onto the annular valve seat portion 16*c* in a direction approximately perpendicular to the annular valve seat portion 16*c*. In the first embodiment, as illustrated in FIG. 20AB, when the nozzle 23*d* is moved along the nozzle movement path for air intake Inp1, the injection angle θ1 of the raw material powder P from the nozzle 23*d* is not changed. The excessive coat Sf1 is therefore formed on the cylinder block mounting surface 12*a* with a width W1 and a thickness T1 in accordance with the injection angle θ1.

Figure 20B:
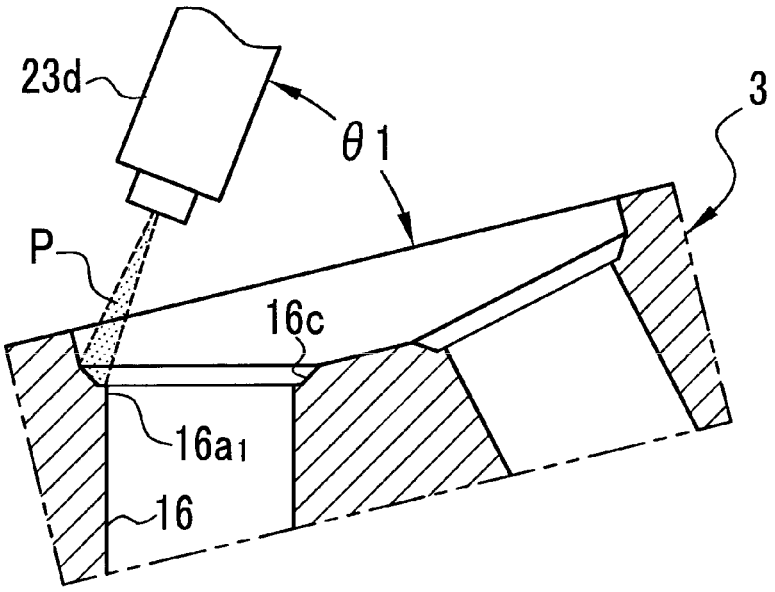
FIG. 20BA is a cross-sectional view illustrating spraying angles of raw material powder in the coating method according to a fifth embodiment of the present invention and illustrates the spraying angle when forming a valve seat coat.
Figure 20B:
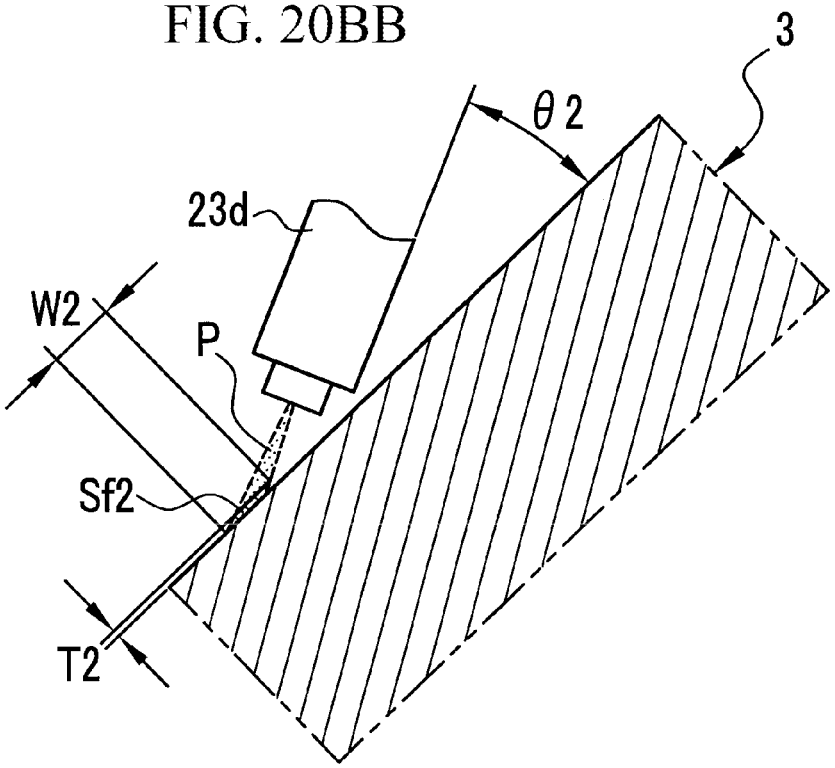

On the other hand, in the pattern (1) of the present embodiment, when the nozzle 23*d* is moved along the coating path for air intake Idp1 on the opening portion $16a_1$ to form the valve seat coat 16*b* on the annular valve seat portion 16*c*, as illustrated in FIG. 20B A, the injection angle of the raw material powder P from the nozzle 23*d* is set to $\theta_1$ as in the first to fourth embodiments. In the present embodiment, however, when the nozzle 23*d* is moved along the nozzle movement path for air intake Inp1, as illustrated in FIG. 20BB, the injection angle θ2 of the raw material powder P with respect to the cylinder block mounting surface 12*a* is set smaller than the injection angle θ1. For example, the injection angle θ2 is set as close to parallel to the cylinder block mounting surface 12*a* as possible. Through this setting, the width W2 of the excessive coat Sf2 formed on the cylinder block mounting surface 12*a* is wider than the width W1 in the first to fourth embodiments, but the thickness T2 is thinner than the thickness T1 of the excessive coat Sf1.

Figure 20C:
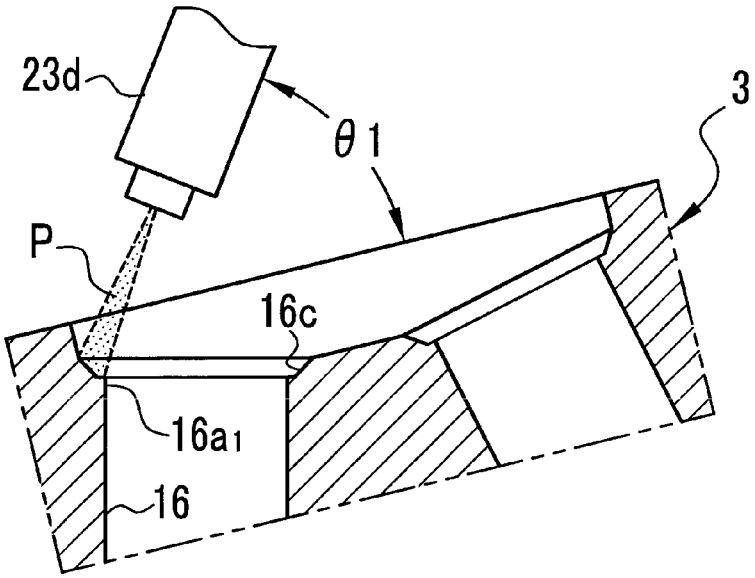
FIG. 20CA is a cross-sectional view illustrating spraying angles of raw material powder in the coating method according to the fifth embodiment of the present invention and illustrates the spraying angle when forming a valve seat coat.
Figure 20C:
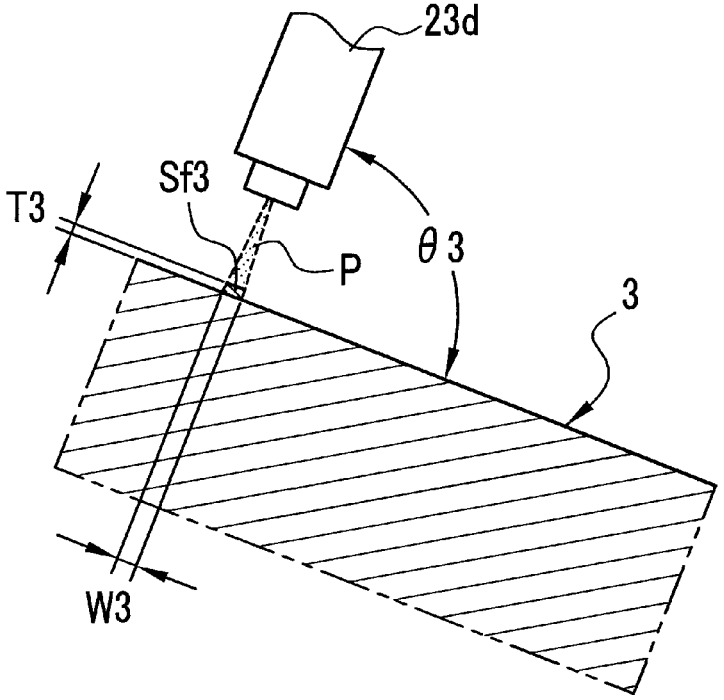

In the pattern (2) of the present embodiment, when the nozzle 23*d* is moved along the coating path for air intake Idp1 on the opening portion $16a_1$ to form the valve seat coat 16*b* on the annular valve seat portion 16*c*, as illustrated in FIG. 20CA, the injection angle of the raw material powder P from the nozzle 23*d* is set to 01 as in the pattern (1). In the present embodiment, however, when the nozzle 23*d* is moved along the nozzle movement path for air intake Inp1, as illustrated in FIG. 20CB, the injection angle θ3 of the raw material powder P with respect to the cylinder block mounting surface 12*a* is set larger than the angle θ1. For example, the injection angle θ3 is set approximately perpendicular to the cylinder block mounting surface 12*a*. Through this setting, the width W3 of the excessive coat Sf3 formed on the cylinder block mounting surface 12*a* is narrower than the width W1 in the first to fourth embodiments, but the thickness T3 is thicker than the thickness T1 of the excessive coat Sf1.

According to the pattern (1) of the present embodiment, the post-processing area applied to the semimanufactured cylinder head 3 to remove the excessive coat Sf2 is wider than that in the first embodiment because the width W2 of the excessive coat Sf2 is wider than the width W1 of the excessive coat Sf1. However, the depth of post-processing is shallower than that in the first embodiment because the thickness T2 of the excessive coat Sf2 is thinner than the thickness T1 of the excessive coat Sf1. The post-processing is therefore easier than that in the first embodiment if the excessive coat Sf2 is formed on the cylinder block mounting surface 12*a* on which the entire surface is cut in the finishing step S4.

According to the pattern (2) of the present embodiment, the depth of post-processing applied to the semimanufactured cylinder head 3 to remove the excessive coat Sf3 is deeper than that in the first embodiment because the thickness T3 of the excessive coat Sf3 is thicker than the thickness T1 of the excessive coat Sf1. However, the post-processing area is narrower than that in the first embodiment because the width W3 of the excessive coat Sf3 is narrower than the width W1 of the excessive coat Sf1. The post-processing is therefore easier than that in the first embodiment if the excessive coat Sf3 is formed on any of the combustion chamber upper wall portions $12b_1$ to $12b_4$ which have a narrower area than that of the cylinder block mounting surface 12*a* and also have curved surfaces or tilted surfaces.

Although not illustrated in detail, the present embodiment is also applied when the valve seat coats 17*b* are formed at the opening portions $17a_1$ to $17a_8$ of the exhaust ports 17. The present embodiment can also be applied when moving the nozzle 23*d* in the second to fourth embodiments. In the present embodiment, the pattern (1) may be applied to both the cylinder block mounting surface 12*a* and the combustion chamber upper wall portions $12b_1$ to $12b_4$, or the pattern (2) may also be applied to both the cylinder block mounting surface 12*a* and the combustion chamber upper wall portions $12b_1$ to $12b_4$. Alternatively, the pattern (1) may be applied to the cylinder block mounting surface 12*a* while the pattern (2) may be applied to the combustion chamber upper wall portions $12b_1$ to $12b_4$.

In the above fifth embodiment, when the nozzle 23*d* moves along the nozzle movement path, the injection angle of the raw material powder P from the nozzle 23*d* is changed. Additionally or alternatively, for example, when the nozzle 23*d* moves along the nozzle movement path, the moving speed of the nozzle 23*d* may be set faster than the moving speed for forming the valve seat coats 16*b* and 17*b*. This can reduce the thickness of the excessive coats formed on the cylinder block mounting surface 12*a* and the combustion chamber upper wall portions $12b_1$ to $12b_4$.

Figure 21:
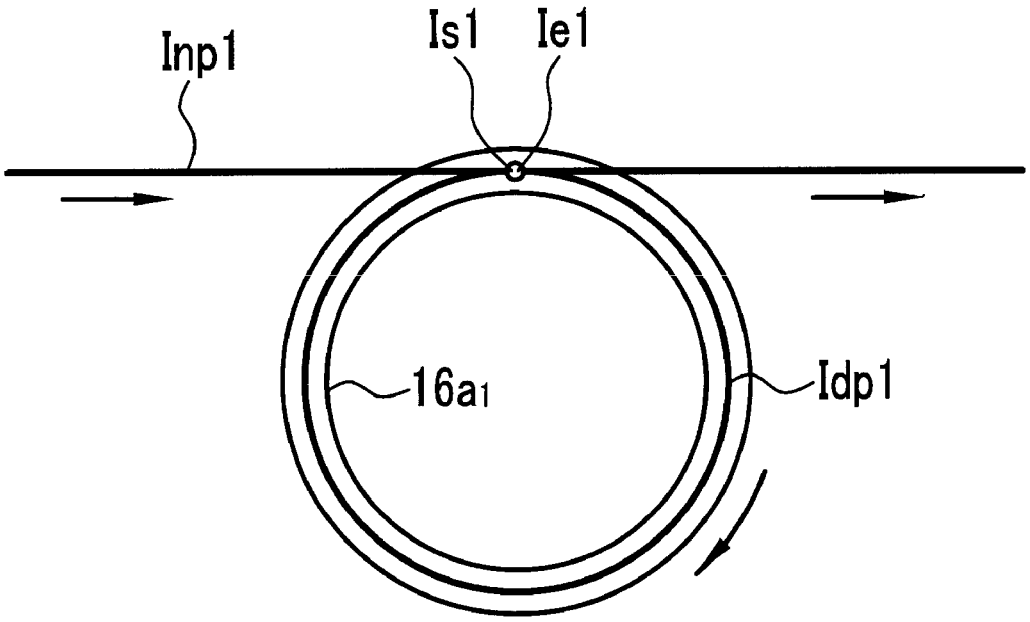
FIG. 21 illustrates another example of the moving direction when the nozzle of the cold spray apparatus moves along a coating path in the coating methods according to the first to fifth embodiments of the present invention.

In the above first to fifth embodiments, as illustrated in FIG. 10, for example, when the nozzle 23*d* reaches the coating start position Is1, the moving direction of the nozzle 23*d* is switched to an approximately opposite direction to move to the coating path for air intake Idp1, and when the nozzle 23*d* having moved along the coating path for air intake Idp1 reaches the coating end position Ie1, the moving direction of the nozzle 23*d* is switched again to an approximately opposite direction to move to the nozzle movement path for air intake Inp1. Through this operation, the timing of switching the moving direction of the nozzle 23*d* in the approximately opposite direction can be adjusted thereby to change the width in which the end portions of the valve seat coat 16*b* overlap to form a thick portion. However, as illustrated in FIG. 21, when the nozzle 23*d* reaches the coating start position Is1, the nozzle 23*d* may be moved to the coating path for air intake Idp1 without switching the moving direction of the nozzle 23*d* to an approximately opposite direction, and when the nozzle 23*d* reaches the coating end position Ie1, the nozzle 23*d* may be moved to the nozzle movement path for air intake Inp1 without switching the moving direction of the nozzle 23*d* to an approximately opposite direction.

The above first to fifth embodiments have been described by exemplifying the opening portions 16$a_1$ to 16$a_8$ of the intake ports 16 and the opening portions 17$a_1$ to 17$a_8$ of the exhaust port 17 of the semimanufactured cylinder head 3 as the plurality of coating portions of the coating target component, but the present invention can also be applied to other coating target components.

For example, in the cylinder block 11 illustrated in FIG. 1, the present invention may be applied when forming coats on the inner surfaces of the four cylinders 11*a* arranged in the depth direction of the drawing using the cold spray apparatus 2. Specifically, when the nozzle 23*d* forms coats on the inner surfaces of the four cylinders 11*a*, during the movement of the nozzle 23*d* from a cylinder 11*a* having been formed with a coat to the adjacent cylinder 11*a* to be subsequently formed with a coat, the nozzle 23*d* can continue to inject the raw material powder P along the nozzle movement path thereby to shorten the cycle time.

Additionally or alternatively, in the crankshaft 14 illustrated in FIG. 1, the present invention may be applied when forming coats on a plurality of journal portions 14*a* provided in the depth direction of the drawing using the cold spray apparatus 2. Specifically, when the nozzle 23*d* forms coats on the plurality of journal portions 14*a*, during the movement of the nozzle 23*d* from a journal portion 14*a* having been formed with a coat to the adjacent journal portion 14*a* to be subsequently formed with a coat, the nozzle 23*d* can continue to inject the raw material powder P along the nozzle movement path thereby to shorten the cycle time. In this case, it is preferred to perform the coating while adjusting the nozzle movement path and the rotational position of the crankshaft 14 so that excessive coats are not formed on crankpins 14*b* arranged between the journal portions 14*a*.

As described above, the coating method according to one or more embodiments of the present invention is a method used for forming a coat on each of a plurality of coating portions that are not continuous with one another. The coating portions are provided on a coating target component such as the semimanufactured cylinder head 3, the cylinder block 11, or the crank shaft 14. This method includes relatively moving the coating target component and the nozzle 23*d* of the cold spray apparatus 2 to cause each of the plurality of coating portions and the nozzle 23*d* to sequentially face each other and spraying the raw material powder P from the nozzle 23*d* onto the coating portions facing the nozzle 23*d*. When the nozzle 23*d* is located on a nozzle movement path from a coating portion having been formed with the coat to another coating portion to be subsequently formed with the coat, injection of the raw material powder P from the nozzle 23*d* is continued. This allows the cycle time to be shorter than that when forming coats on the plurality of coating portions by repeating the spraying of the raw material powder P and its stopping.

According to the coating methods of the first to fifth embodiments of the present invention, in the semimanufactured cylinder head 3 which is the coating target component, when the valve seat coats 16*b* and 17*b* are formed on the annular edge portions of the opening portions 16$a_1$ to 16$a_8$ and opening portions 17$a_1$ to 17$a_8$ which are the plurality of coating portions, the semimanufactured cylinder head 3 and the nozzle 23*d* of the cold spray apparatus 2 are relatively moved to cause each of the annular edge portions of the plurality of opening portions 16$a_1$ to 16$a_8$ and opening portions 17$a_1$ to 17$a_8$ and the nozzle 23*d* to face each other, and the nozzle 23*d* sprays the raw material powder P onto each of the annular edge portions of the opening portions 16$a_1$ to 16$a_8$ and opening portions 17$a_1$ to 17$a_8$ facing the nozzle 23*d*. Then, when the nozzle 23*d* is located on the nozzle movement path for air intake Inp1 or Inp 2, the nozzle movement path for air exhaust Enp1 or Enp 2, or the nozzle movement path Np along which the nozzle 23*d* is moved from an opening portion having been formed with the valve seat coat to another opening portion to be subsequently formed with the valve seat coat, injection of the raw material powder P from the nozzle 23*d* is continued. This allows the cycle time of the coating step S3 to be shorter than that when forming the valve seat coats 16*b* and 17*b* at the plurality of opening portions 16$a_1$ to 16$a_8$ and opening portions 17$a_1$ to 17$a_8$ by repeating the spraying of the raw material powder P and its stopping.

According to the coating methods of the first to fifth embodiments, the nozzle movement paths for air intake Inp1 and Inp 2, the nozzle movement paths for air exhaust Enp1 and Enp 2, and the nozzle movement path Np are set so that the nozzle 23*d* does not move above the opening portions 16$a_1$ to 16$a_8$ of the intake ports 16 or the opening portions 17$a_1$ to 17$a_8$ of the exhaust ports 1, and it is therefore possible to prevent the excessive coats Sf from being formed at positions in the intake ports 16 or the exhaust ports 17 from which the excessive coats Sf cannot be removed.

According to the coating methods of the first to fifth, the nozzle movement paths for air intake Inp1 and Inp 2, the nozzle movement paths for air exhaust Enp1 and Enp 2, and the nozzle movement path Np are set so that the nozzle 23*d* moves above the cylinder block mounting surface 12*a*, and the excessive coats Sf are therefore formed on the cylinder block mounting surface 12*a*. However, fortunately, the cylinder block mounting surface 12*a* has been conventionally post-processed using a milling machine or the like to improve the flatness, and the excessive coats Sf formed on the cylinder block mounting surface 12*a* can therefore be removed without providing any new step.

According to the coating methods of the first to fifth embodiments, the nozzle movement paths for air intake Inp1 and Inp 2, the nozzle movement paths for air exhaust Enp1 and Enp 2, and the nozzle movement path Np are set so that the nozzle 23*d* moves above the combustion chamber upper wall portions 12$b_1$ to 12$b_4$, and the excessive coats Sf are therefore formed on the combustion chamber upper wall portions 12$b_1$ to 12$b_4$. However, fortunately, the excessive coats Sf on the combustion chamber upper wall portions 12$b_1$ to 12$b_4$ can be removed relatively easily because the combustion chamber upper wall portions 12$b_1$ to 12$b_4$ are exposed to the outside. The excessive coats Sf otherwise may not have to be removed if they do not affect the combustion performance of the engine 1, so the cycle time for the semimanufactured cylinder head 3 is not affected.

According to the coating methods of the first to fifth embodiments, the nozzle movement paths for air intake Inp1 and Inp2 are set linearly along the arrangement direction of the opening portions 16$a_1$ to 16$a_8$, and the coating start positions Is1 and Is2 and the coating end positions Ie1 and Ie2 are set on the nozzle movement paths for air intake Inp1 and Inp2. Likewise, the nozzle movement paths for air exhaust Enp1 and Enp2 are set linearly along the arrangement direction of the opening portions 17$a_1$ to 17$a_8$, and the coating start positions Es1 and Es2 and the coating end positions Ee1 and Ee2 are set on the nozzle movement paths for air exhaust Enp 1 and Enp2. The nozzle movement path Np is set linearly along the arrangement direction of the opening portions 16$a_1$ to 16$a_8$, and the coating start positions Is4 and the coating end positions Ie4 are set on the nozzle movement path Np. It is therefore possible to shorten the distance along which the nozzle 23*d* uselessly injects the raw material powder P, that is, the distance along which the excessive coats Sf are formed. This can suppress the waste of the raw material powder P and reduce the number of steps for removing the excessive coats Sf.

According to the coating method of the first embodiment, the nozzle movement path for air intake Inp1 and the nozzle movement path for air exhaust Enp 1 are set between the opening portions $\mathbf{16}a_1$ to $\mathbf{16}a_8$ of the intake ports 16 and the opening portions $\mathbf{17}a_1$ to $\mathbf{17}a_8$ of the exhaust ports 17, and the raw material powder can therefore be sprayed between the opening portions $\mathbf{16}a_1$ to $\mathbf{16}a_8$ and the opening portions $\mathbf{17}a_1$ to $\mathbf{17}a_8$ to form the excessive coats Sf for applying the compressive residual stress. This can further enhance the strength between the opening portions $\mathbf{16}a_1$ to $\mathbf{16}a_8$ and the opening portions $\mathbf{17}a_1$ to $\mathbf{17}a_8$.

According to the coating method of the first embodiment, the excessive coats Sf are not formed in any of the injector holes $\mathbf{12}g_1$ to $\mathbf{12}g_4$ because the nozzle movement path for air intake Inp1 and the nozzle movement path for air exhaust Enp1 are set between the opening portions $\mathbf{16}a_1$ to $\mathbf{16}a_8$ and the opening portions $\mathbf{17}a_1$ to $\mathbf{17}a_8$. When using the nozzle movement path for air intake Inp1 and the nozzle movement path for air exhaust Enp 1, the excessive coats Sf are formed in the plug holes $\mathbf{12}f_1$ to $\mathbf{12}f_4$, but the plug holes $\mathbf{12}f_1$ to $\mathbf{12}f_4$ are necessarily post-processed to form threaded bores for the spark plugs, and the excessive coats Sf can be removed by that post-processing.

According to the coating method of the second embodiment, the nozzle movement path for air intake Inp2 is set between the edge portions of the combustion chamber upper wall portions $\mathbf{12}b_1$ to $\mathbf{12}b_4$ and the opening portions $\mathbf{16}a_1$ to $\mathbf{16}a_8$. Likewise, the nozzle movement path for air exhaust Enp2 is set between the edge portions of the combustion chamber upper wall portions $\mathbf{12}b_1$ to $\mathbf{12}b_4$ and the opening portions $\mathbf{17}a_1$ to $\mathbf{17}a_8$. The heat generated during the cold spray is therefore dissipated and the valve seat coats 16*b* and 17*b* can be formed in which the residual stress is less likely to accumulate.

According to the coating method of the third embodiment, the nozzle movement path for air intake Inp1 or nozzle movement path for air exhaust Enp1 of the first embodiment and the nozzle movement path for air intake Inp2 or nozzle movement path for air exhaust Enp2 of the second embodiment can be combined as appropriate thereby to exhibit effects resulting from the effect obtained by the first embodiment and the effect obtained by the second embodiment. That is, the raw material powder is sprayed between the opening portions $\mathbf{16}a_1$ to $\mathbf{16}a_8$ and the opening portions $\mathbf{17}a_1$ to $\mathbf{17}a_8$ to form the excessive coats Sf thereby to apply the compressive residual stress, thus further improve the strength between the opening portions $\mathbf{16}a_1$ to $\mathbf{16}a_8$ and the opening portions $\mathbf{17}a_1$ to $\mathbf{17}a_8$, and the heat generated during the cold spray can be dissipated, so that the valve seat coats 16*b* or the valve seat coats 17*b* can be formed in which the residual stress is less likely to accumulate.

According to the coating method of the fourth embodiment, the valve seat coats 16*b* and 17*b* are formed for each of the combustion chamber upper wall portions $\mathbf{12}b_1$ to $\mathbf{12}b_4$ thereby to allow the temperature of the combustion chamber upper wall portions $\mathbf{12}b_1$ to $\mathbf{12}b_4$ formed with the valve seat coats 16*b* and 17*b* to be maintained at a high temperature, and the raw material powder P can therefore adhere strongly to the combustion chamber upper wall portions $\mathbf{12}b_1$ to $\mathbf{12}b_4$ to form the valve seat coats 16*b* and 17*b* having excellent high-temperature abrasion resistance. Moreover, the valve seat coats 16*b* and 17*b* can be repaired for each of the combustion chamber upper wall portions $\mathbf{12}b_1$ to $\mathbf{12}b_4$.

According to the coating method of the fifth embodiment, in the nozzle movement path for air intake Inp1 or Inp 2, the nozzle movement path for air exhaust Enp1 or Enp 2, or the nozzle movement path Np, the injection angle θ2 or θ3 of the raw material powder P from the nozzle 23*d* can be made different from the injection angle θ1 of the raw material powder P with respect to the opening portions $\mathbf{16}a_1$ to $\mathbf{16}a_8$ or the opening portions $\mathbf{17}a_1$ to $\mathbf{17}a_8$, which are the coating portions, thereby to change the width and thickness of the excessive coats formed on the cylinder block mounting surface 12*a* or the combustion chamber upper wall portions $\mathbf{12}b_1$ to $\mathbf{12}b_4$. Thus, the width and thickness of the excessive coats can be changed in accordance with the shapes of surfaces to be formed with the excessive coats, the presence or absence of post-processing, and the like, and the removal of the excessive coats therefore becomes easy by appropriately selecting the width and thickness of the excessive coats.

DESCRIPTION OF REFERENCE NUMERALS

1 Engine
- 11 Cylinder block
- 11*a* Cylinder
- 12 Cylinder head
- 12*a* Cylinder block mounting surface
- $\mathbf{12}b_1$ to $\mathbf{12}b_4$ Combustion chamber upper wall portion
- $\mathbf{12}f_1$ to $\mathbf{12}f_4$ Plug hole
- $\mathbf{12}g_1$ to $\mathbf{12}g_4$ Injector hole
- 16 Intake port
- $\mathbf{16}a_1$ to $\mathbf{16}a_8$ Opening portion
- 16*b* Valve seat coat
- 16*c* Annular valve seat portion
- 17 Exhaust port
- $\mathbf{17}a_1$ to $\mathbf{17}a_8$ Opening portion
- 17*b* Valve seat coat
- 17*c* Annular valve seat portion
- 18 Intake valve
- 19 Exhaust valve

2 Cold spray apparatus
- 23*d* Nozzle

Cs1 to Cs4 Compressive residual stress
Inp1, Inp2 Nozzle movement path for air intake
Idp1, Idp2, Idp4 Coating path for air intake
Enp1, Enp2 Nozzle movement path for air exhaust
Edp1, Edp2, Edp4 Coating path for air exhaust
Np Nozzle movement path
P Raw material powder
Sf, Sf1 to Sf3 Excessive coat
θ1 to θ3 Injection angle

The invention claimed is:

1. A coating method comprising:

preparing a semi-manufactured cylinder head comprising:

a main body portion with a cylinder block mounting surface, a combustion chamber upper wall portion provided at the cylinder block mounting surface, and a plurality of intake ports and a plurality of exhaust ports, where each intake port and each exhaust port includes an opening portion, and the opening portions are not continuous with one another;

causing each of the plurality of opening portions and a nozzle of a cold spray apparatus to sequentially face each other while relatively moving the semi-manufactured cylinder head and the nozzle; and spraying a raw material powder onto annular edge portions of the opening portions facing the nozzle using a cold spray method to form a valve seat coat on each of the plurality of opening portions, wherein:

in a nozzle movement path from an opening portion having been formed with the valve seat coat to another opening portion to be subsequently formed with the valve seat coat, injection of the raw material powder from the nozzle is continued, and the raw material powder is sprayed on the cylinder head between the opening portions of the intake ports and the opening portions of exhaust ports to apply compressive residual stress.

2. The coating method according to claim 1, wherein the nozzle movement path is set so that the nozzle does not move above the opening portions.

3. The coating method according to claim 2, wherein the nozzle movement path is set so that the nozzle moves above the cylinder block mounting surface.

4. The coating method according to claim 2, wherein the nozzle movement path is set so that the nozzle moves above the combustion chamber upper wall portion.

5. The coating method according to claim 2, wherein the nozzle movement path is linearly set along an arrangement direction in which the plurality of opening portions is arranged, and the nozzle movement path is set with coating start positions at which the nozzle starts spraying the raw material powder onto the annular edge portions of the opening portions and coating end positions at which the nozzle finishes spraying the raw material powder onto the annular edge portions of the opening portions.

6. The coating method according to claim 2, wherein the nozzle movement path is set so that the nozzle moves between the opening portions of intake ports and the opening portions of exhaust ports.

7. The coating method according to claim 2, wherein the nozzle movement path is set so that the nozzle moves between an edge portion of the combustion chamber upper wall portion and the opening portions.

8. The coating method according to claim 2, wherein the semi-manufactured cylinder head has a plurality of combustion chamber upper wall portions, and when each of the plurality of combustion chamber upper wall portions comprises at least two of the intake ports and at least two of the exhaust ports, the valve seat coat is formed on each of the annular edge portions of the opening portions of said at least two of the intake portions and said at least two of the exhaust ports of each of the combustion chamber upper wall portions.

9. The coating method according to claim 1, wherein an angle of the nozzle in the nozzle movement path is set larger or smaller than an angle of the nozzle at the annular edge portions of the opening portions.

* * * * *